US007263808B2

(12) United States Patent
Massey et al.

(10) Patent No.: US 7,263,808 B2
(45) Date of Patent: Sep. 4, 2007

(54) ADJUSTABLE RAIL ASSEMBLY FOR EXTERIOR DOOR STILL ASSEMBLY AND COMPONENTS FOR THE SAME

(75) Inventors: Victor T. Massey, Winston-Salem, NC (US); Matthew White, Charlotte, NC (US)

(73) Assignee: Premdor International, Inc. (BB)

( * ) Notice: Subject to any disclaimer, the term of this patent is extended or adjusted under 35 U.S.C. 154(b) by 231 days.

(21) Appl. No.: 10/673,639

(22) Filed: Sep. 30, 2003

(65) Prior Publication Data

US 2004/0139667 A1 Jul. 22, 2004

Related U.S. Application Data

(60) Provisional application No. 60/441,079, filed on Jan. 21, 2003, provisional application No. 60/441,106, filed on Jan. 21, 2003, provisional application No. 60/414,653, filed on Oct. 1, 2002, provisional application No. 60/414,652, filed on Oct. 1, 2002.

(51) Int. Cl.
*E06B 1/04* (2006.01)

(52) U.S. Cl. ..... 52/204.1

(58) Field of Classification Search ..... 52/204.1, 52/717.01, 717.02, 204.51; 49/467, 469, 49/471, 504, 505

See application file for complete search history.

(56) References Cited

U.S. PATENT DOCUMENTS

| | | | | |
|---|---|---|---|---|
| 1,910,260 | A | 5/1933 | Reher | |
| 2,856,651 | A | 10/1958 | Hobbs | |
| 3,593,473 | A | 7/1971 | King | |
| 3,811,238 | A | 5/1974 | Brinker | |
| 3,851,420 | A | 12/1974 | Tibbetts | |
| 3,886,688 | A * | 6/1975 | Ragland | 49/504 |
| 3,888,046 | A | 6/1975 | Meisterheim | |
| 3,900,967 | A | 8/1975 | Bursk et al. | |
| 3,967,412 | A | 7/1976 | Governale | |
| 4,055,917 | A | 11/1977 | Coller | |
| 4,079,550 | A | 3/1978 | Bursk et al. | |
| 4,251,962 | A | 2/1981 | Langenhorst | |
| 4,287,684 | A | 9/1981 | McKann | |
| 4,310,991 | A | 1/1982 | Seely | |
| 4,352,258 | A | 10/1982 | Bursk et al. | |
| 4,387,535 | A | 6/1983 | Corbo | |

(Continued)

FOREIGN PATENT DOCUMENTS

JP 06093771 A * 4/1994

*Primary Examiner*—Jose V. Chen
(74) *Attorney, Agent, or Firm*—Berenato, White & Stavish

(57) ABSTRACT

A modular exterior threshold and door sill assembly is provided for an entryway. The threshold and sill assembly includes an elongated sill assembly having at least one elongated channel. An elongated rail assembly is provided that extends at least a portion of the length of the elongated sill assembly. A portion of the elongated rail assembly is received within the elongated channel. The threshold and sill assembly includes at least one sill component connected to one of the elongated rail assembly and the elongated channel, wherein the at least one sill component includes at least one of a cover assembly, an astragal bolt receiver assembly, a mullion boot assembly, a side panel spacer assembly and an outswing rail assembly. The elongated rail assembly may be fixed or adjustable. The adjustable rail assembly may be adjusted using adjustors that are fixedly secured to the sill assembly.

38 Claims, 55 Drawing Sheets

U.S. PATENT DOCUMENTS 4,411,104 A 10/1983 St. Aubin
4,488,378 A 12/1984 Symon
4,532,743 A 8/1985 Miller et al.
5,010,690 A * 4/1991 Geoffrey ..... 49/469
5,136,814 A 8/1992 Headrick
5,179,804 A 1/1993 Young
5,230,181 A 7/1993 Geoffrey et al.
5,426,894 A 6/1995 Headrick
5,477,647 A 12/1995 Yates, Jr.
5,483,775 A 1/1996 Redman
5,542,217 A 8/1996 Larivee, Jr.
5,603,585 A 2/1997 Bruchu et al.
5,611,173 A 3/1997 Headrick et al.
5,638,641 A * 6/1997 Joffe et al. ..... 49/469
5,647,172 A * 7/1997 Rokicki ..... 49/504
5,673,517 A 10/1997 Stanclift
5,901,510 A 5/1999 Ellingson
5,910,084 A 6/1999 Koike et al.
5,979,129 A 11/1999 Azar
6,041,560 A 3/2000 Larson et al.
6,052,949 A 4/2000 Procton et al.
6,058,665 A 5/2000 Halvorson, Jr. et al.
6,079,181 A * 6/2000 Ruff ..... 52/204.1
6,122,883 A 9/2000 Braun
6,125,599 A 10/2000 Mees et al.
6,145,164 A 11/2000 Ferrari et al.
6,148,572 A 11/2000 Ruff
6,185,870 B1 2/2001 Mettler
6,203,231 B1 3/2001 Salice
6,205,724 B1 3/2001 Garling et al.
6,219,971 B1 4/2001 Headrick
6,289,635 B1 9/2001 Procton et al.
6,308,475 B1 10/2001 Crish, II et al.
6,367,201 B1 4/2002 Massey et al.
6,371,188 B1 * 4/2002 Baczuk et al. ..... 49/467
6,415,565 B1 7/2002 Sosa
6,651,390 B2 * 11/2003 Camperelli ..... 49/504
6,684,573 B2 * 2/2004 Heath et al. ..... 49/467
2002/0138944 A1 10/2002 Schnelle et al.

* cited by examiner

ADJUSTABLE RAIL ASSEMBLY FOR EXTERIOR DOOR STILL ASSEMBLY AND COMPONENTS FOR THE SAME

CROSS REFERENCE TO RELATED APPLICATIONS

This application relates to and claims priority to the following: U.S. Provisional Patent Application No. 60/414,653, entitled "Exterior Door Sill Assembly," filed on Oct. 1, 2002; U.S. Provisional Patent Application No. 60/414,652, entitled "Astragal Assembly Bolt Receiver For Use With An Exterior Double Door System," filed Oct. 1, 2002; U.S. Provisional Patent Application No. 60/441,079, entitled "Adjustable Rail Assembly For Exterior Door Sill Having Integrated Adjuster," filed on Jan. 21, 2003; and U.S. Provisional Patent Application No. 60/441,106, entitled "Adjustable Rail Assembly for Exterior Door Sill," filed on Jan. 21, 2003, the disclosures of each are specifically incorporated herein by reference.

BACKGROUND OF THE INVENTION

1. Field of the Invention

The present invention relates to a novel high profile sill assembly and low profile sill assembly that share many components to permit common sills to be used in different door jamb designs without altering the sill assembly. A series of components are provided that can be used on both the high profile sill assembly and the low profile sill assembly such that sill assemblies can be configured for single doors, double doors, fixed panels and the like.

A novel adjustable rail assembly for a high profile sill assembly is provided. The adjustable rail assembly includes a series of adjustor assemblies that can be used to adjust the height of the rail with respect to the sill assembly. The adjustor assemblies are integrated into the sill assembly. The adjustor assemblies are placed under adjustable rail, fixed rail and any sidelite spacers.

The present invention further relates to another novel adjustable rail assembly for a high profile sill assembly. The adjustable rail assembly includes a series of spacer components that can be used to adjust the height of the rail with respect to the sill assembly without the use of adjustment screws or adjustor assemblies. The spacer components uniformly support the rail assembly on the sill assembly.

2. Description of Related Art

Adjustable exterior door sills have traditionally utilized a rail that is attached with adjusting screws into the sill through tapped holes, as shown in FIG. 1A. Adjustable sill rails in the past have relied heavily on the use of screws, which are fixed to the rail. Current rails either have exposed bolts or circular screw covers. Exposed bolts tend to rust, corrode and also provide a leak path across the rail. Circular screw covers also disrupt the sealing surface between the door sweep and rail. They also have a tendency to loosen over time and become lost. This rail design, with its fixed location, does not allow an assembler to have inventory flexibility. This sill design forces an assembler to inventory a unique sill for each door configuration. An assembler must stock components for every possible configuration and size.

Adjustable sill rails in the past have relied heavily on the use of screws. There are inherent drawbacks to using screws in a sill assembly. Screws require significant time to assemble. Tap threads must be drilled into the sill base. The placement of these threads is critical to allow the assembly of the rail to the sill base. Because of the specific placement of the threads, one sill cannot be used for different door configurations or sizes. Furthermore, the materials used to form the sills and the rails have different rates of thermal expansion and moisture absorption. These environmental changes cause misalignment between the screws and the tapped holes. This misalignment leads to screws breaking or threads stripping, which leads to increased manufacturing costs and greater inventory requirements.

Current known low profile sill assemblies are not designed to accept components that are utilized on high profile sill assemblies. As result, the manufacturer and assembler of sill assemblies must maintain inventories of components for both high profile sill assemblies and low profile sill assemblies.

SUMMARY OF THE INVENTION

One aspect of the embodiments of the present invention provides a high profile sill assembly having common components with a low profile sill assembly. The high profile sill assembly can be easily configured for singles doors, double doors, fixed panels, and French doors. Furthermore, the high profile sill assembly can be easily configured for either an adjustable height rail or a fixed rail.

Another aspect of embodiments of the present invention provides a high profile sill assembly, a low profile sill assembly and components for the same that avoids the current necessity of having a unique sill for each door unit. This flexibility will result in reduced lead time for filling customer orders. The sill assemblies share common components including but not limited to sill bases, rail assemblies, side lite spacers, corner keys, and mullion boots to permit an assembler to configure a sill to order.

The present invention is directed to an innovative high profile sill and low profile sill assembly having common components. A key aspect of the present invention allows a reduction inventory requirements. Door assemblers may simply cut a sill to the required length. An assembler's inventory will consist of mull boots, a sidelite spacers, an assortment of rail assemblies and sill bases. They can build any configuration needed.

The present invention is directed to a modular exterior threshold and door sill assembly for an entryway. The entryway includes a pair of vertically extending jamb members, a header structure and at least one door. The door sill assembly includes an elongated sill assembly connected at opposing ends to the pair of vertically extending jamb members. It is contemplated that the elongated sill assembly may be either a high profile sill assembly or a low profile sill assembly. The elongated sill assembly includes a longitudinally extending sill base having a leading edge and a trailing edge, an upwardly extending portion extending from the trailing edge of the sill base, and an upwardly extending lip structure extending from the sill base. The upwardly extending lip structure is laterally spaced from the upwardly extending portion. The upwardly extending lip structure, the upwardly extending lip structure and an interconnecting portion of the sill base form an elongated channel.

The door sill assembly further includes an elongated rail assembly extending at least a portion of the length of the elongated sill assembly. A portion of the elongated rail assembly is received within the elongated channel. A leading portion of the elongated rail assembly engages the upwardly extending lip structure. A trailing portion of the elongated rail assembly contacts a free end of the upwardly extending portion. The elongated rail assembly is selectively positioned within the elongated channel.

The door sill assembly in accordance with the present invention further includes at least one sill component connected to one of the elongated rail assembly and the elongated channel. The at least one sill component includes at least one of a cover assembly, an astragal bolt receiver assembly, a mullion boot assembly, a side panel spacer assembly and an outswing rail assembly.

In accordance with the present invention, the elongated rail assembly may include an elongated rail channel formed an upper surface thereof. The at least one sill component may include one of a cover assembly and an astragal bolt receiver assembly positioned within the elongated rail channel.

In accordance with the present invention, the astragal bolt receiver assembly includes a body having a forward portion sized to extend over the leading portion of the elongated rail assembly. The bolt receiver assembly further includes a bolt receiving aperture formed in the body. The bolt receiver assembly also includes at least one fastening assembly connected to the body for releasably and adjustably securing the body within the elongated rail channel. In accordance with the present invention, the cover assembly configured and positioned within the elongated rail channel to cover the at least one fastening assembly.

In accordance with the present invention, the entryway may be configured to accommodate at least one mullion located between the jamb members and at least one fixed panel positioned between one mullion and one of the jamb members. With this arrangement, the at least one sill component includes a mullion boot assembly connected each of the mullions. The mullion boot assembly is received within the elongated channel. Furthermore, the at least one sill component further includes a side panel spacer assembly. The side panel spacer assembly is adapted to be received under the at least one fixed panel. The side panel spacer assembly is received within the elongated channel. The side panel spacer assembly is positioned within the elongated channel adjacent the mullion boot assembly. In accordance with the present invention, the elongated rail assembly is positioned within the elongated channel adjacent the mullion boot assembly on a side opposite the side panel spacer assembly. The elongated rail assembly may be either a fixed rail or an adjustable height rail assembly. When the rail assembly is a fixed rail assembly. The astragal bolt receiver assembly and cover member disclosed above may be positioned on the fixed rail.

When the rail is an adjustable rail assembly, the adjustable height rail assembly may include an elongated rail received within the elongated channel. The elongated rail includes a downwardly extending portion adapted to contact the sill base when the elongated rail is a lowermost position. The rail also includes an adjustment mechanism for raising and lowering the positioning of the elongated rail. The adjustment mechanism may include at least one adjustment bracket selectively positioned within the elongated channel and at least one adjustment cam operatively connected to the at least one adjustment bracket.

In accordance with the present invention, the at least one door may be an outwardly swinging door. When an outwardly swinging door is contemplated, the at least one sill component includes an outswing rail assembly. The outswing rail assembly includes a downwardly extending portion adapted to be received within the elongated channel. The outswing rail assembly further includes an upwardly projecting bumper, and a weatherstriping strip positioned within a recess in the bumper. The outswing rail assembly may be used on either high profile sill assembly or a low profile sill assembly. Furthermore, the outswing rail assembly may be used in connection with the mullion boot assembly and the side panel support.

In accordance with the present invention, the elongated sill assembly may be a high profile sill assembly. The elongated sill assembly may include an enclosed cavity formed therein. The cavity is positioned on a side of the lip structure opposite the elongated channel. The sill assembly may include at least one drainage port formed in the lip structure to permit the drainage of moisture from the elongated channel to the cavity. The sill assembly may further include at least one drainage port to permit the drainage of moisture from the cavity to an exterior of the sill assembly.

In accordance with the present invention, a pair of corner key assemblies may be provided. One of the corner key assembly being secured to one end of the sill assembly. Another corner key assembly being secured to an opposite end of the sill assembly. The corner key assemblies are sized to enclose the opposing ends of the sill assembly. Each corner key assembly may include a vertical cap member sized to cover the end of the sill assembly and at least one mounting projection extending from one side of vertical cap member. The at least one mounting projection is sized to be received within one of the elongated channel and the cavity in the sill assembly.

Each corner key assembly further includes a first mounting extension extending from a side of the vertical cap member opposite the at least one mounting projection. The mounting extension is sized to receive at least a portion of the vertical jamb member thereon. Each corner key assembly further includes a second mounting extension extending from the same side of the vertical cap member as the at least one mounting projection. The second mounting projection is sized to receive at least a portion of the vertical jamb member thereon. The second mounting extension is vertically spaced above an upper surface of the high profile sill assembly. The vertical cap member forms a space between the vertical jamb member and the sill assembly. A corner pad is positioned within the space. The corner pad is configured to conform to the exterior profile of at least a portion of the vertical cap member.

Another aspect of embodiments of the present invention provides an adjustable height rail assembly for a high profile sill assembly. The adjustable height rail assembly has an adjuster assembly integrated into the sill assembly. A plurality of adjuster elements are integrated into the sill assembly for use in adjusting the height of the rail assembly with respect to the sill assembly. The plurality of adjusters are capable of underlying both fixed and adjustable sill components.

The present invention is further directed to an adjustable threshold and door sill assembly. The threshold and door sill assembly includes an elongated sill assembly having a length. The elongated sill assembly includes at least one elongated channel extending substantially the length of the elongated sill assembly. The elongated sill assembly also includes an upwardly extending lip structure positioned adjacent one of the at least one elongated channel. The present invention also includes an elongated rail assembly extending at least a portion of the length of the elongated sill assembly. A portion of the elongated rail assembly is received within the at least one elongated channel. The elongated rail assembly includes a leading portion of the elongated rail assembly that engages the upwardly extending lip structure. A plurality of adjuster assemblies are fixedly secured within one channel for adjusting the vertical position of the elongated rail assembly with respect to the elongated sill assembly. The adjuster assemblies are integrated into the sill assembly. In particular, a base member of the adjuster assembly is secured to the channel. The plurality of adjuster assemblies are spaced along the entire length of the channel and are located under both the adjustable rail and fixed components.

Another aspect of an embodiment of the present invention provides an adjustable height rail assembly for a high profile sill assembly that permits the adjustment of the rail height without the use of adjustment screws. A plurality of spacer elements for use in adjusting the height of the rail assembly with respect to the sill assembly. The spacer elements can be stored in rail assembly when not installed. The spacer elements uniformly supports the rail on the sill assembly.

The present invention is directed to an adjustable threshold and door sill assembly that does require the use of any tools for adjust the position of a rail assembly with respect to a lower portion of a door. The adjustable threshold and door sill assembly includes an elongated sill assembly having a length. The elongated sill assembly includes at least one elongated channel extending substantially the length of the elongated sill assembly. The elongated sill assembly further includes an upwardly extending lip structure positioned adjacent one elongated channel. The adjustable threshold and sill assembly also includes an elongated rail assembly extending at least a portion of the length of the elongated sill assembly. A portion of the elongated rail assembly is received within the at least one elongated channel. The elongated rail assembly includes a leading portion of the elongated rail assembly that engages the upwardly extending lip structure.

In accordance with the present invention, at least one spacer component is provided for uniformly adjusting the vertical position of the elongated rail assembly with respect to the elongated sill assembly along the length of the elongated rail assembly. Each spacer component is sized to be received in one of the at least one elongated channel and extend the length of the channel such the spacer component is positioned within the one elongated channel below a lower portion of the elongated rail assembly when in an installed position. Each spacer component has a stored position. The spacer components when not needed may be stored in a channel formed in the upper portion of the elongated rail assembly.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1A:
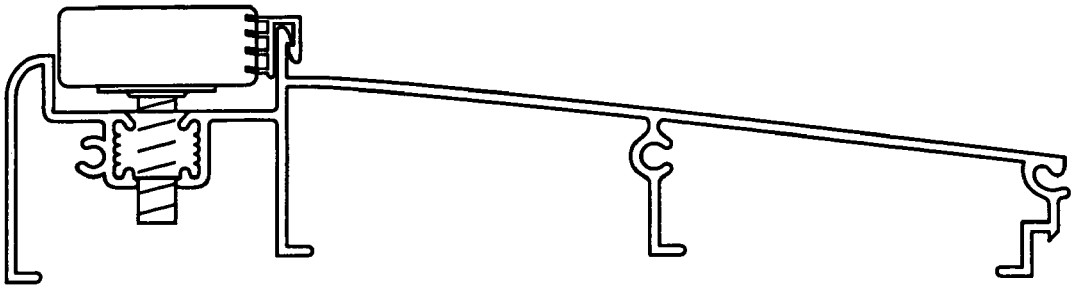
FIG. 1A is a side view of a known sill assembly.
Figure 1B:
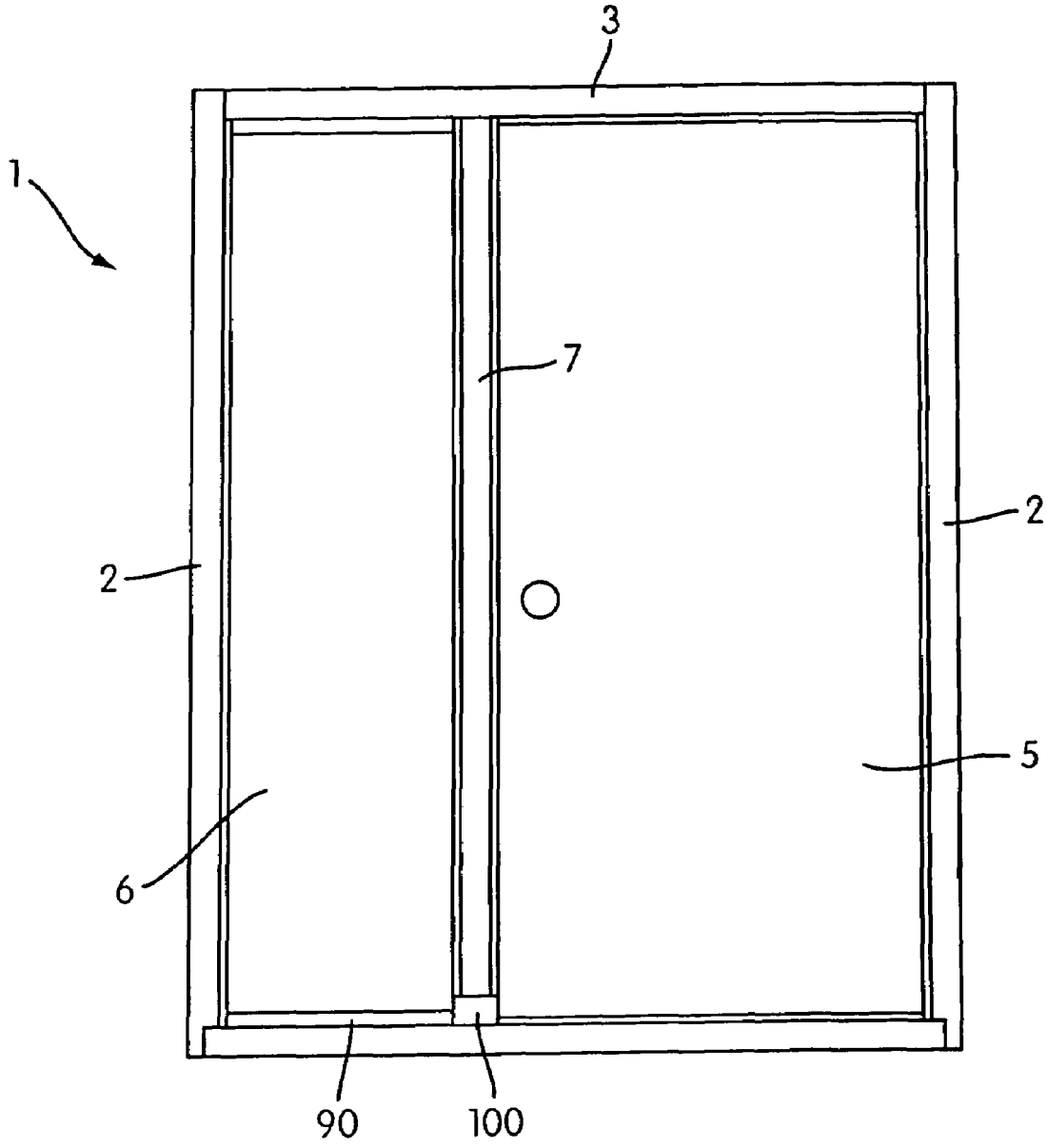
FIG. 1B is a front view of a door jamb assembly.

FIG. 1B illustrates a door jamb assembly 1 incorporating components of the present invention. The door jamb assembly 1 includes a pair of vertically extending horizontally spaced jamb members 2, a horizontally extending header structure 3, and a horizontally extending sill structure connected to lower ends of the jamb members 2 and extending therebetween. The pair of jamb members 2, the header structure 3, and the sill structure form a generally rectangular doorjamb opening within which a door 5 is disposed. The doorjamb assembly includes a door 5 and at least one side panel 6 disposed on a side of the door 5. The present invention is not limited to use with the specific configuration of door jamb assembly shown and other various configurations are contemplated, for example, a door jamb assembly may include a pair of doors, sliding door panel, a combination of fixed and movable door panels and any combination of side panels including only multiple side panels disposed on opposite sides of the door 5. To accommodate the placement and support of the side panel 6, the door jamb assembly may include one or more vertically extending mullions 7, which are connected at upper ends thereof to the header structure 3 and at lower ends thereof to the sill structure through a mullion boot assembly 100.

Figure 2:
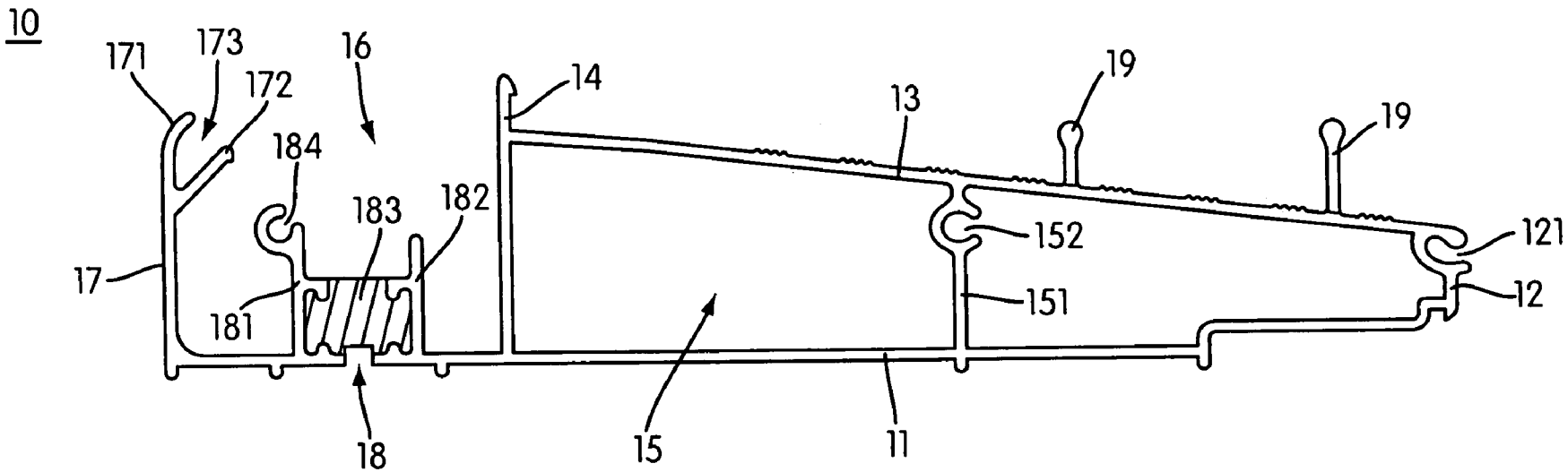
FIG. 2 is a side view of a high profile sill assembly in accordance with the present invention.
Figure 3:
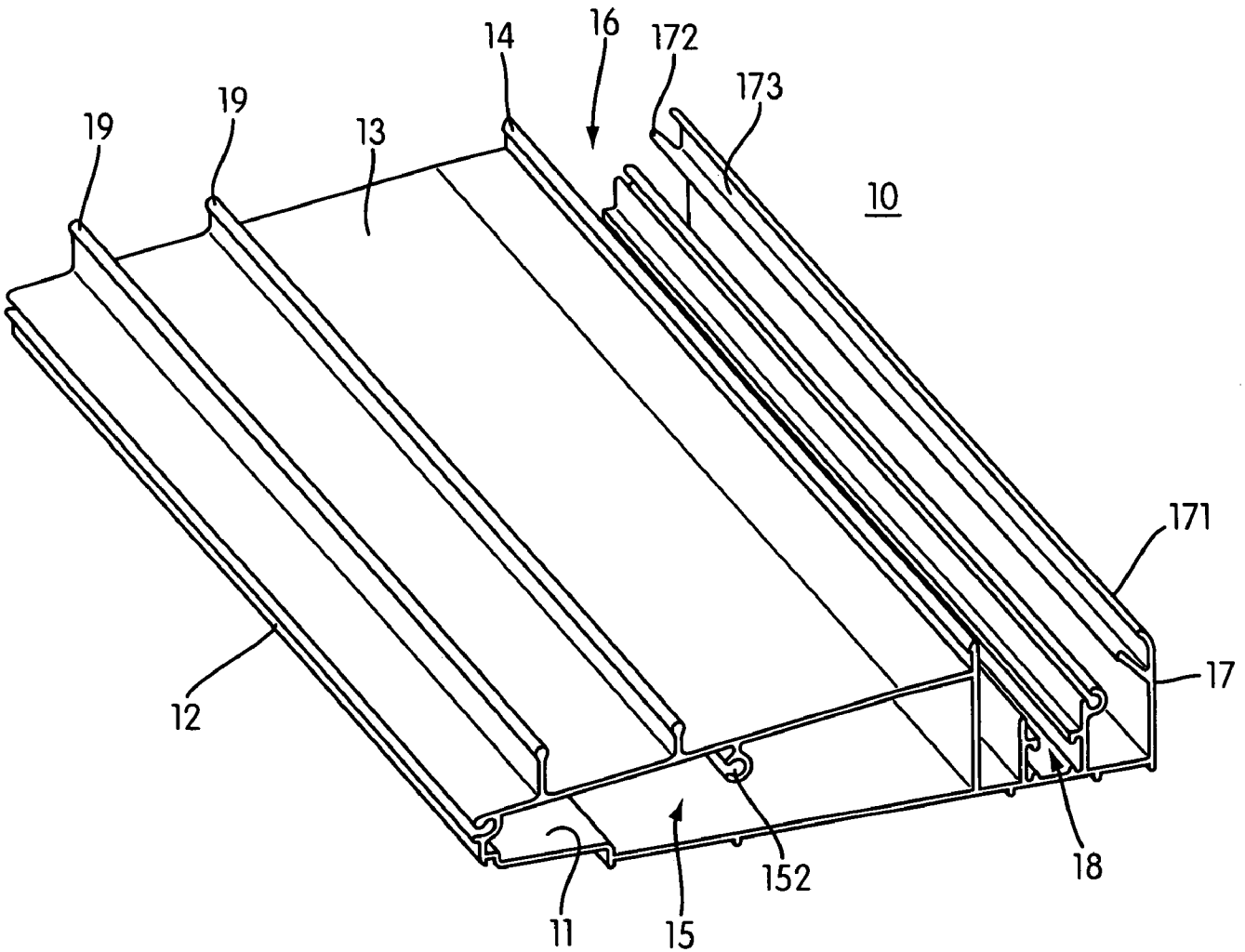
FIG. 3 is a right front perspective of the high profile sill assembly of FIG. 2.
Figure 13:
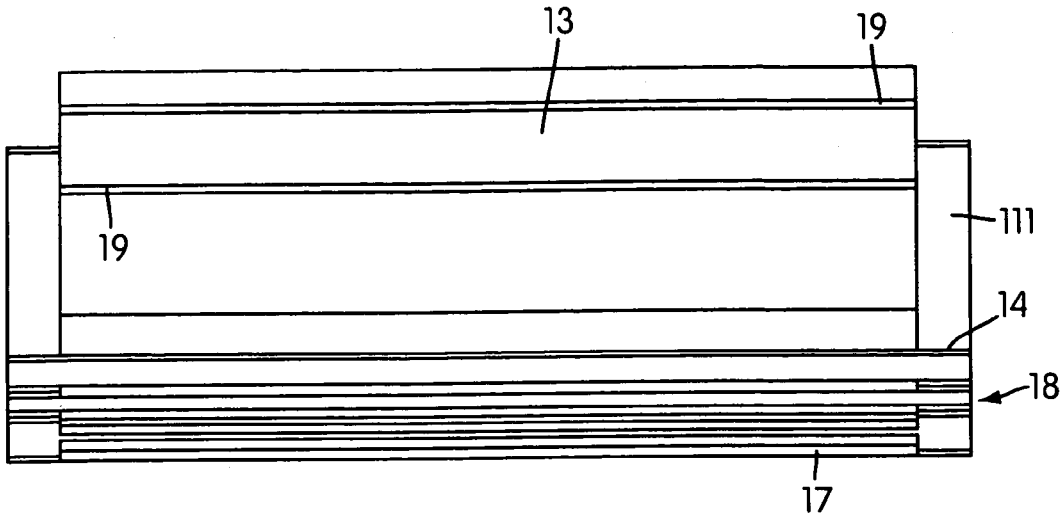
FIG. 13 is a top view of the high profile sill assembly of FIG. 2.
Figure 14:
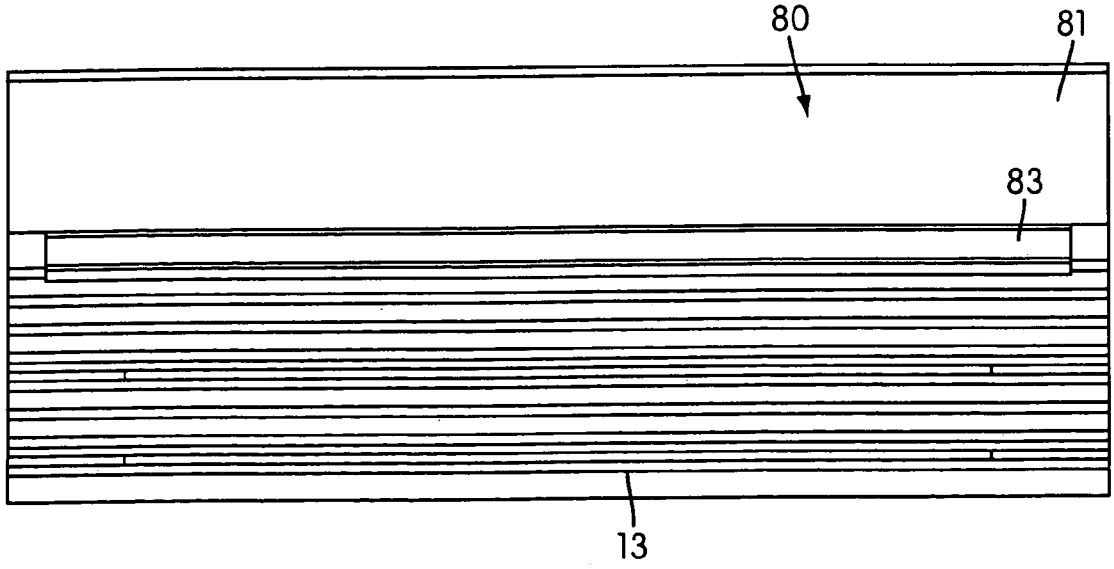
FIG. 14 is a top view of the outswing high profile sill assembly of FIG. 12.
Figure 20:
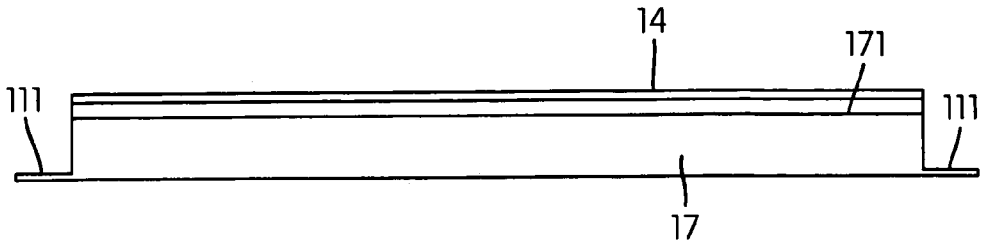
FIG. 20 is a rear view of the high profile sill assembly of FIG. 2.

A high profile sill assembly 10 in accordance with the present invention will now be described in greater detail. The high profile sill assembly 10 offers greater water protection than lower profile sill assemblies including the low profile sill assembly 20, described. As shown in FIG. 2, the high profile sill assembly 10 includes an integral sill base 11 extending the length of the sill assembly 10. A leading edge portion 12 extends upwardly from a forward edge of the sill base 11. The leading edge portion 12 may include a screw boss 121 for securing the sill assembly 10 to the door jamb by receiving a suitable fastener therein. The fastener (e.g. a screw) extends through the jamb and terminates in the screw boss 121. An inclined ramp portion 13 extends rearwardly from the leading edge portion 12 to an upwardly extending lip structure 14. The upwardly extending lip structure 14 projects above the ramp portion 13. The lip structure 14 also includes a portion that extends downwardly to the sill base 11. The base sill 11, the leading edge portion 12, the inclined ramp portion 13 and the lip structure 14 together form a cavity 15 that is open on opposite ends of the sill base 11, as shown in FIG. 3. The base sill 11 may include extensions 111 extending from opposite ends of the sill assembly 10, as shown in FIGS. 3, 13 and 20. The vertically extending jamb members of the jamb assembly may be located thereon. The extensions 111 raise the jamb members to limit contact with moisture, which reduces rot. The base sill 11 and the extensions 111 inhibit rotting of the jamb.

The cavity 15 may include at least one reinforcing rib 151 located therein, as shown in FIGS. 2 and 4-12. The reinforcing ribs 151 are provided to increase the over all strength and stability of the sill assembly 10. The reinforcing rib 151 may further include a screw boss 152 for receiving a suitable fastener therein for securing a jamb to the sill 10. Although it is preferable to include at least one reinforcing rib 151, it is not required. It is contemplated that the high profile sill assembly 10 may be formed without reinforcing ribs 151, as shown for example in FIG. 3. In such an arrangement, the screw boss 152 extends from the inclined ramp portion 13 within the cavity 15. It is further contemplated that the screw boss 152 may extend from the sill base 11.

The lip structure 14 also forms one side of a channel 16 that extends along the length of the sill assembly 10, as shown in FIGS. 4, 7, 8, 11 and 13. An opposite side of the channel 16 is formed from an upwardly extending portion 17. The upwardly extending portion 17 is connected at a lower end to the sill base 11. The upper free end 171 of the upwardly extending portion 17 may have a generally arcuate shape, as shown in FIGS. 2 and 3. A rib 172 extends from the upper portion of the upwardly extending portion 17 in generally the same direction as the upper free end 171. The upper free end 171 and the rib 172 together form a channel 173. The channel 173 opens into the channel 16. The channels 16 and 173 are provided to receive one or more of the sill components described below and shown in FIGS. 4-11, 24, 25 and 28.

A thermal break 18 is provided to limit or reduce the temperature transfer through the high profile sill assembly 10. The thermal break 18 is especially necessary in cooler climates. The thermal break 18 is formed within the channel 16. The thermal break 18 includes a pair of opposed ribs 181 and 182, which extend the length of the sill assembly 10. A thermal break material 183 is formed between the ribs 181 and 182. One or both of the ribs 181 and 182 may include a screw boss 184. Like the screw boss 152, the screw boss 184 is provided to secure the sill 10 to the jamb assembly. The thermal break material is preferably a polyurethane or other suitable material having similar strength and thermal transfer properties. After the material 183 is formed between the ribs 181 and 182, a portion of the sill base 11 extending between the ribs 181 and 182 is removed by performing a suitable machining operation. The high profile sill assembly 10 is formed as a one piece extrusion from aluminum or other suitable material. It is also contemplated that the high profile sill assembly 10 may by formed from plastic or fiberglass. In the event that the sill assembly 10 is formed from a plastic or fiberglass, the thermal break 18 may be omitted.

In accordance with the present invention, the sill assembly 10 may include one or more upwardly projecting extensions 19 extending from the inclined ramp portion 13, as shown in FIGS. 2 and 3. The extensions 19 are provided to secure one or more screen doors thereon. The extensions 19 extend generally parallel to each other in the longitudinal direction.

Figure 5:
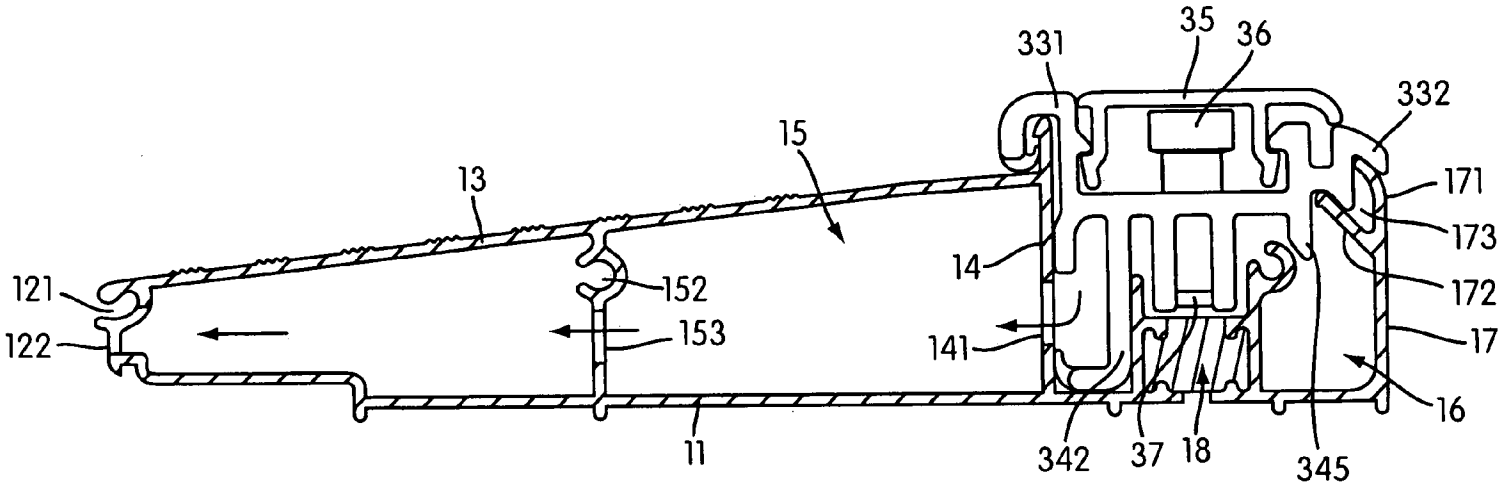
FIG. 5 is a cross sectional side view of the high profile sill assembly and adjustable rail assembly of FIG. 4, wherein a drainage pathway is illustrated.

In the event that water or moisture enters the high profile sill assembly 10, one or more drainage ports are provided. In the event that moisture enters the channel 16, a drainage port 141 is provided in the lower portion of the lip structure 14. The drainage port 141 is located a sufficient distance from the base sill 11 so as to be above a sealing assembly on the adjustable rail assemblies, as shown in FIG. 5 and described below. The moisture collected in the channel 16 drains through the drainage port 141 into the cavity 15. The reinforcing ribs 151 are also provided with drainage ports 153 to permit the passage of moisture through the cavity 15 to a drainage port 122 formed in the leading edge portion 12 where the moisture exits the cavity 15. The moisture travels along the path indicated by the arrows in FIG. 5. It is contemplated that a drainage port may instead be provided in the sill base 11 adjacent the leading edge portion 12 to permit drainage of moisture from the cavity 15. Although it is unlikely that any moisture will enter the cavity 15 through the ends, the drainage ports 122, 141 and 153 will permit the drainage of this moisture from the cavity 15.

Figure 45:
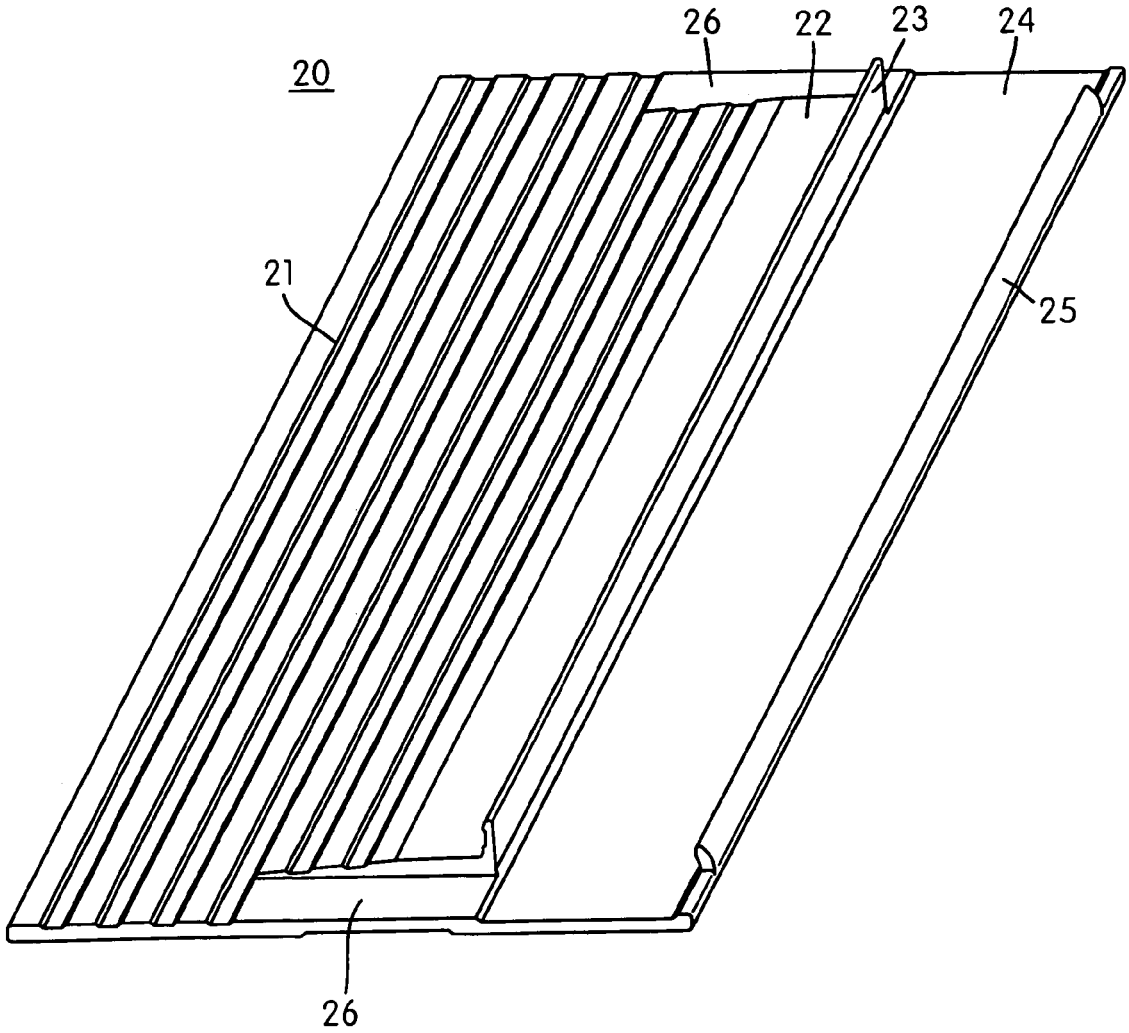
FIG. 45 is a left perspective view of a low profile sill assembly according to the present invention.
Figure 46:
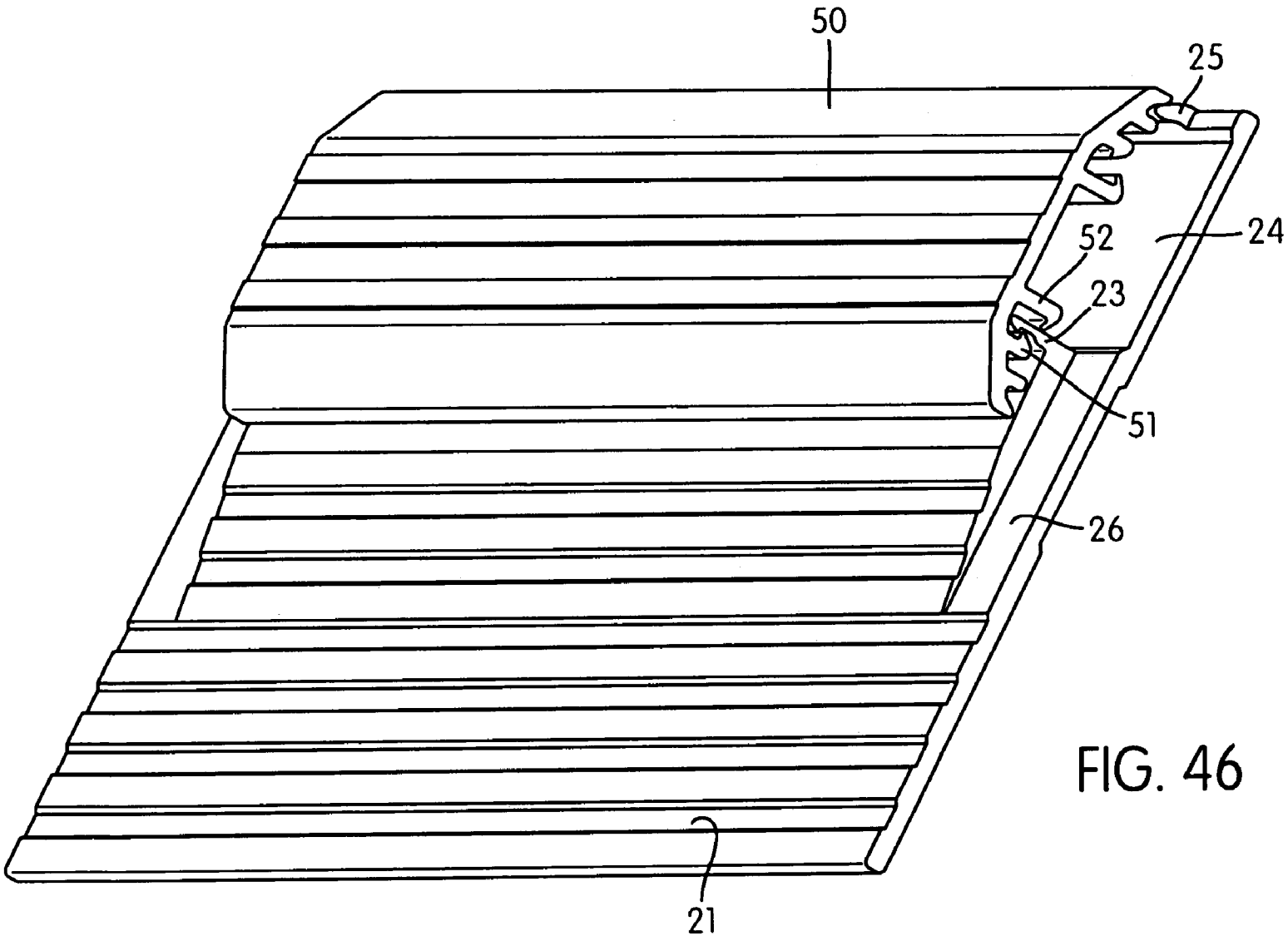
FIG. 46 is a left perspective view of the low profile sill assembly of FIG. 45 having the fixed rail assembly of FIG. 17 secured thereto.

A low profile sill assembly 20 in accordance with the present invention will now be described in greater detail in connection with FIGS. 45-54. The low profile sill assembly 20 has an overall height that is lower than that of the high profile sill assembly 10, described above, and is in compliance with the requirements of the Americans with Disability Act. As shown in FIGS. 45 and 46, the low profile sill assembly 20 includes a generally flat leading edge portion 21. An inclined ramp portion 22 extends from the leading edge portion 21 to an upwardly extending lip structure 23, as shown in FIGS. 45, 46 and 50-52. The upwardly extending lip structure 23 forms one side of a longitudinally extending channel 24. An opposite of the channel 24 is formed by an upwardly extending trailing edge portion 25. As shown in FIG. 45, the upwardly extending edge portion 25 has a generally arcuate surface. A jamb receiving portion 26 is formed on opposite ends of the inclined ramp portion 22. Each jamb receiving portion 26 is sized to receive at least a portion of the vertically extending jamb members thereon.

The low profile sill assembly 20 is preferably formed from a pultruded fiberglass as a single component. The use of a fiberglass provides a thermal break without the need of additional components. The present invention, however, is not limited solely to the use of pultruded fiberglass; rather, it is contemplated that the low profile sill assembly 20 may be formed from aluminum or other suitable materials when it is not necessary to provide a thermal break (e.g., in warm weather climates). It is also contemplated that a thermal break, as described above, in connection with the high profile sill assembly 10 may be included in the low profile sill assembly 20.

The low profile sill assembly 20 and the high profile sill assembly 10 have complimentary geometries. With the exception the adjustable rail assemblies 30 and 40 and the corner key assembly 200, described below, all of the components described herein are useable in both the high profile sill assembly 10 and the low profile sill assembly 20, which greatly reduces the inventory requirements of the manufacturer and increases jamb design flexibility.

Typically, a rail member is secured to the sill assembly to close or eliminate any gap between the sill assembly and the bottom of the door. In high profile sill assemblies, it is desirable for the height of the rail member be adjustable to ensure a good seal with the sweep on the bottom of the door.

Figure 4:
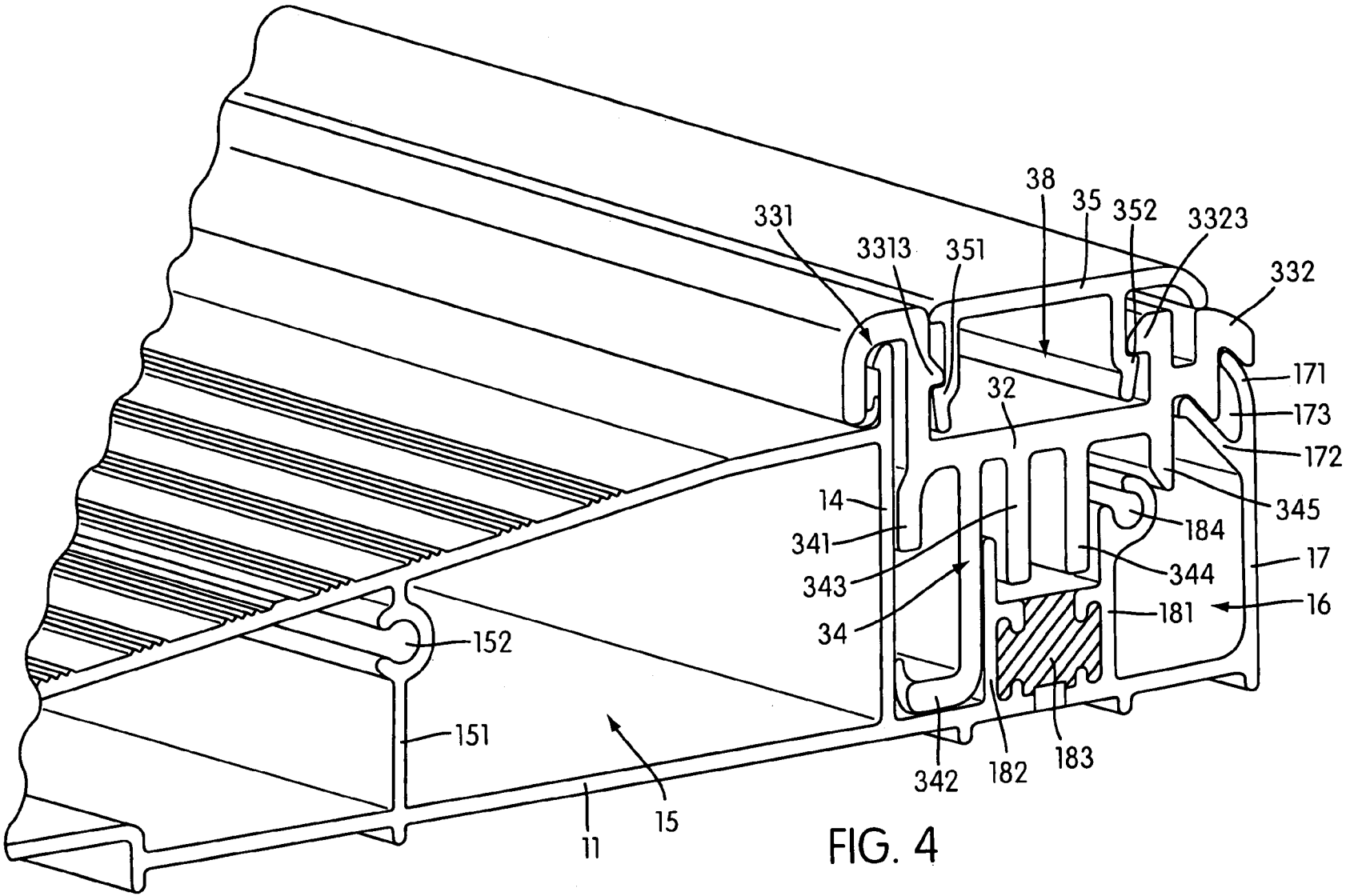
FIG. 4 is a partial right side perspective view of the high profile sill assembly of FIG. 2 having an adjustable rail assembly according to one embodiment of the present invention secured thereto.

An adjustable rail assembly 30 in accordance with an embodiment of the present invention will now be described in greater detail. The adjustable rail assembly 30 includes a base member 31 having a base 32, an upper portion 33 and a lower portion 34, a cover member 35, at least one adjustment bolt 36 and at least one T nut 37. The base member 31 is preferably formed from an extruded material (e.g. plastic). As shown in FIGS. 4 and 5, the lower portion 34 of the base member 31 is adapted to be received within the channel 16. The upper portion 33 of the base member 31 extends over the lip structure 14 and the upwardly extending portion 17. The cover member 35, the adjustment bolts 36 and the T-nuts 37 are self contained within the base member 35. This construction of the base member 31 permits the member 31 to be slidably positionable within the channel 16.

Figure 15:
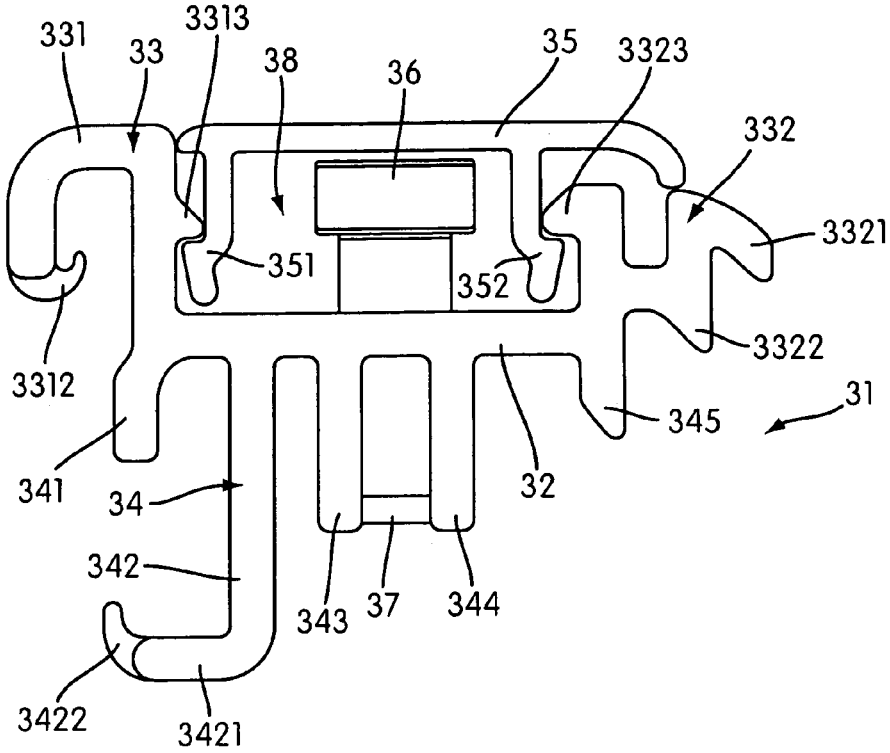
FIG. 15 is a side view of the adjustable rail assembly of FIG. 4 in accordance with the present invention.

As shown in FIG. 15, the lower portion 34 includes a plurality of ribs extending downwardly from the base 32. The ribs locate and stabilize the base member 31 within the channel 16. A first rib 341 extends downwardly from an edge of the base 32 adjacent the lower end of the lip structure 14. A second rib 342 is laterally spaced from the first rib 341 and extends into the cavity 16. The second rib 342 extends a greater distance than the first rib 341 such that a lower portion 3421 of the rib 342 is positioned adjacent the sill base 11, as shown in FIGS. 4 and 5. The second rib 342 is adapted to be positioned against the rib 182 of the thermal break 18. A flexible flange 3422 is integrally formed on a free end of the lower portion 3421. The base member 31 is preferably formed by an extrusion process such that the flexible flange 3422 has a lower durometer than that of the remaining portion of the base member 31. The flange 3422 engages the surface of the lower portion of the lip structure 14 to form a seal. To permit drainage of moisture from the channel 16, the drainage port 141 must be positioned at a point above the location where the flange 3422 contacts the lip structure, as shown in FIG. 5. The lower portion 34 further includes third and fourth ribs 343 and 344, which are adapted to be received between the ribs 181 and 182 of the thermal break 18. The third and fourth ribs 343 and 344 are spaced to capture and secure the at least one T-nut 37 therebetween. A bolt 36 is received within each T-nut 37. A least a portion of the at least one adjustment bolt 36 extends between the third and fourth ribs 343 and 344. Rotation of the bolts 36 with respect to the T-nut raise and lower the base member 31 with respect to the sill assembly 10. A fifth rib 345 is spaced from the fourth rib 344 and is adapted to extend between the rib 172 and the screw boss 184.

The upper portion 33 of the base member 31 together with the base 32 form a channel 38. The at least one adjustment bolt 36 is adapted to be at least partially received within the channel 38, as shown in FIG. 15. The upper portion 33 includes a first flange 331 which extends upwardly and over the upper portion of the lip structure 14. A free end 3311 of the flange 331 extends downwardly towards the ramp portion 13. The free end 331 terminates in a flexible flange 3312. The flange 3312 forms a seal with the upper portion of the lip structure 14 to prevent moisture from entering the channel 16. Like the flexible flange 3422, the flange 3312 is integrally formed with the base member 31 during an extrusion process such that the flexible flange 3312 has a lower durometer than that of the remaining portion of the base member 31. The flange 331 further includes a rib 3313 extending inwardly into the channel 38. The rib 3313 is sized to engage a complimentary rib 351 on the cover member 35. The upper portion 33 further include a second flange 332 which extends upwardly and over the upper portion of portion 17. A portion 3321 of the second flange 332 extends over the free end 171. A rib 3322 on the flange 332 is received within the channel 173. A rib 3323 is provided to engage a complimentary rib 352 on the cover member 35.

Adjustment of the rail height is a simple operation. The door installer or the homeowner can adjust the rail assembly 30 by removing cover member 35 and turning at least one of adjustment bolt 36. The bolt 36 pushes against thermal break 18 of the sill assembly 10 to raise or lower the base member 31. During adjustment, the flanges 3312 and 3422 remain in contact with their respective portions of the lip structure 14. After adjusting, the cover member 35 is replaced.

The cover member 35 hides the bolts 36 used to adjust the height of the base member 31. The cover member 35 may run the full length of the base member 31. It provides a clean surface without disruptions for the door sweep to seal against. It also has integral snap fit type engagement with the base member 31.

Figure 25:
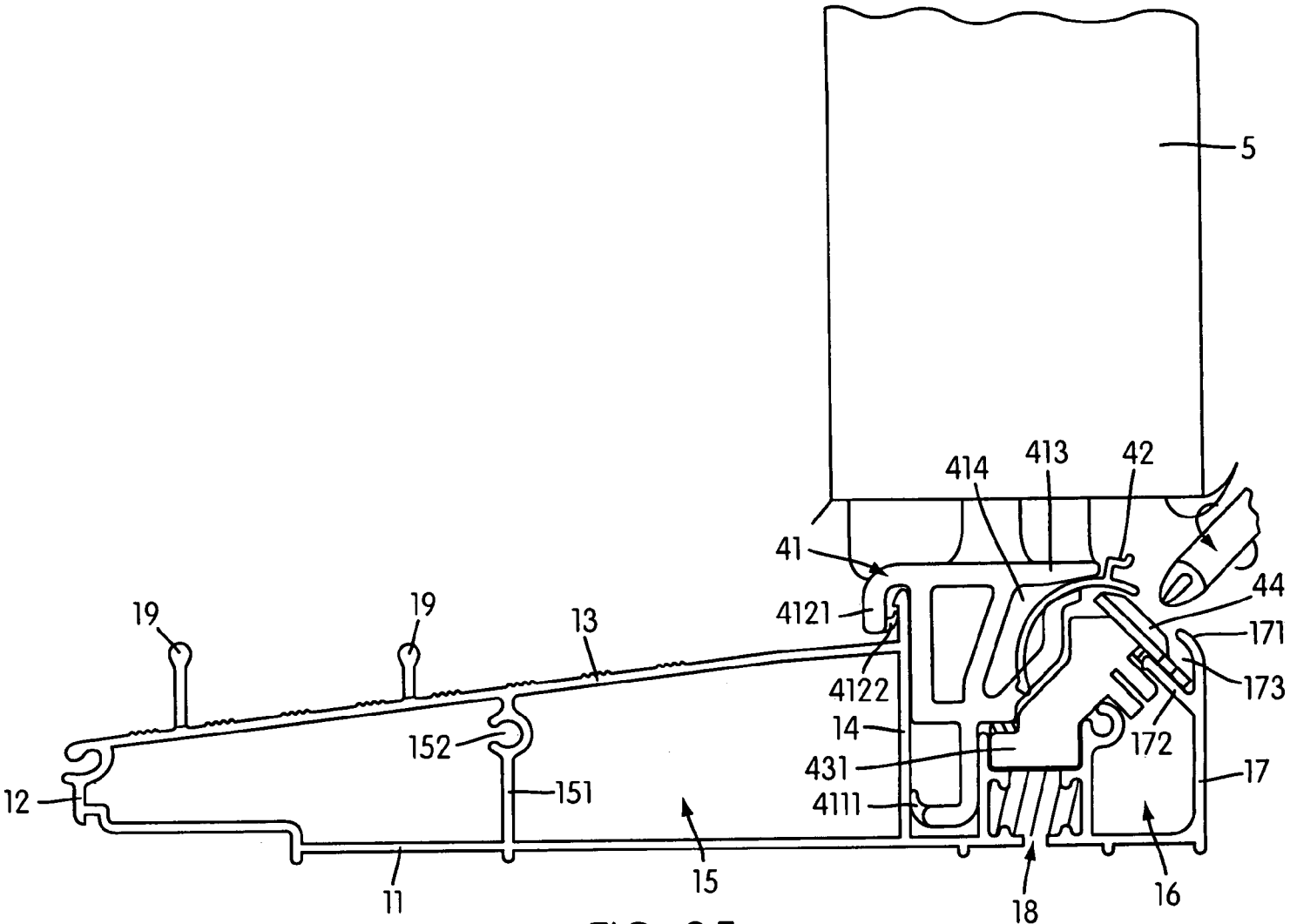
FIG. 25 is a right side perspective view of the high profile sill assembly and adjustable rail assembly of FIG. 24 illustrating adjustment of the rail assembly with a door in place.
Figure 26:
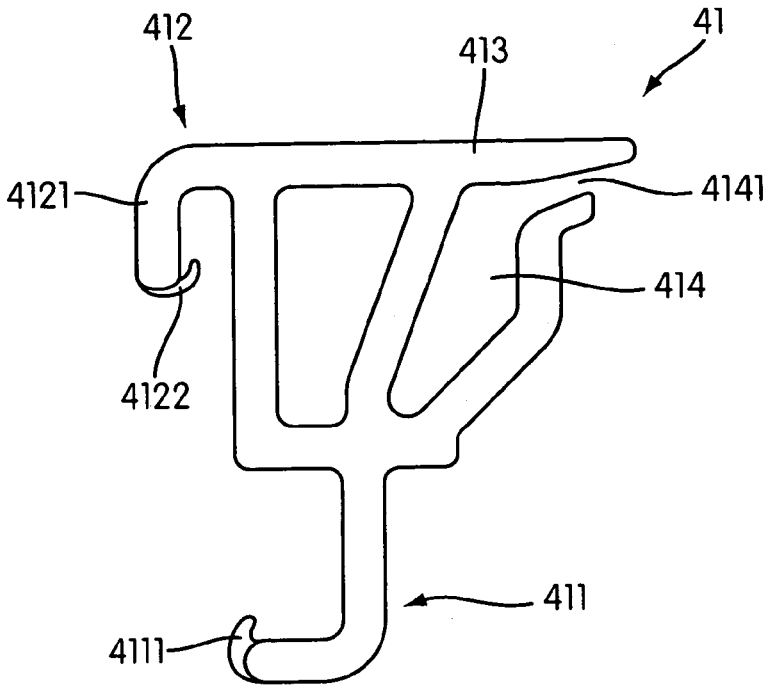
FIG. 26 is a side view of the rail base for the embodiment of the adjustable rail assembly illustrated in FIG. 24.

The adjustable rail assembly 30 is an improvement over known rail assemblies. The rail assembly 30, however, cannot be adjusted when the door within the jamb is in closed position. An adjustable rail assembly 40 in accordance with another embodiment of the present invention will now be described in greater detail. The design of the adjustable rail assembly 40 permits adjustment of the rail when the door is closed, as shown in FIG. 25. This eliminates the guessing and constant door opening and closing other designs require. The adjustable rail assembly 40 includes a base member 41, a movable cover member 42 and an adjustment mechanism having an adjustment bracket 43 and an adjustment cam 44. Like the base member 31 and the cover member 35, the base member 41 and cover member 42 are formed from a plastic material by an extrusion process. As illustrated in FIG. 26, the base member 41 includes a lower portion 411 that is adapted to be received within the channel 16 and an upper portion 412 that is adapted to extend over the lip structure 14.

Figure 24:
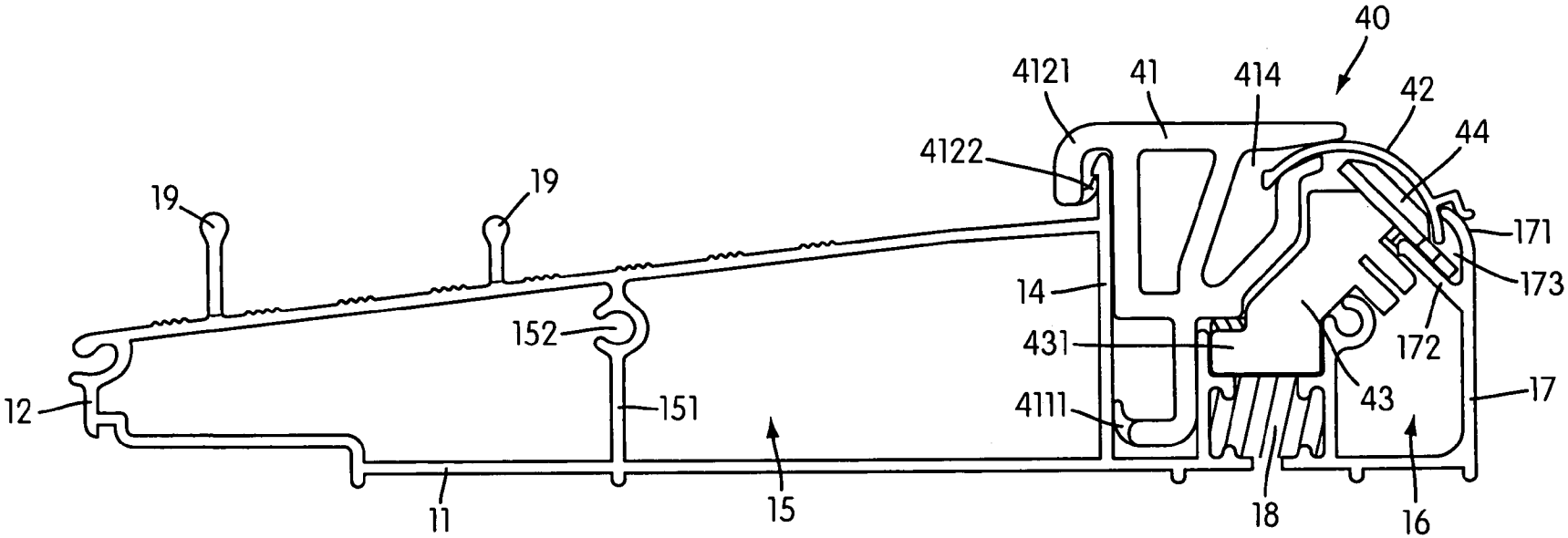
FIG. 24 is a right side perspective view of the high profile sill assembly of FIG. 2 having an adjustable rail assembly according to another embodiment of the present invention secured thereto.

The lower portion 411 locates and stabilize the base member 41 within the channel 16. The lower portion 411 is positioned adjacent the sill base 11, as shown in FIGS. 24 and 25, between the lower end of the lip structure 14 and the rib 182 of the thermal break 18. A flexible flange 4111 is integrally formed on a free end of the lower portion 411. The flexible flange 4111 engages the surface of the lower portion of the lip structure 14 to form a seal. To permit drainage of moisture from the channel 16, the drainage port 141 must be positioned at a point above the location where the flange 4111 contacts the lip structure 14. The base member 41 is preferably formed by an extrusion process such that the flexible flange 4111 has a lower durometer than that of the remaining portion of the base member 41.

The upper portion 412 of the base member 41 includes a flange 4121 that extends upwardly and over the upper portion of the lip structure 14. A free end of the flange 4121 extends downwardly towards the ramp portion 13. The free end terminates in a flexible flange 4122. The flange 4111 forms a seal like flange 3312. Like the flexible flange 4111, the flange 4122 is integrally formed with the base member 41 during an extrusion process such that the flexible flange 4122 has a lower durometer than that of the remaining portion of the base member 41. The upper portion 412 includes a cover portion 413 that extends substantially across the opening of the channel 16, as shown in FIGS. 24 and 25. The upper portion 412 further includes a cavity 414 extending the length of the base member 41. The cavity 414 has an opening 4141 that also runs the length of the base member 41. The movable cover member 42 is slidably received within the cavity.

Figure 27:
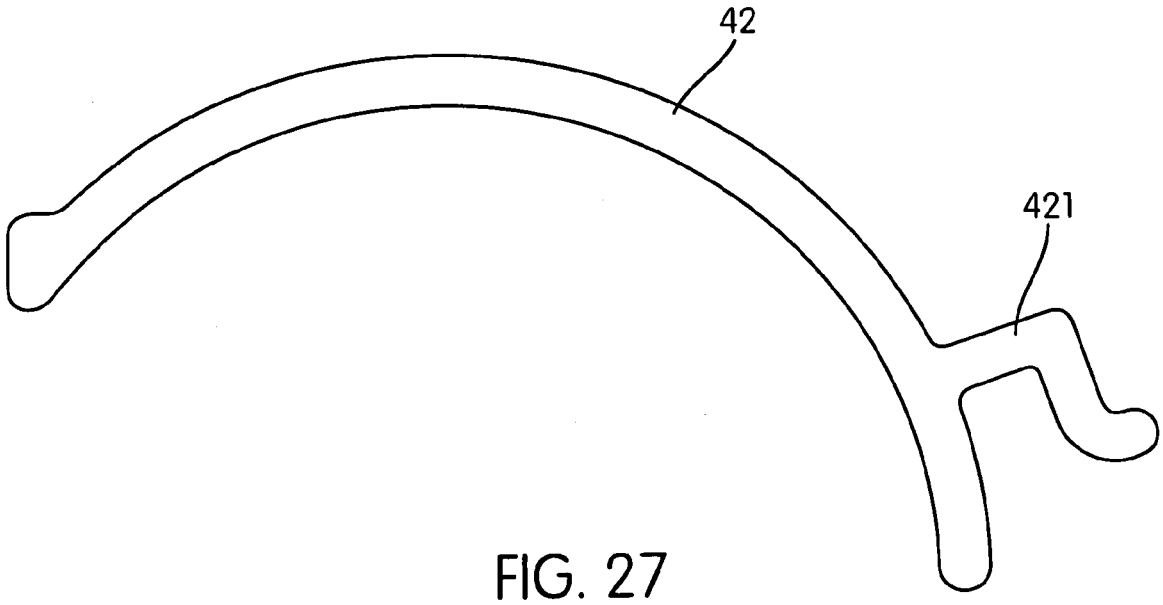
FIG. 27 is a side view of the cover assembly for the embodiment of the adjustable rail assembly illustrated in FIG. 24.

The adjustable rail assembly 40 includes a cover member 42, which serves to hide the adjusting mechanism from view and create a finished top rail surface, as shown in FIG. 24. When the installer or homeowner desires to adjust the height of the rail member 41, the cover member 42 slides up into the cavity 414. As shown in FIGS. 24, 25 and 27, the cover member 42 has a geometry to keep it captured within the cavity 414 and allows the cover member 42 to function at all rail adjustment heights. After completing adjustment, the installer or homeowner slides the cover member 42 down to hide the adjusting mechanism. The cover member 42 includes a lip portion 421, which engages the upper free end 171 and the end channel 172. The cover member 42 is preferably formed from an extruded plastic. It, however, is contemplated that other materials may be used including but not limited to aluminum and steel.

Figure 32:
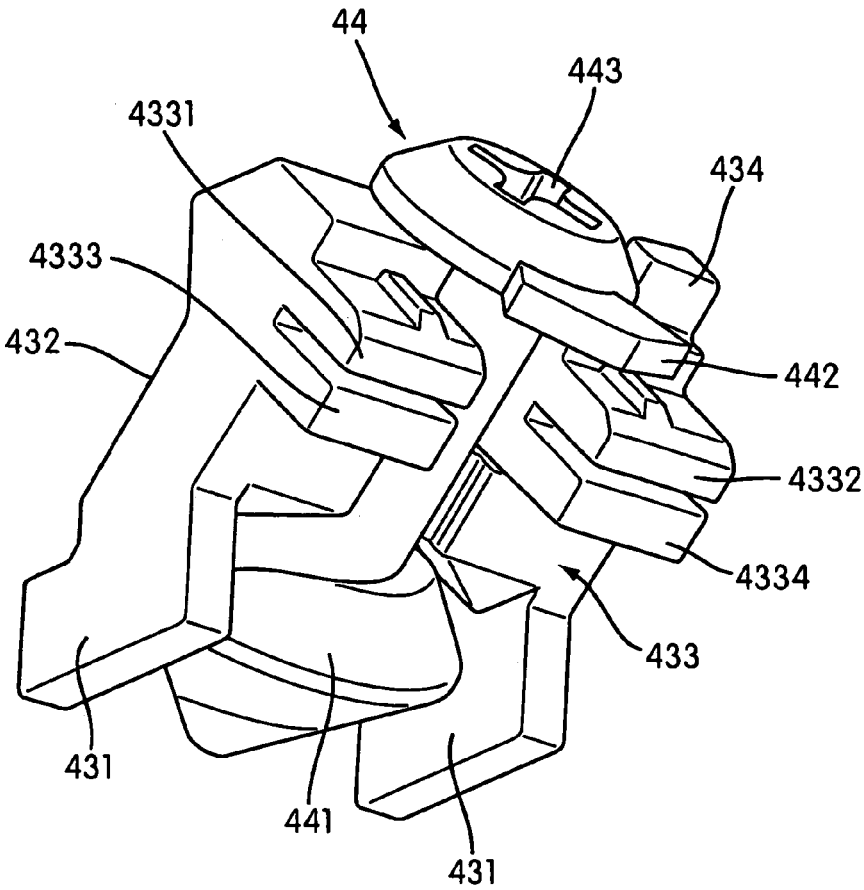
FIG. 32 is a schematic view of the adjustable cam and cam bracket of FIG. 28.

The adjustment mechanism of the adjustable rail assembly 40 will now be described in greater detail. The adjustment mechanism is independent of the base member 41 and the sill assembly 10. The adjustment mechanism includes an adjustment bracket 43 and adjustment cam 44. The adjustment bracket 43 and adjustment cam 44 snap fit together, as shown in FIGS. 28 and 32.

Figure 33:
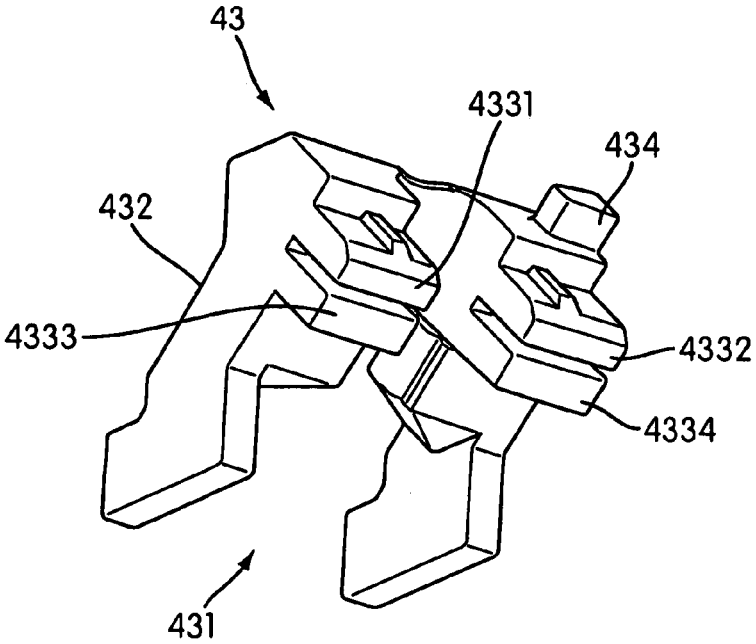
FIG. 33 is a rear schematic view of the cam bracket illustrated in FIGS. 28 and 32.
Figure 34:
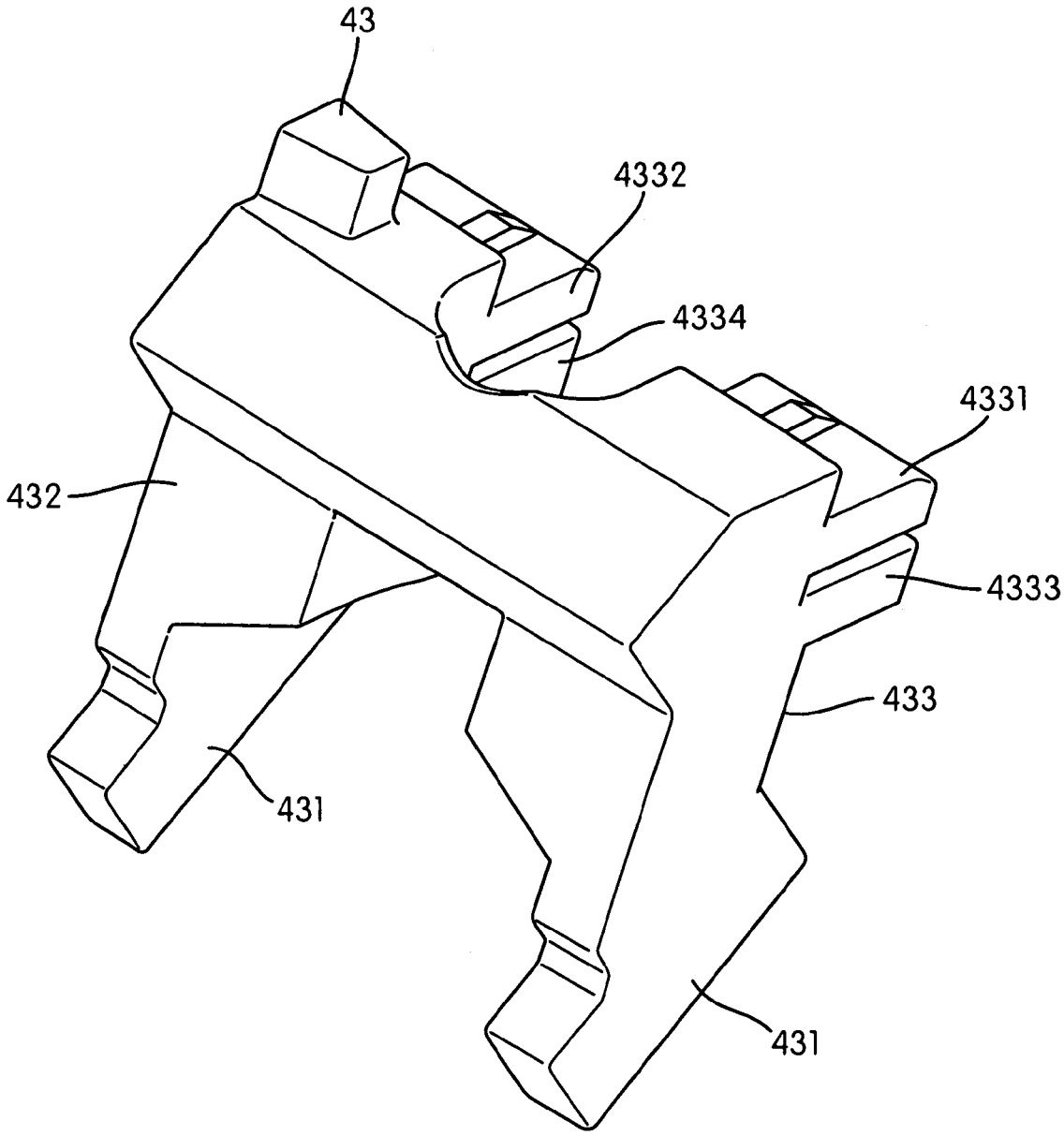
FIG. 34 is a front schematic view of the cam bracket of FIG. 33.
Figure 35:
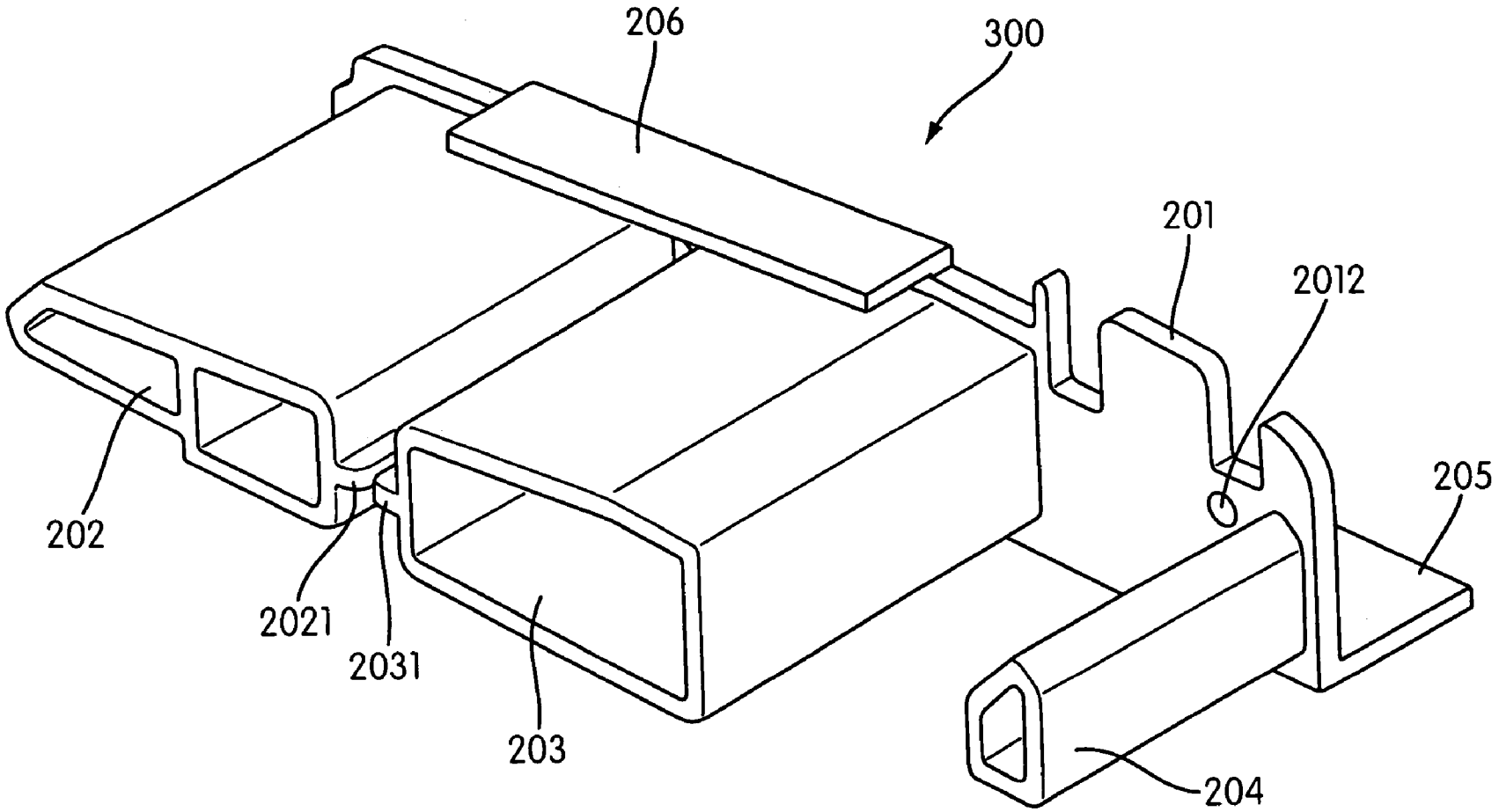
FIG. 35 is a left side perspective view of a corner key assembly according to the present invention for use with the high profile sill assembly illustrated in FIG. 2.
Figure 36:
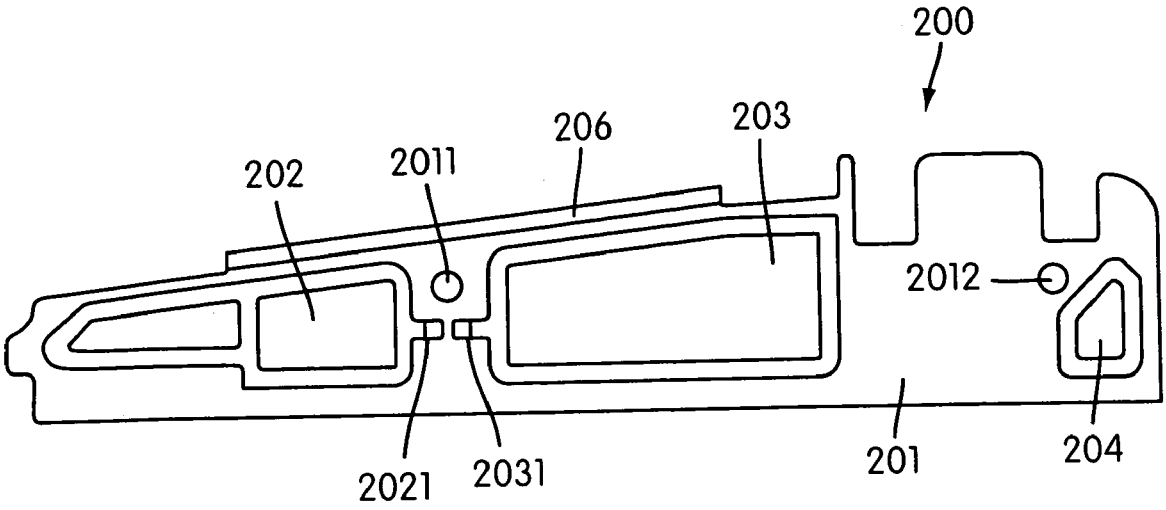
FIG. 36 is a side view of the corner key assembly of FIG. 35.
Figure 37:
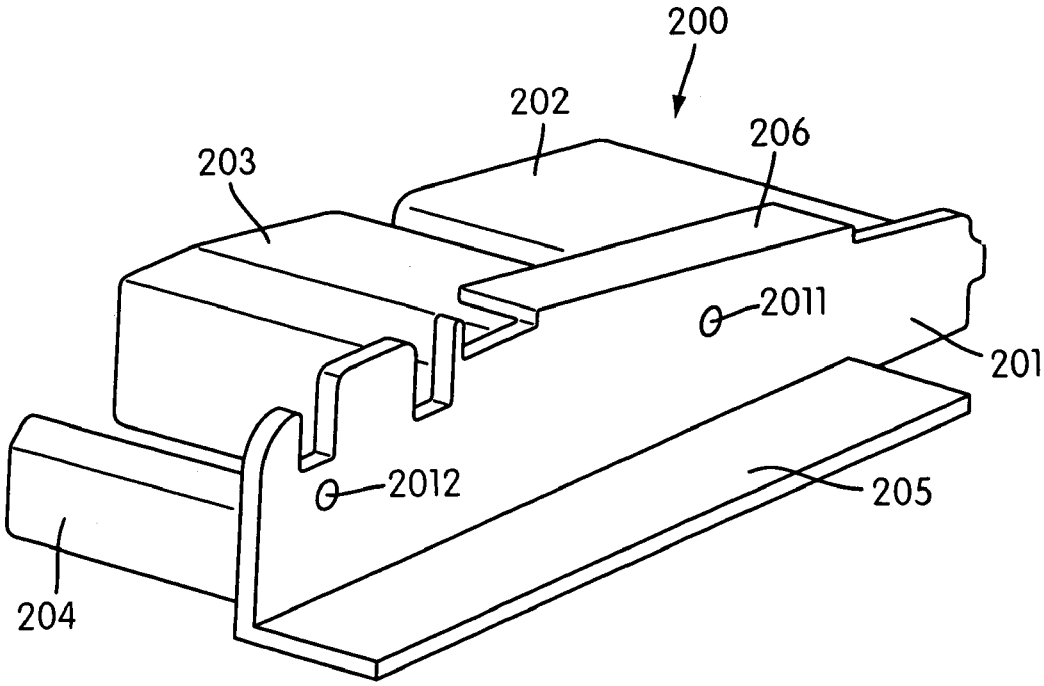
FIG. 37 is a right side perspective view of the corner key assembly of FIG. 35.
Figure 38:
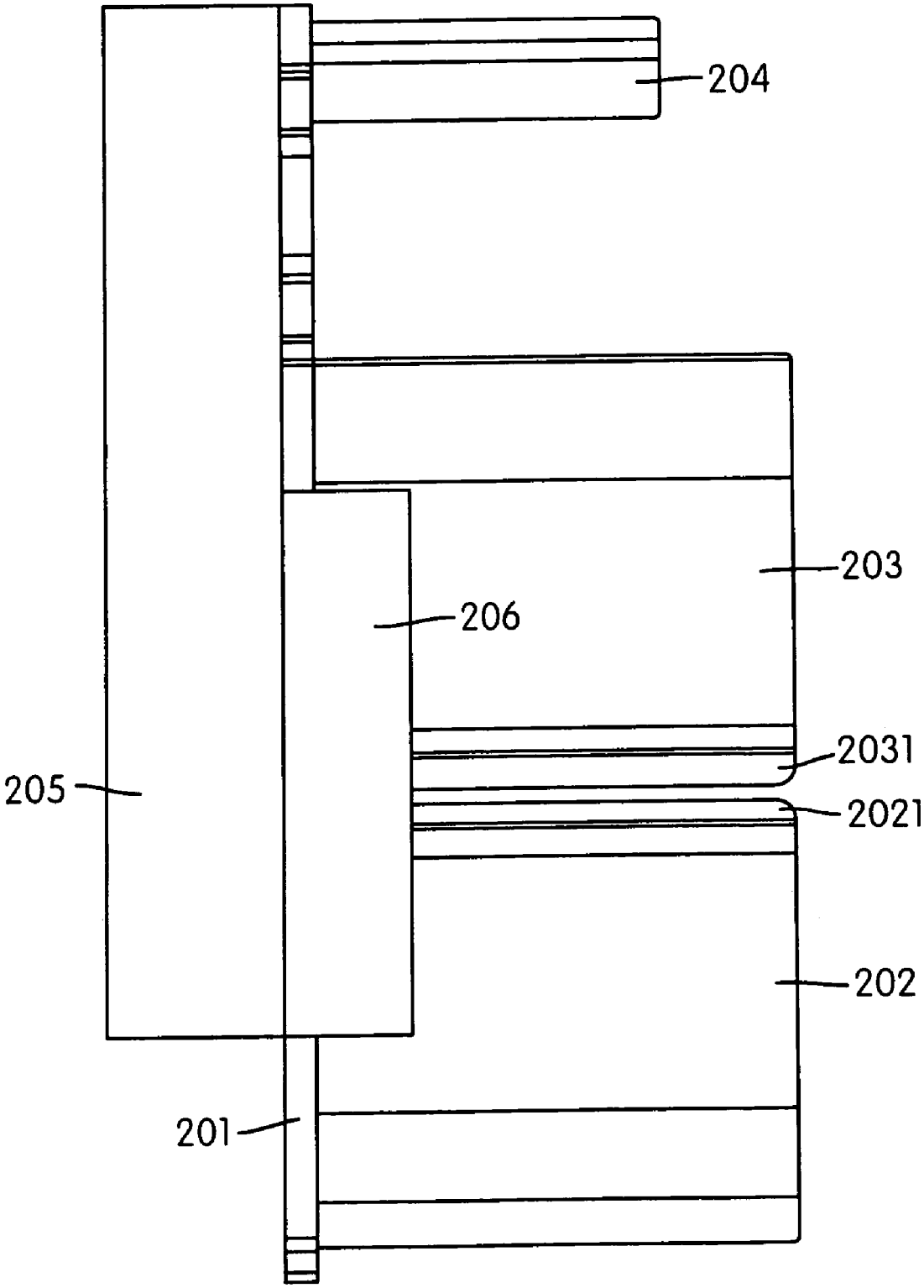
FIG. 38 is a top view of the corner key assembly of FIG. 35.

As shown in FIGS. 33 and 34, the adjustment bracket 43 includes a lower portion 431 that is slidably positioned between the ribs 181 and 182 of the thermal break 18. An upper side portion 432 of the adjustment bracket 43 is adapted to engage the base member 41, which causes the base member 41 to be raised or lowered in response to adjustment of the adjustment mechanism. A lower side portion 433 of the adjustment bracket 43 includes a plurality of projections 4331, 4332, 4333 and 4334. The projections 4331, 4332, 4333 and 4334 are adapted to received within the channel 16 between rib 172 and screw boss 184.

Figure 28:
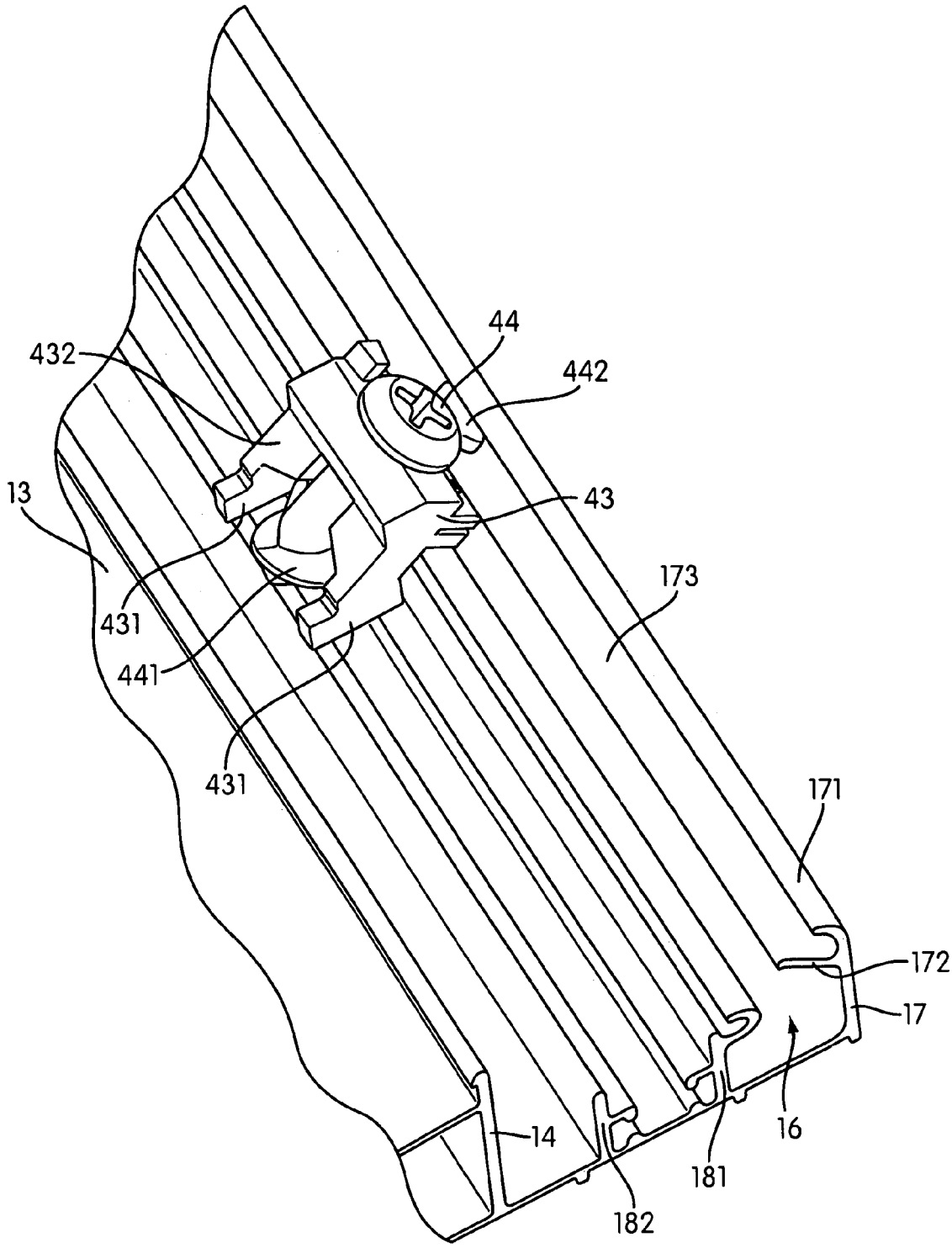
FIG. 28 is a partial right schematic view of an adjustable cam and cam bracket for the embodiment of the adjustable rail assembly illustrated in FIG. 24.

As shown in FIG. 28, the construction of the adjustment bracket 43 permit the adjustment mechanism to be located at any point within the channel 16. The distances between the adjustment mechanisms can be varied. This feature provides the flexibility to create a left or right hand side lite unit with the same parts. The assembler no longer needs to carry unique inventory to support different door configurations. Furthermore, any number of adjustment mechanisms can be installed. The adjustment mechanisms can also be moved to provide clearance for after market hardware.

Figure 29:
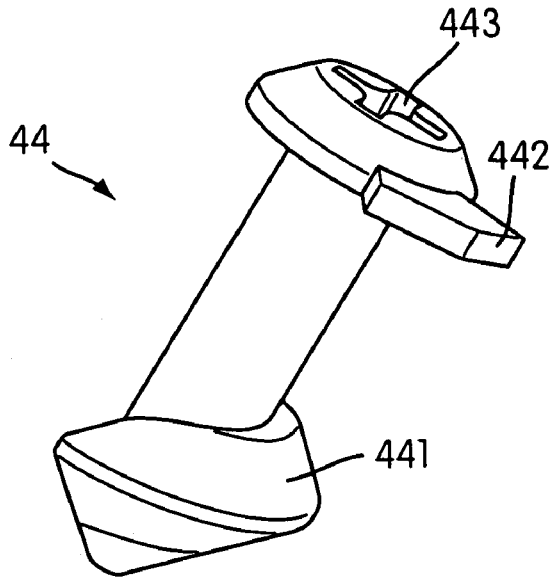
FIGS. 29 and 30 are side schematic views of the adjustable cam for use in the embodiment of the adjustable rail assembly illustrated in FIG. 24.
Figure 30:
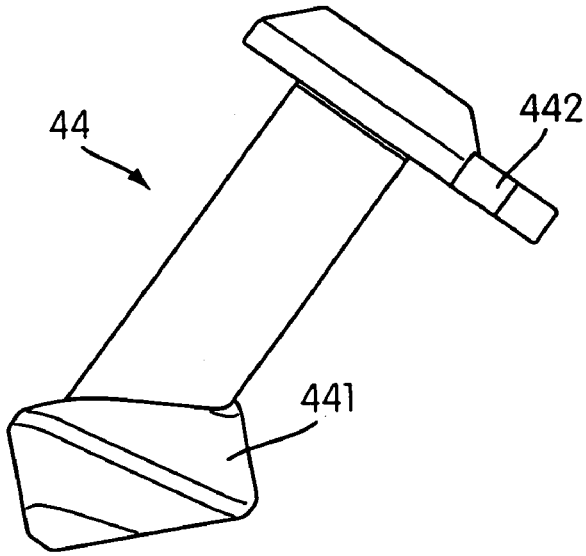
Figure 31:
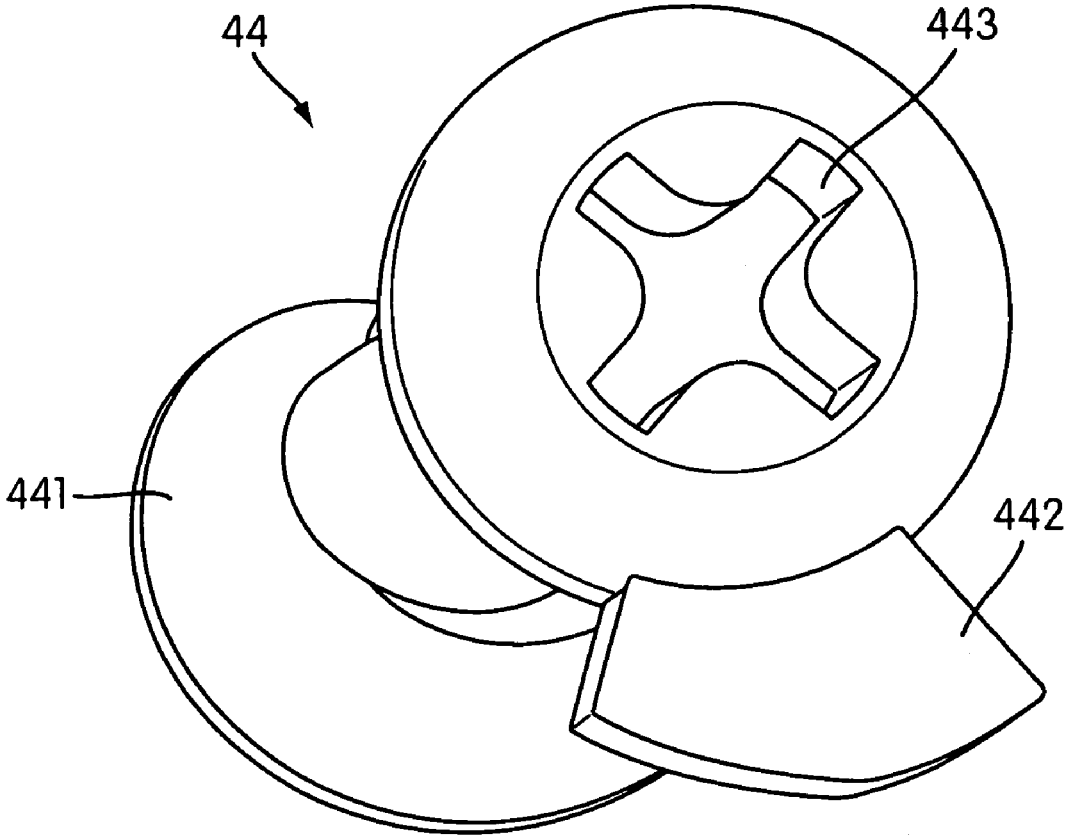
FIG. 31 is a top schematic view of the adjustable cam of FIGS. 29 and 30.

The adjustment bracket 43 also includes a stop 434 positioned on a top portion of the bracket 43. The stop 434 limits the rotation of the adjustment cam 44 within the adjustment bracket. The adjustment cam 44 includes a lower cam body 441. As shown in FIGS. 29-31, the cam body 441 includes a helical surface. Rotation of the cam 44 rotates the cam body 441 with respect to the adjustment bracket 43. The cam body 441 contacts the thermal break 18 to raise or lower the adjustment mechanism. The upper portion of the adjustment cam 44 includes a stop assembly 442, which limits the range of movement of the adjustment cam 44 and prevents over adjustment. When rotated in one direction, the travel of the adjustment cam 44 is limited when the stop assembly 442 contacts the stop 434. When rotated in an opposite direction, the travel of the adjustment cam 44 is limited when one edge of the stop assembly 442 contacts the upper free end 171 of the upwardly extending portion 17. When assembled, the stop assembly 442 is received within the channel 173. This arrangement prevents removal of the adjustment mechanism. The upper portion of the adjustment mechanism also includes an opening 443 for receiving an adjustment device, shown in FIG. 25. The adjustment device may be a screw driver.

An unique feature of the adjustable rail assembly 40 is the separation between the rail member 41 and the adjustment mechanism. This feature results in an adjustable rail assembly 40 without holes for screws. This design produces several benefits including but not limited a stiffer rail, because it does not have any holes to weaken it; weather performance, no holes for water to leak through; and fewer assembly steps, requiring no secondary operations on rail.

Figure 6:
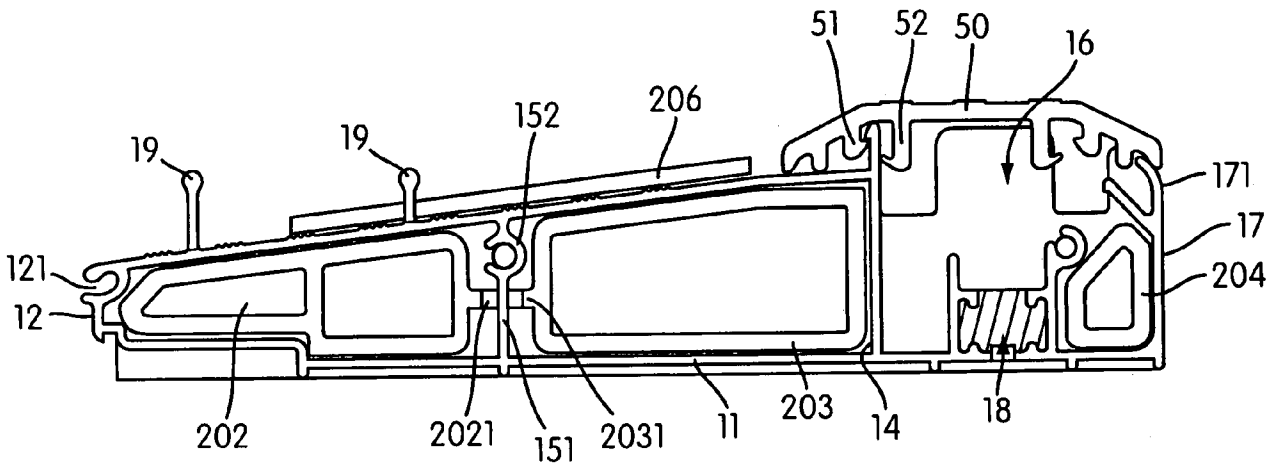
FIG. 6 is a cross sectional side view of the high profile sill assembly of FIG. 2 having a fixed rail secured thereto, an interior portion of a corner key assembly secured to the high profile sill assembly is also illustrated.
Figure 7:
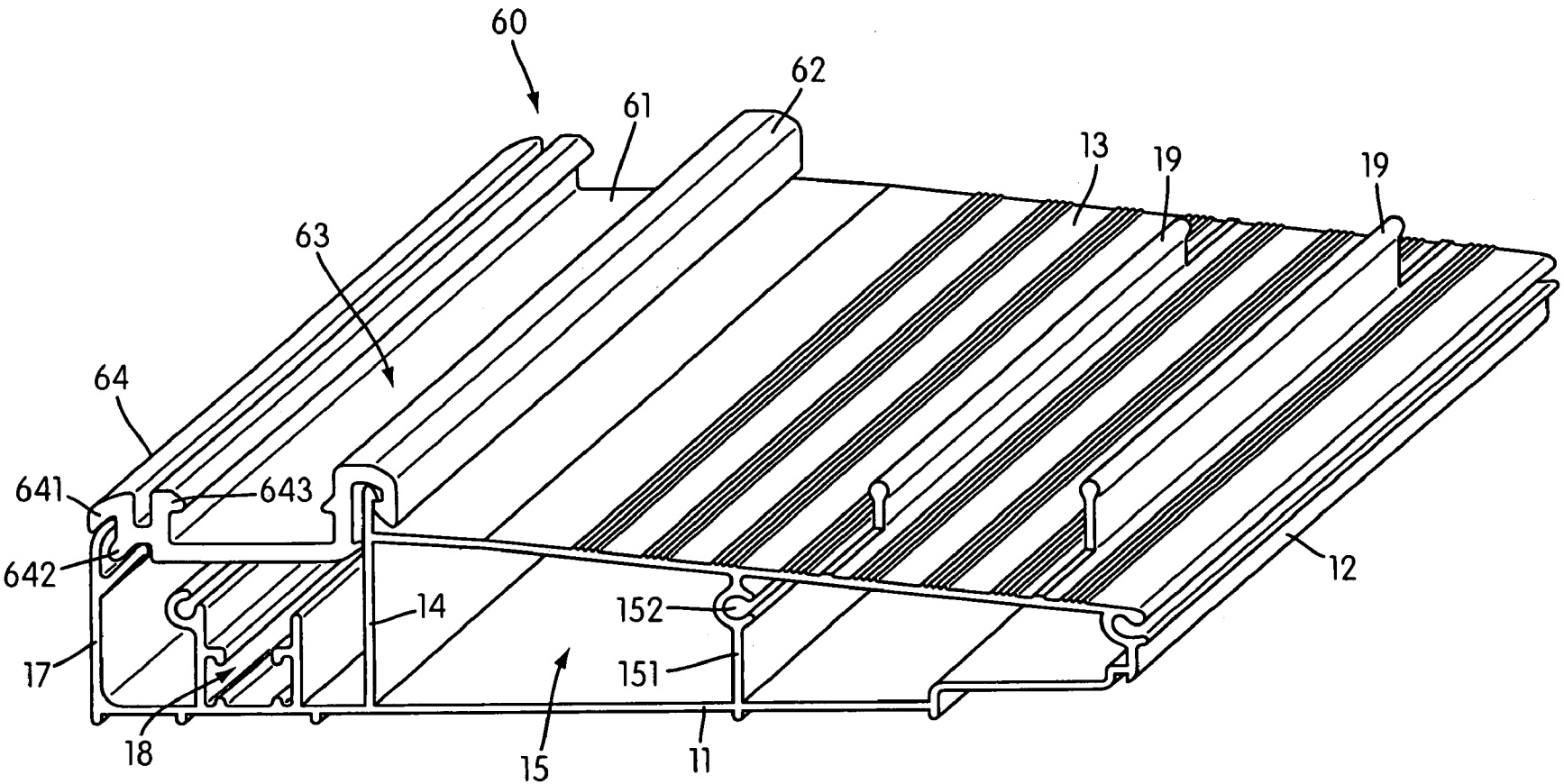
FIG. 7 is a left schematic view of the high profile sill assembly of FIG. 2 having a fixed French rail secured thereto in accordance with the present invention.
Figure 8:
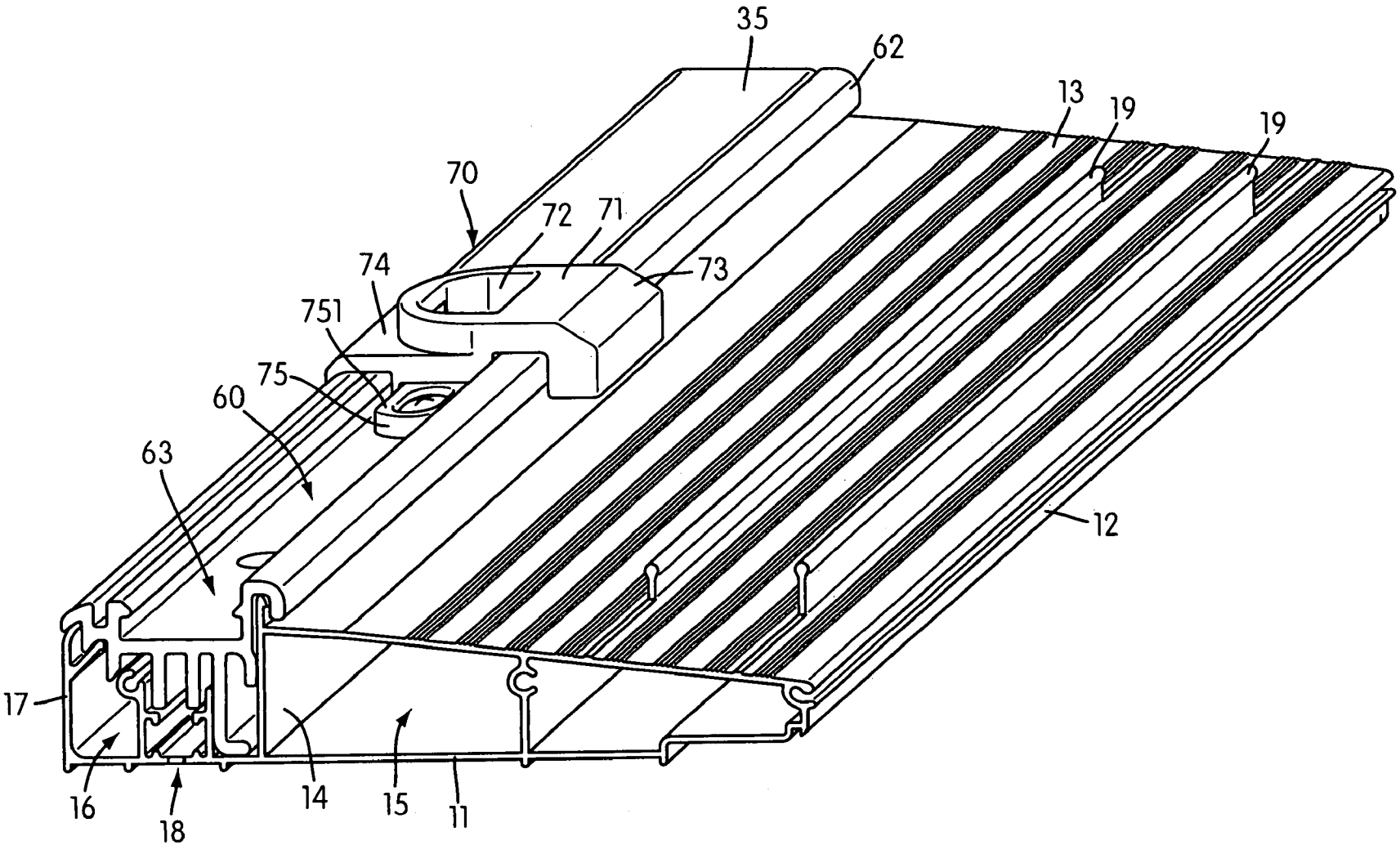
FIG. 8 is a left schematic view of the high profile sill assembly of FIG. 8 having an astragal bolt receiver and a cover plate positioned within the French rail in accordance with the present invention.
Figure 9:
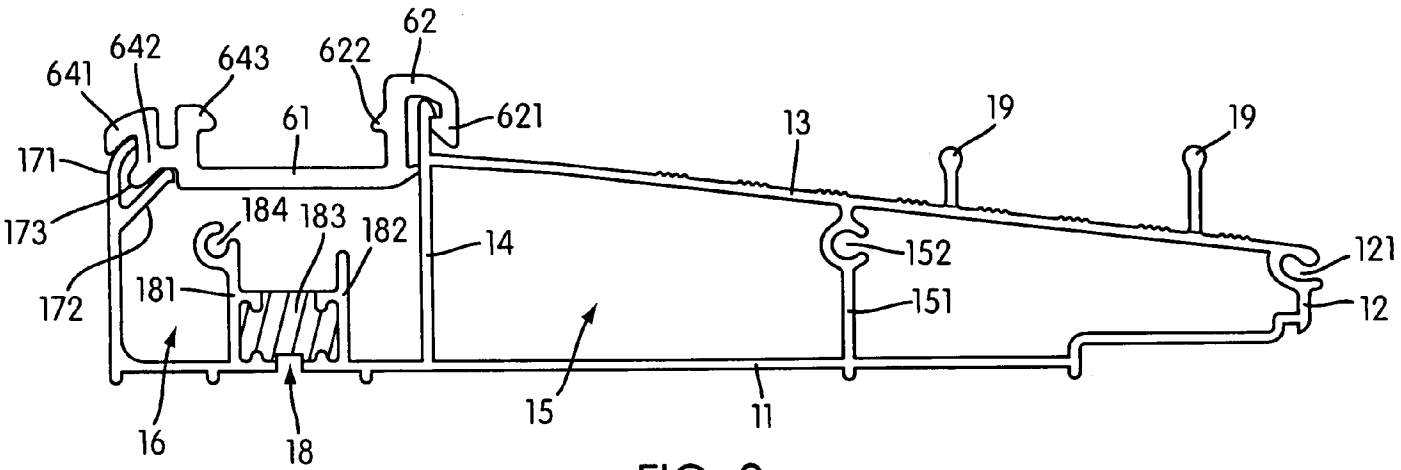
FIG. 9 is a side view of the high profile sill assembly and fixed French rail of FIG. 7.
Figure 10:
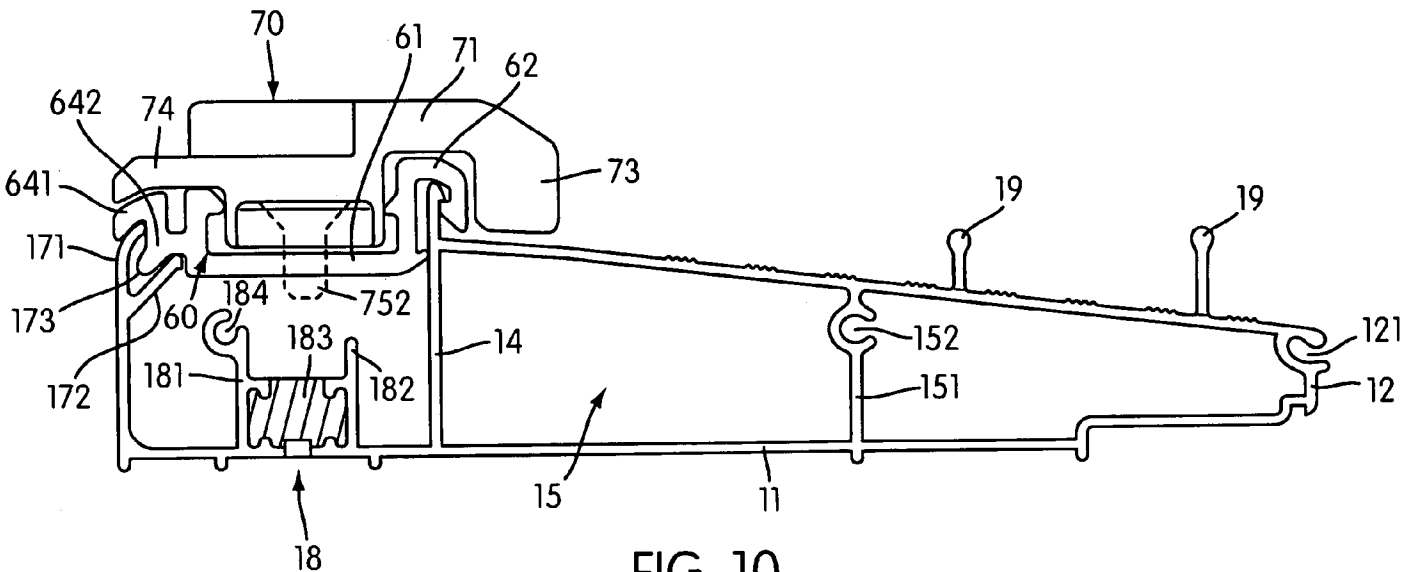
FIG. 10 is a side view of the high profile sill assembly, fixed French rail and astragal bolt receiver of FIG. 8.
Figure 11:
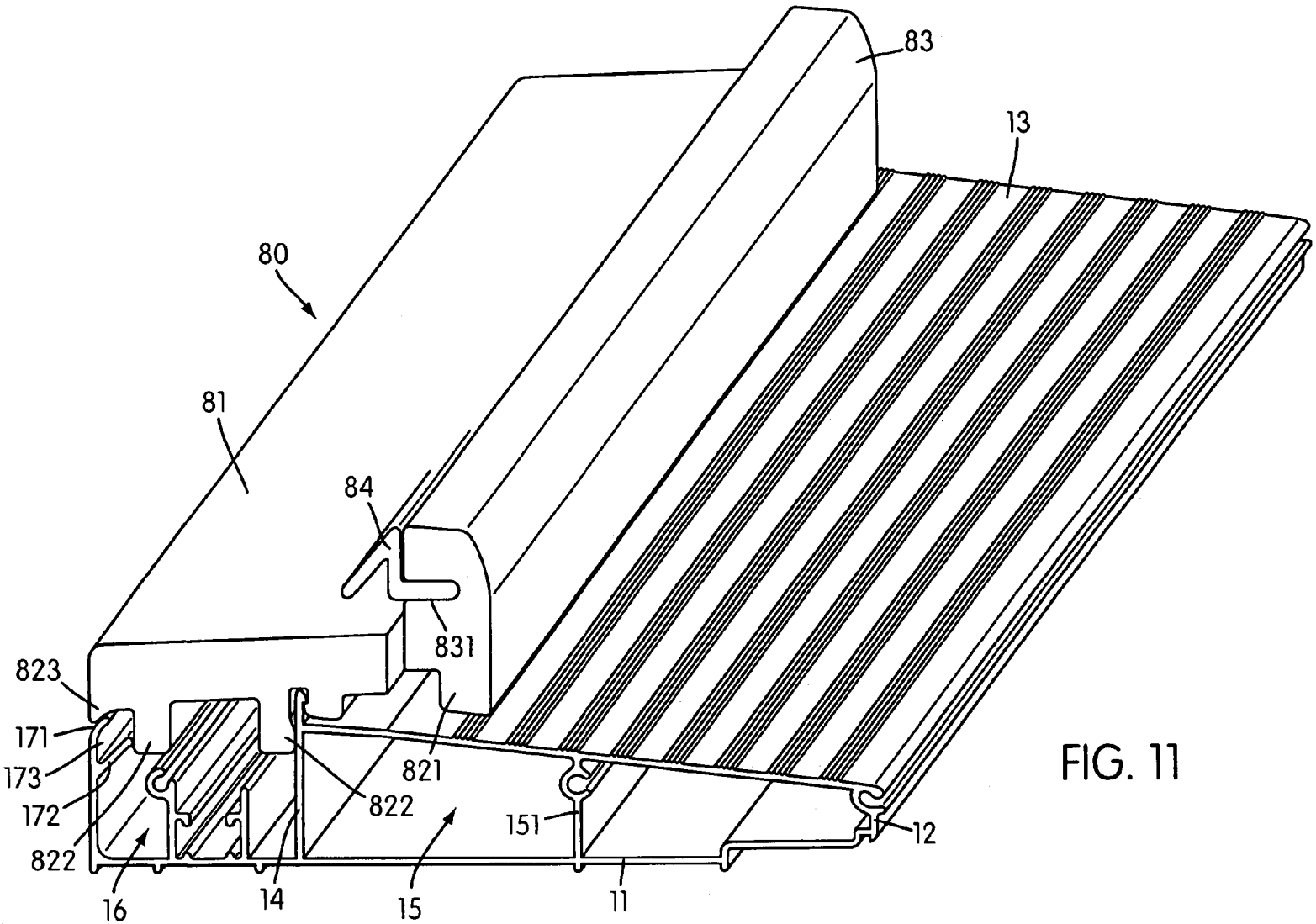
FIG. 11 is a left schematic view of the high profile sill assembly of FIG. 2 having an outswing rail assembly secured thereto.
Figure 39:
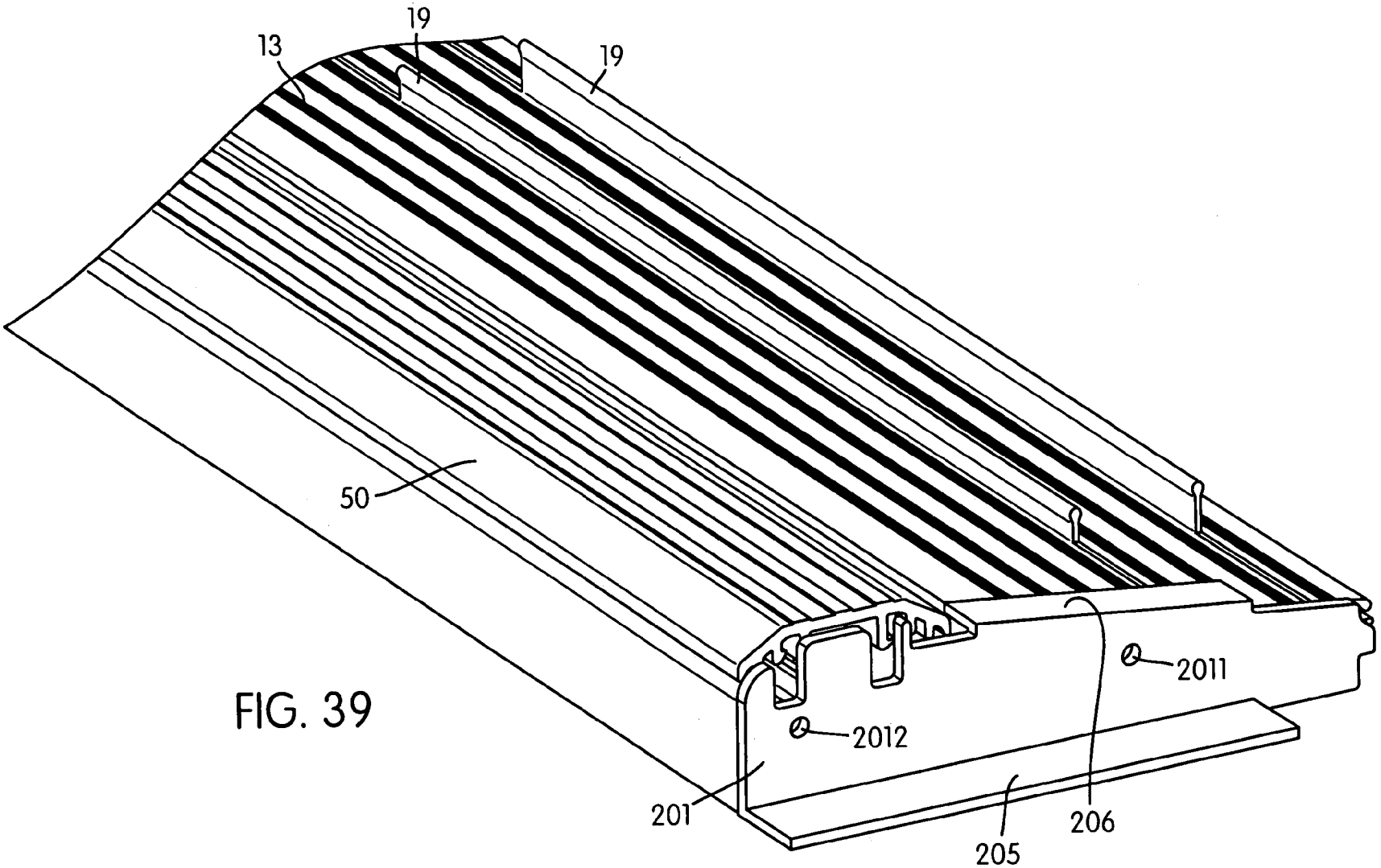
FIG. 39 is a right side perspective view of the corner key assembly located on a high profile sill assembly having a fixed rail assembly secured thereto.

The adjustable rail assemblies 30 and 40, described above, are not always required or desired in a particular door jamb design. In those circumstances, a fixed rail may be used, which is more economical than an adjustable rail assembly. A fixed rail assembly 50 in accordance with the present invention will now be described in greater detail. The fixed rail assembly 50 may be positionable anywhere along the channel 16 in the high profile sill assembly 10, as shown in FIGS. 6 and 39, or the anywhere along the channel 24 in the low profile sill assembly 20. Different fixed panels are not required for high and low profile sill assemblies.

Figure 17:
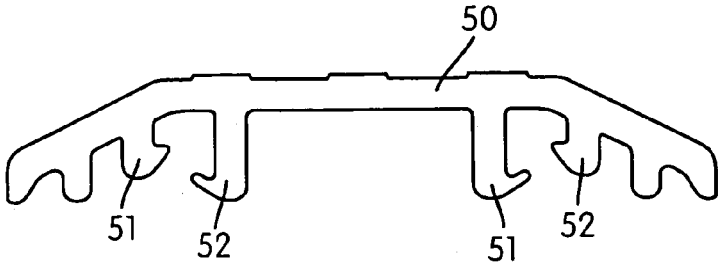
FIG. 17 is a side view of the fixed rail assembly of FIG. 6 in accordance with the present invention.

As shown in FIG. 17, the fixed rail assembly 50 has a symmetrical such that it is reversible and provides an aesthetic appearance. The appearance is unique on low profile sills. The fixed rail assembly 50 includes downwardly extending projections 51 and 52, which extend the length of the fixed rail assembly 50. The projections 51 and 52 are adapted to engage the lip structure 14, as shown in FIG. 6, and the lip structure 23, shown in FIG. 46. The projections 51 and 52 and the respective lip structures 14 and 23 form a snap fit to secure the fixed rail assembly 50 in place. Each edge of the fixed rail assembly 50 is configured to extend over the upwardly extending portion 17 and the trailing edge portion 25, as shown in FIGS. 6 and 46. In accordance with the present invention, the fixed rail assembly 50 is preferably formed by extrusion from plastic, aluminum, steel or other suitable materials having similar properties.

Another fixed rail type assembly for use in connection with French doors or double door arrangements will now be described. A French fixed rail assembly 60 is illustrated in FIGS. 8-10, 16, and 47-49. The French fixed rail assembly 60 includes a base 61, which is sized to extend across the channel 16 in the high profile sill assembly 10 or the channel 24 in the low profile sill assembly 20. The rail assembly 60 includes a first flange 62 which extends upwardly and over the upper portion of either the lip structure 14 or lip structure 23. A free end 621 of the flange 62 extends downwardly towards the ramp portion 13 or 22. Although not shown, it is contemplated that the free end 621 of the first flange 62 may include an flexible flange integrally formed thereon. The first flange 62 forms a friction snap fit with the upper end of the lip structure 14 or 23. The flange 62 further includes a rib 622 extending inwardly into a channel 63 formed in the French fixed rail assembly 60. The rib 62 is sized to engage a complimentary rib 351 on the cover member 35. The rib 62 and the rib 351 have a snap fit engagement. The cover member 35, described above in connection with the adjustable rail assembly 30, may be used to cover the channel 63. The cover member 35 is another example of components that can be interchanged between fixed and adjustable rail assemblies and high profile and low profile sill assemblies, which reduces the inventory of components necessary to produce various door jamb designs.

Figure 16:
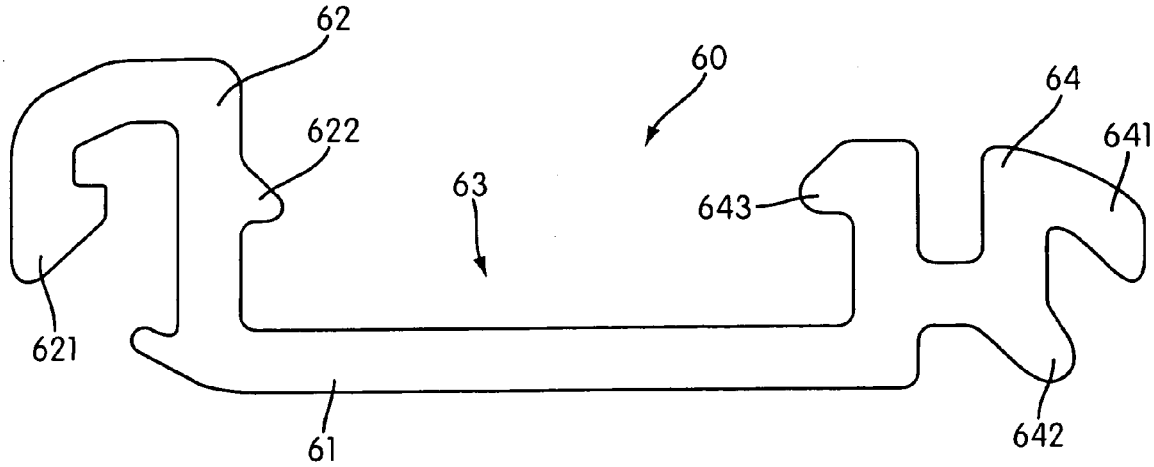
FIG. 16 is a side view of the fixed French rail assembly of FIG. 7 in accordance with the present invention.
Figure 49:
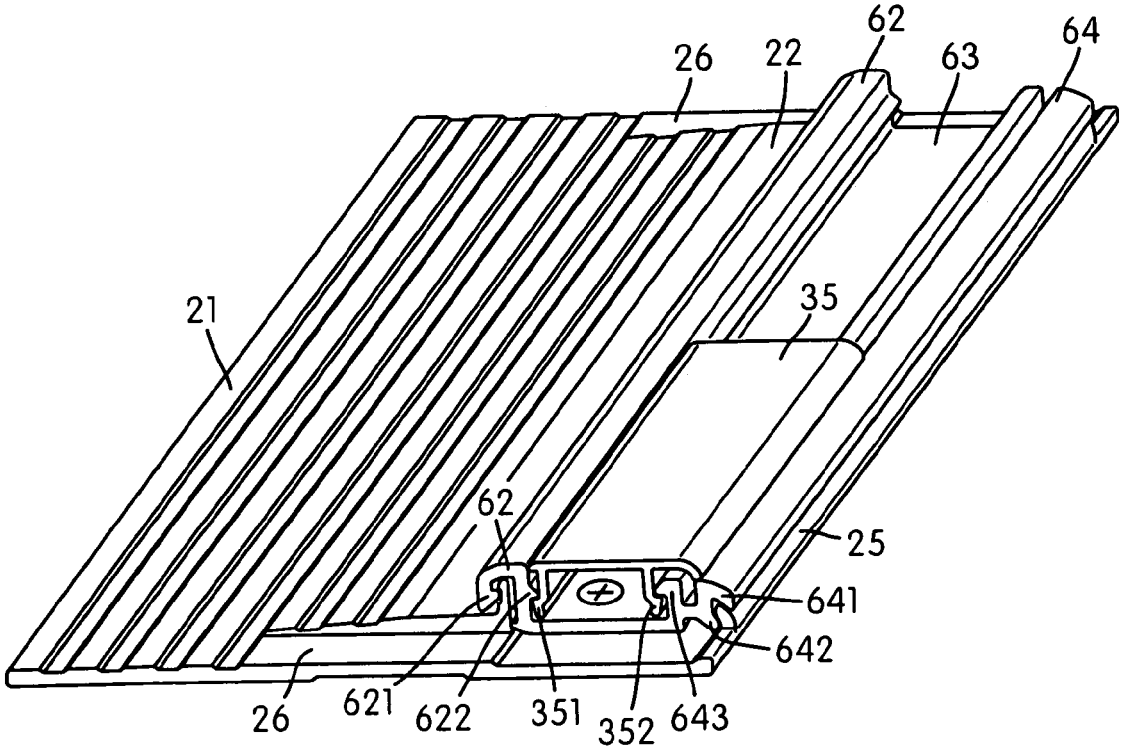
FIG. 49 is a left perspective view of the low profile sill assembly of FIG. 45 having a fixed French rail of FIG. 16 and a cover assembly secured thereto.
Figure 50:
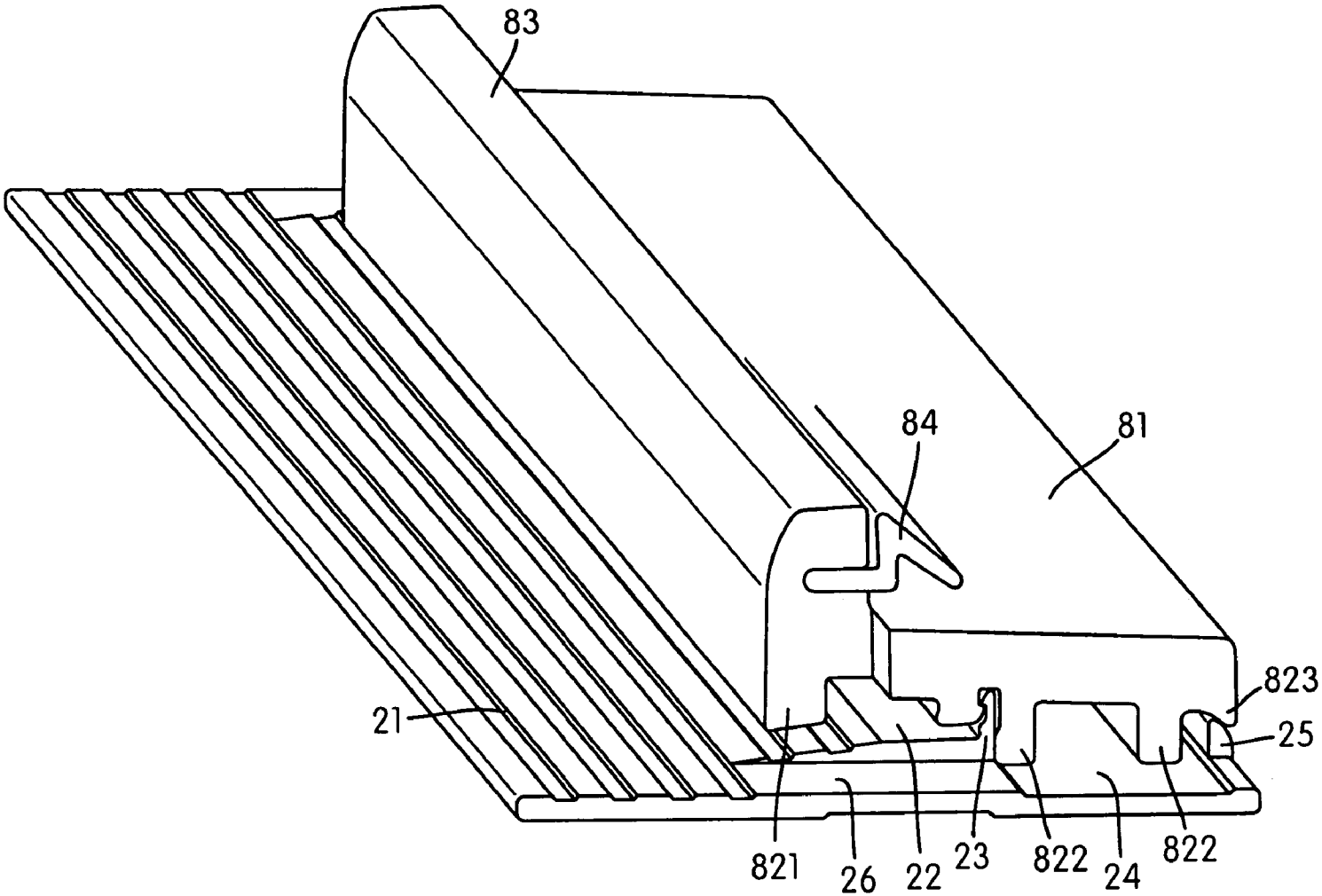
FIG. 50 is a left perspective view of the low profile sill assembly of FIG. 45 having an outswing rail assembly of FIG. 22 secured thereto.

As shown in FIG. 16, the fixed French rail assembly 60 further includes a second flange 64 which extends upwardly and over the upper portion of portion 17 or the edge portion 25. A portion 641 of the second flange 64 extends over the free end 171 or the edge portion 25. A rib 642 on the flange 64 is received within the channel 173. A rib 643 is provided to engage a complimentary rib 352 on the cover member 35, as shown in FIGS. 47 and 49. In accordance with the present invention, the French fixed rail assembly 60 is preferably formed by extrusion from plastic, aluminum, steel or other suitable materials having similar properties. Like the fixed rail assembly 50, the French fixed rail assembly 60 may be cut to size to fit any size door jamb assembly.

Figure 18:
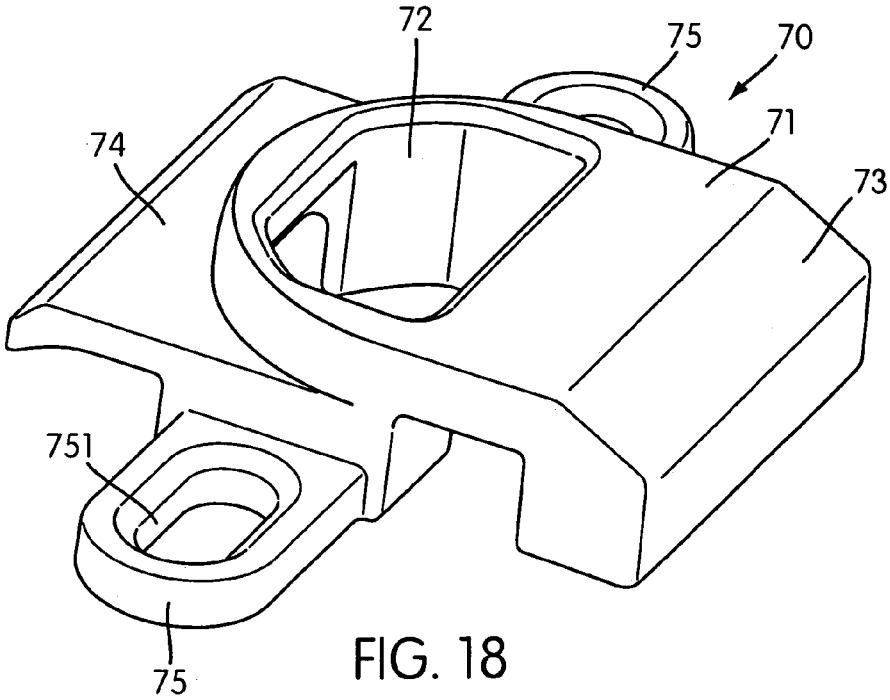
FIG. 18 is a left front schematic view of the astragal bolt receiver of FIG. 8 in accordance with the present invention.
Figure 47A:
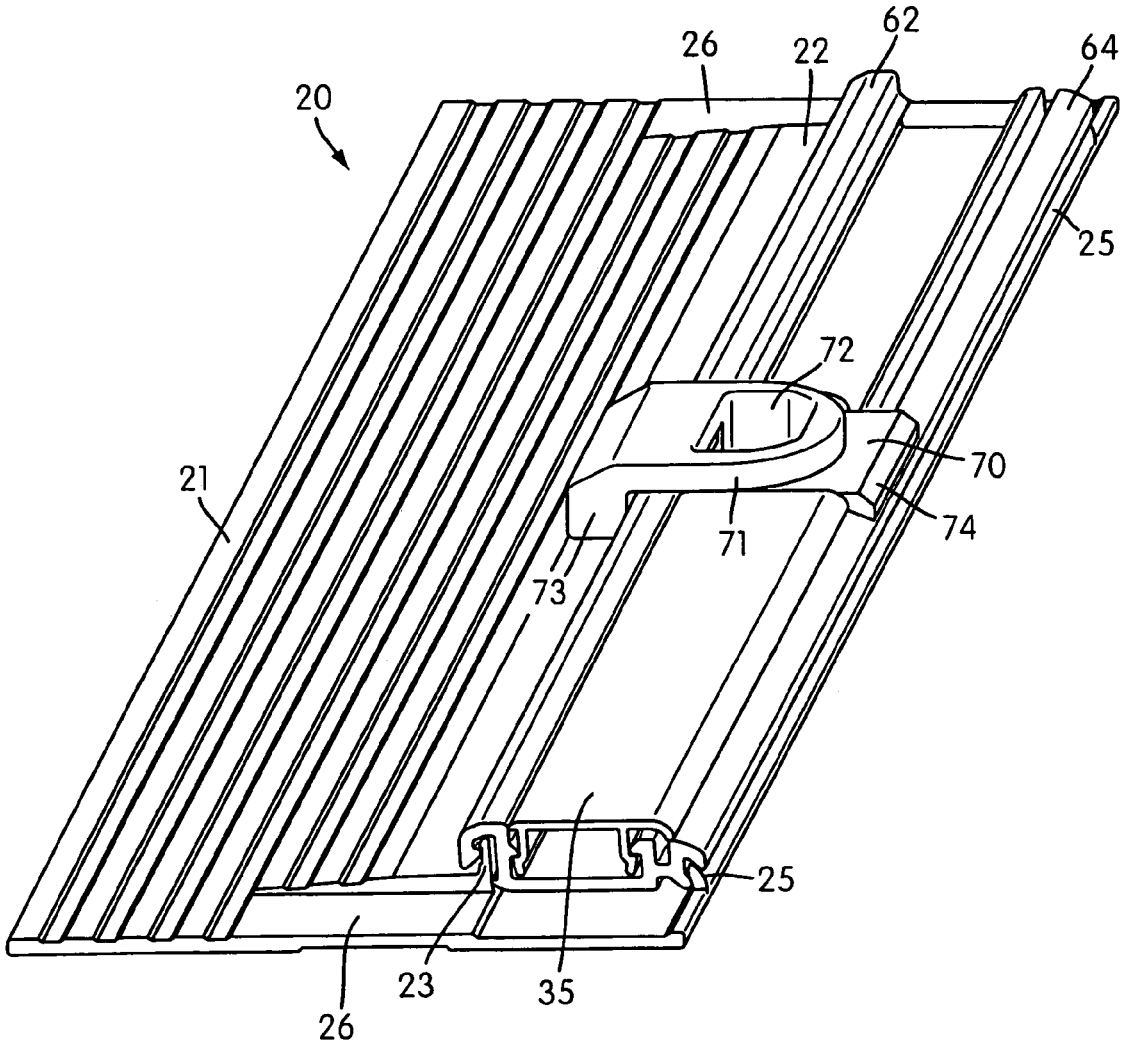
FIG. 47A is a left perspective view of the low profile sill assembly of FIG. 45 having a fixed French rail and astragal bolt receiver secured thereto.
Figure 47B:
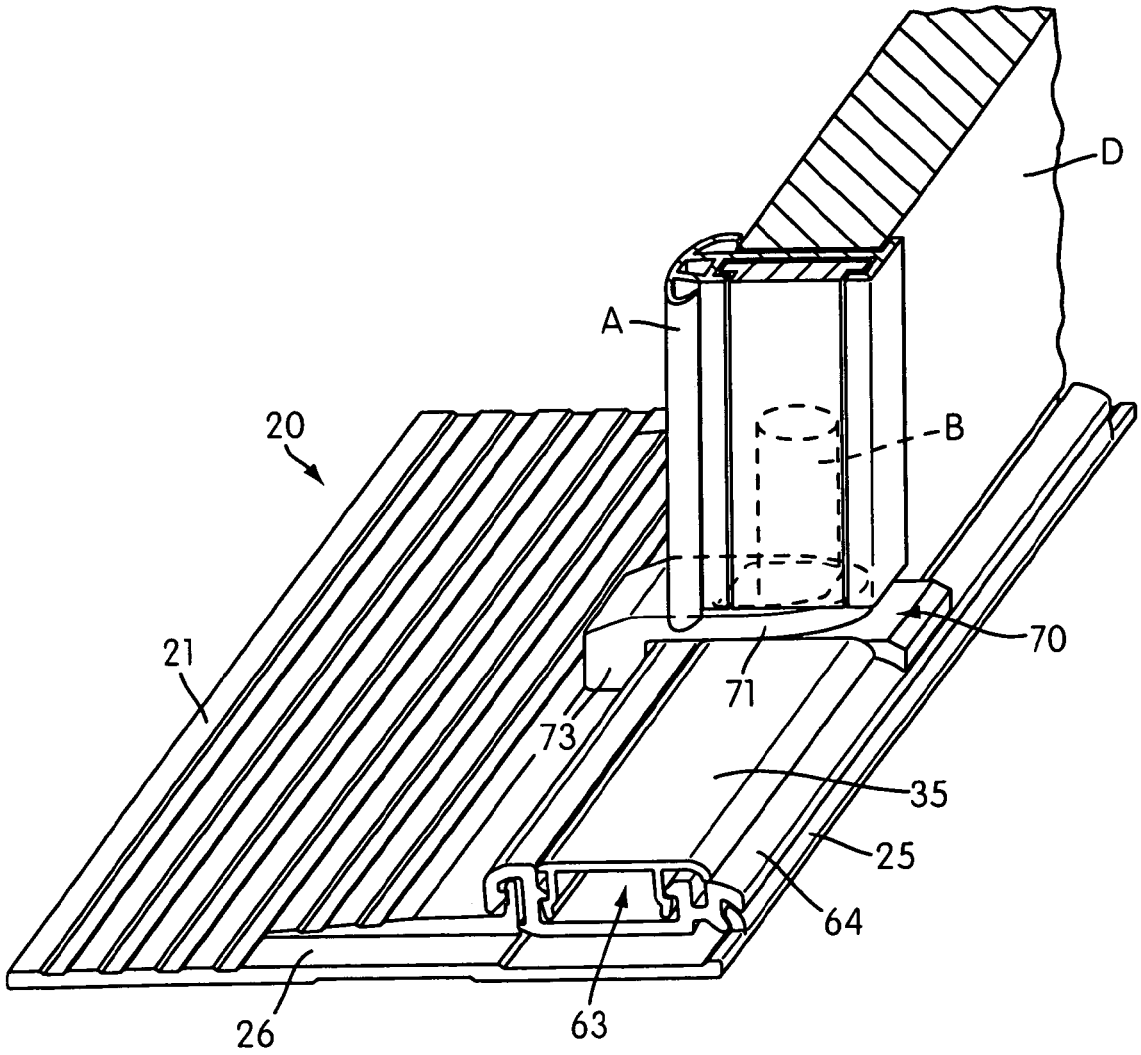
FIG. 47B is a left perspective view of the low profile sill assembly of FIG. 45 having a fixed French rail and astragal bolt receiver secured thereto with an astragal bolt received therein.
Figure 48:
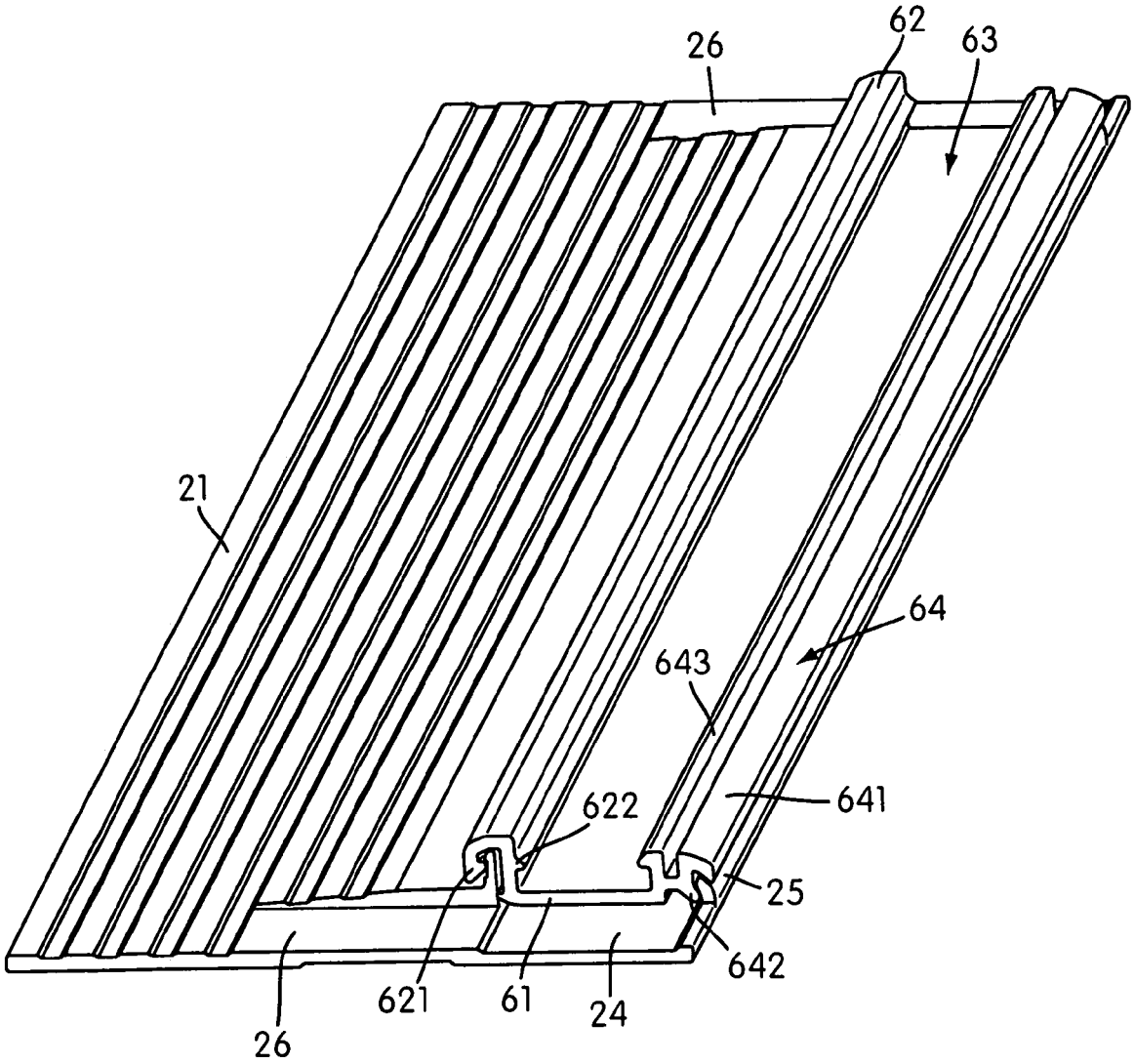
FIG. 48 is a left perspective view of the low profile sill assembly of FIG. 45 having a fixed French rail of FIG. 16 secured thereto.

The French fixed rail assembly 60 is also sized to receive an astragal bolt receiver assembly 70 illustrated in FIGS. 8, 10, 18, 47A and 47B. The astragal bolt receiver assembly 70 eliminates the need to drill a hole in the rail assembly to receive an astragal bolt B associated with an astragal A of a French or double door assembly. The French fixed rail assembly 60 includes a channel 63 sized to receive a bolt receiver 70. The astragal bolt receiver 70 is slidably received within the channel 63 such that the astragal bolt receiver 70 can be properly located to ensure proper location of the passive door D when in a closed position, as shown in FIG. 47B. This provides maximum resistance to water infiltration when the doors are in a closed position. As shown in FIG. 18, the bolt receiver 70 includes a body 71. The body 71 is sized to be received within the channel 63. The body 71 has a central opening 72 formed therein, which is sized to receive a locking bolt B from an astragal assembly A, shown in FIG. 47B, located on one of the French or double doors. A front flange 73 extends over the top of the first flange 62 of the French fixed rail assembly 60. A rear flange 74 extends over the second flange 64 of the French fixed rail assembly 60. The pair of extensions 75 extend from opposite sides of the body 71 within the channel 62. Each extension 75 includes an opening 751 for receiving a fastener 752 therein to secure the bolt receiver 70 to the French fixed rail assembly 60.

The astragal bolt receiver assembly 70 in accordance with the present invention ensures proper location of the opening 72 such that proper alignment of the astragal bolt is achieved. No drilling into the sill assembly is required. Unlike known double door jambs, the bolt receiver assembly 70 can be positioned within the channel 63 when the passive door D is in a closed position. The assembler properly locates the body 71 within the channel 63 when the astragal bolt B is received within the channel 63. One of the extensions 75 is exposed so that the assembler can secure a fastener 752 through the opening 751. After one side is secured, the passive door D is opened and the assembler can secure a fastener in the opening 751 in the opposite extension. The cover member 35 hides the fasteners 752.

After installation, the location of the astragal bolt receiver assembly 70 can be adjusted. This is important because houses tend to settle over time, causing a fixed bolt receiver to bind the astragal bolt, which can hamper door opening performance and possibly create leaks. The adjuster removes the cover members 35 to expose the fasteners 752. The fasteners 752 are loosened to permit shifting of the body 71 within the channel 63. The openings 751 are elongated to permit adjustment. Once repositioned the body 71 is repositioned, the fasteners 752 are tightened and the cover members 35 are placed with in the channel 63.

Figure 12:
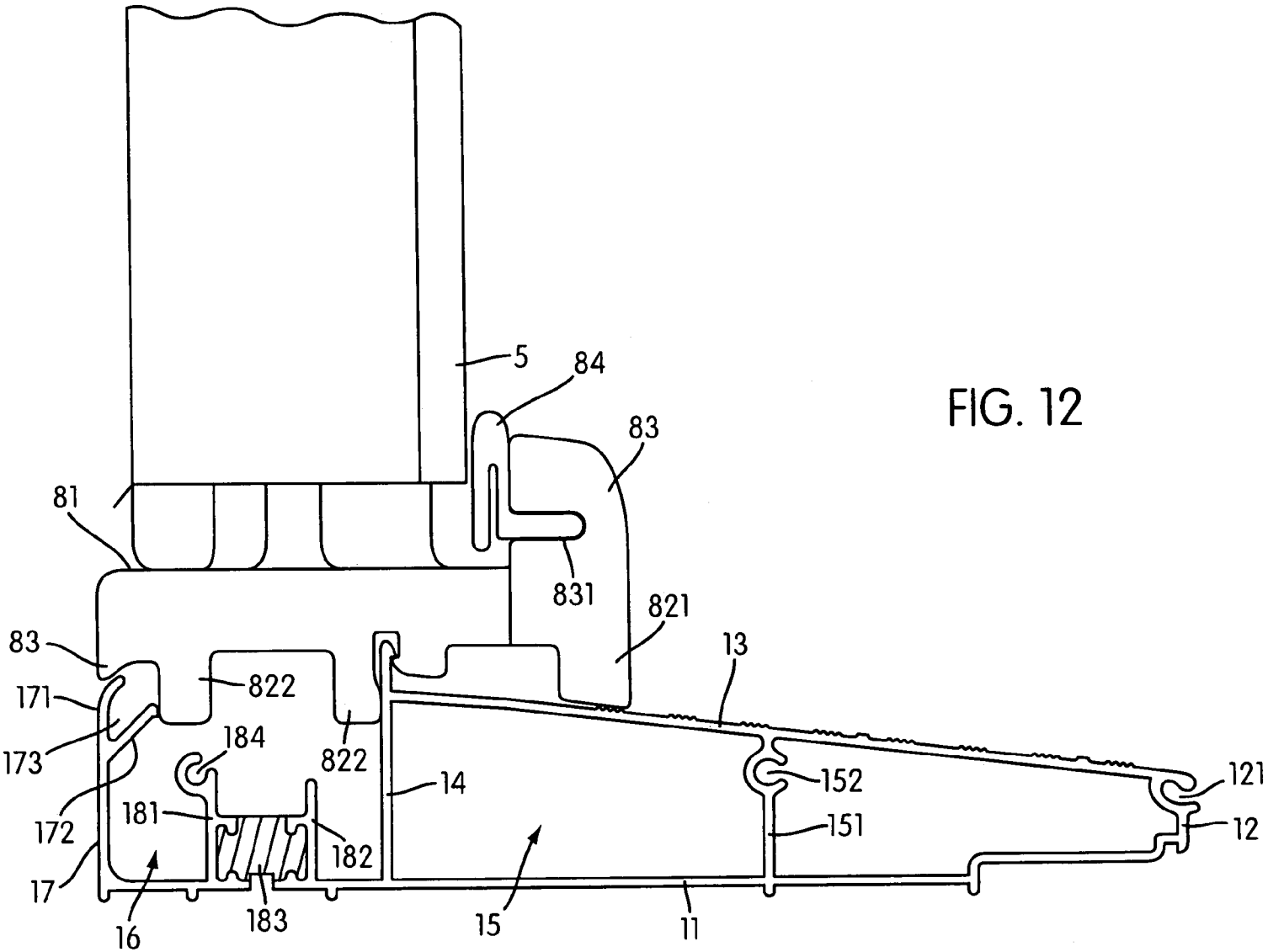
FIG. 12 is a side view of the high profile sill assembly and outswing rail assembly of FIG. 11 positioned below a door in accordance with the present invention.
Figure 53:
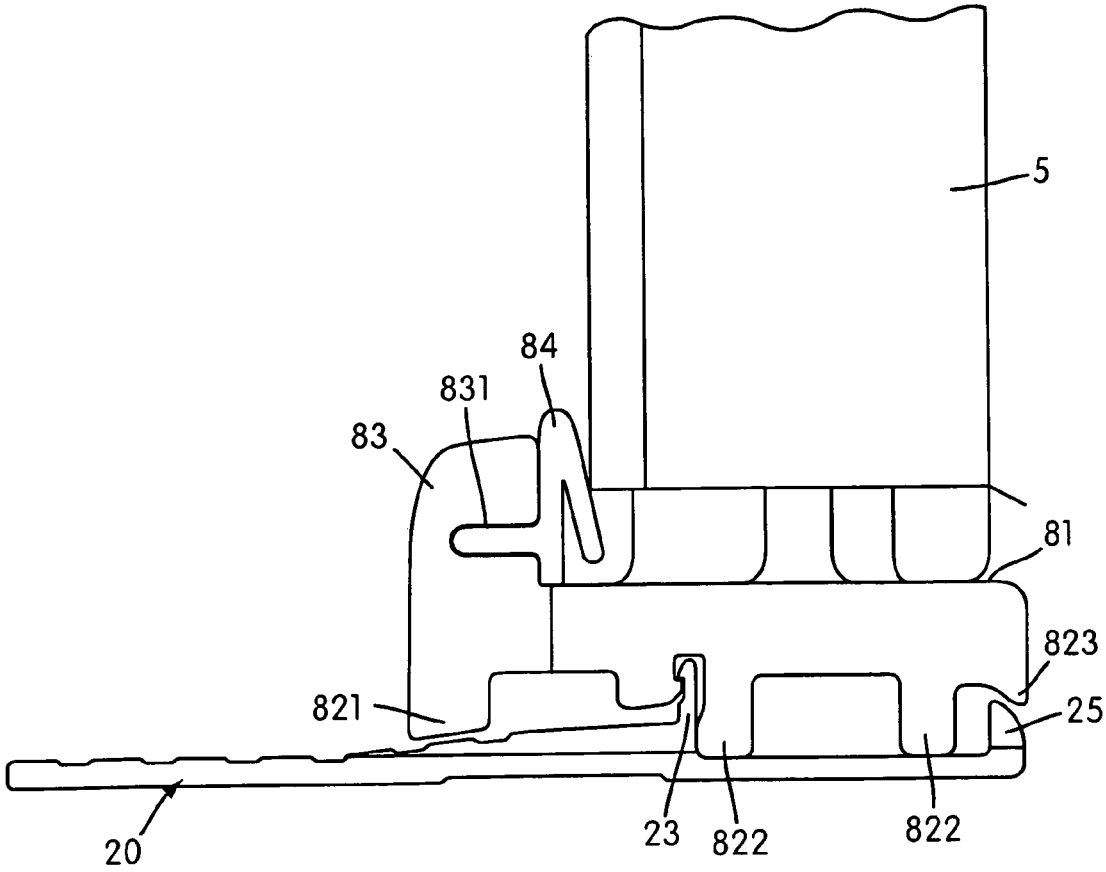
FIG. 53 is a side view of the low profile sill assembly of FIG. 45 having an outswing rail assembly secured thereto.
Figure 54:
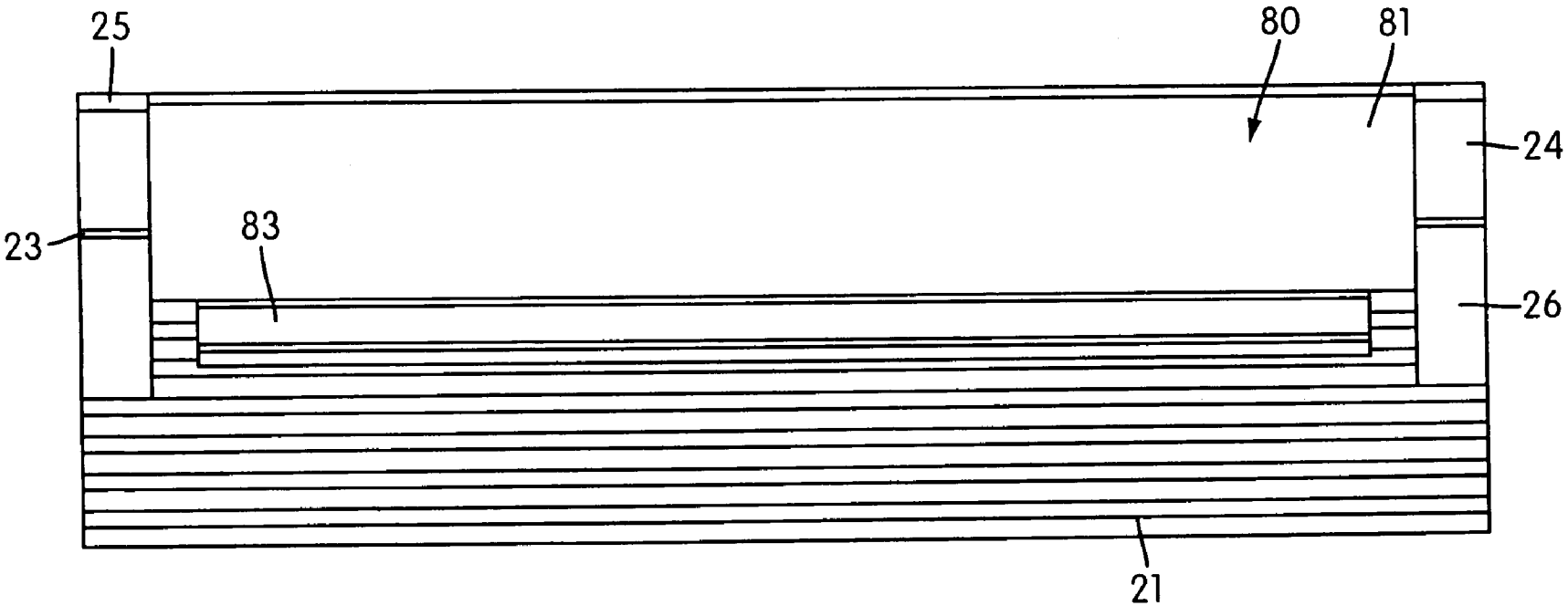
FIG. 54 is a top view of the low profile sill assembly of FIG. 45.

In some applications, it is desirable for the door to open outwardly rather than inwardly. The high profile sill assembly 10 and the low profile sill assembly 20 in accordance with the present invention can be configured without modification; rather an outswing rail assembly 80, illustrated in FIGS. 11, 12, 14, 22, 23, 50 and 53, may be installed in channel 16 and 24. The outswing rail assembly 80 maybe used in connection with the mullion boot assembly 100 and side panel support 90, described below, to create a door assembly having an outward swing with fixed side panels. It is also contemplated that the outswing rail assembly 80 may be used with the bolt receiver 70 to create outwardly swinging French or double doors. The rail assembly 80 includes a substantially flat upper surface 81 and a sill engaging surface 82 that is generally shaped to compliment the topographic configuration of both the high profile sill assembly 10 and the low profile assembly 20. The sill engaging surface 82 includes a leading edge depending portion 821 that extends downwardly to engage surface 13 or 22 on the sill assemblies 10 and 20. The rail assembly 80 also includes an intermediate depending portion(s) 822 that is to be received within the channel 16 or 24. A trailing edge portion 823 of the rail assembly 80 includes an arcuate surface configured to engage the trailing edge portion 17 or 25. Upwardly projecting bumper 83 is located on one side of the flat upper surface 81. The bumper 83 includes a kerf 831 to accept a weatherstrip 84 therein. The weatherstrip 84 is arranged to engage the door when the door is in a closed position, as shown in FIGS. 12 and 53. The combination of the bumper 83 and the weatherstrip 84 provide superior water resistance.

It is contemplated that the outswing rail assembly 80 may be formed from a polymer material, such as by an extrusion process, which provides a thermal break. It is also contemplated that the rail assembly 80 may be formed by extruding metallic or composite materials. Additionally, the rail assembly 80 may be formed, for example, by machining, casting, extruding, or molding any of polymer, metallic, or composite materials (including those including wood fiber and polymer). Other suitable materials and processes may also be utilized.

Figure 19:
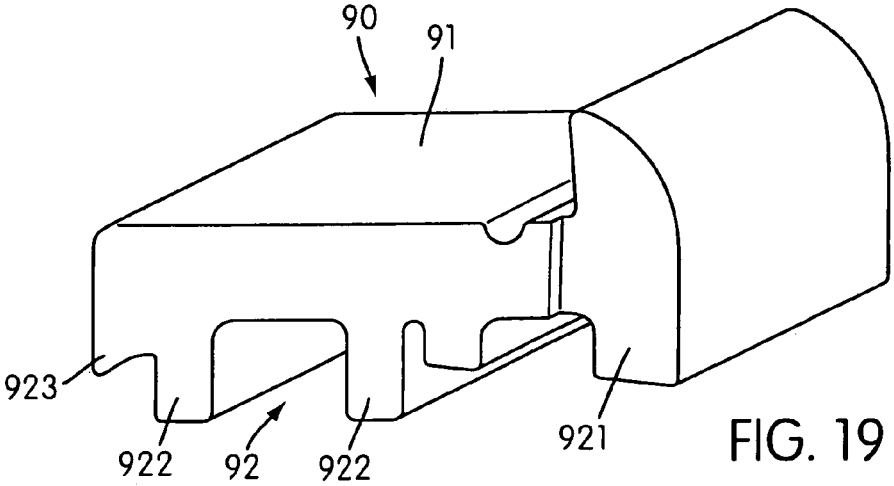
FIG. 19 is a left front schematic view of a side panel spacer in accordance with the present invention.
Figure 52:
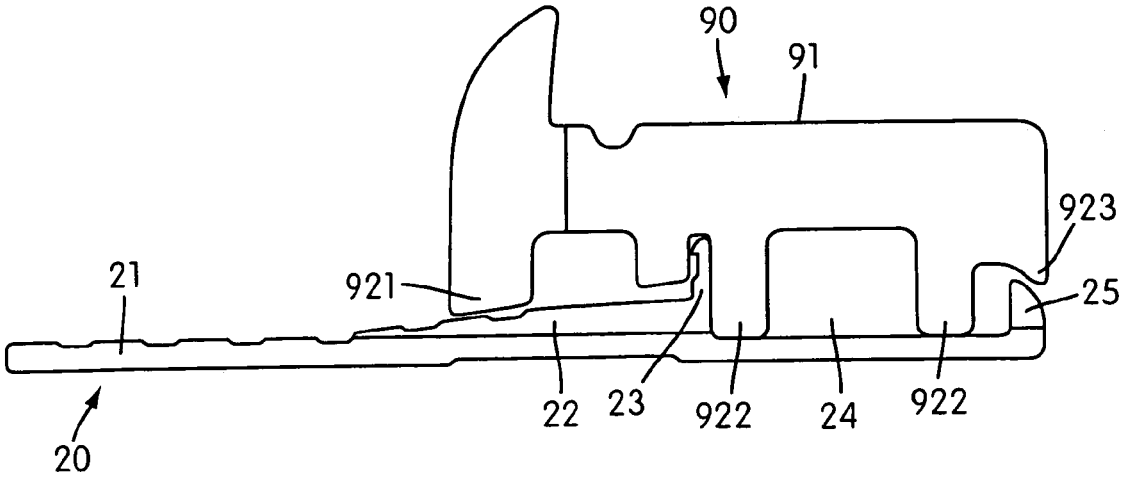
FIG. 52 is a side view of the low profile sill assembly having the side panel spacer of FIG. 19 secured thereto.

Door assemblies are frequently provided with fixed side panels. These side panels may include side lites. The fixed panels are supported within the jamb assembly between one of the vertically extending jamb members and a mullion. The vertically extending jamb members are connected to the sill assembly by directly securing the vertically extending jamb members to the sill assembly. It is also contemplated that the vertically extending jamb members may be secured to the sill assembly using a corner key assembly 200, described in greater detail below. The mullion is preferably secured to the sill assembly using a mullion boot assembly 100, described in greater detail below. The lower end of the fixed panel located between the vertically extending jamb member and the mullion is secured to the sill assembly using a side panel spacer assembly 90, illustrated in FIG. 19. The side panel spacer 90 may be used on either the high profile sill assembly 10 or the low profile sill assembly 20, as shown in FIG. 52.

The side panel spacer 90 includes a substantially flat panel support surface 91 and a sill engaging surface 92 that is generally shaped to compliment the topographic configuration of both the high profile sill assembly 10 and the low profile assembly 20. The sill engaging surface 92 includes a leading edge depending portion 921 that extends downwardly to engage surface 13 or 22 on the sill assemblies 10 and 20. The panel spacer 90 also includes an intermediate depending portion 922 that is to be received within the channel 16 or 24. A trailing edge portion 923 of the panel spacer 200 includes an arcuate surface configured to engage the trailing edge portion 17 or 25. The panel spacer 90 is described in greater detail in copending U.S. patent application Ser. No. 10/673,645, entitled "Continuous Head and Sill Assembly and Combined Head and Sill Assembly and Combined Spacing Member and Side Panel Support Therefor," filed on Sep. 30, 2003, U.S. Provisional Patent Application No. 60/414,655, entitled "Continuous Head and Sill Assembly and Spacing Member and Side Panel Support Therefor" and copending U.S. Provisional Patent Application No. 60/414,651, entitled "Continuous Head and Sill Assembly and Combined Spacing Member and Side Panel Support Therefor." The disclosures of which are hereby incorporated specifically herein by reference.

Figure 21:
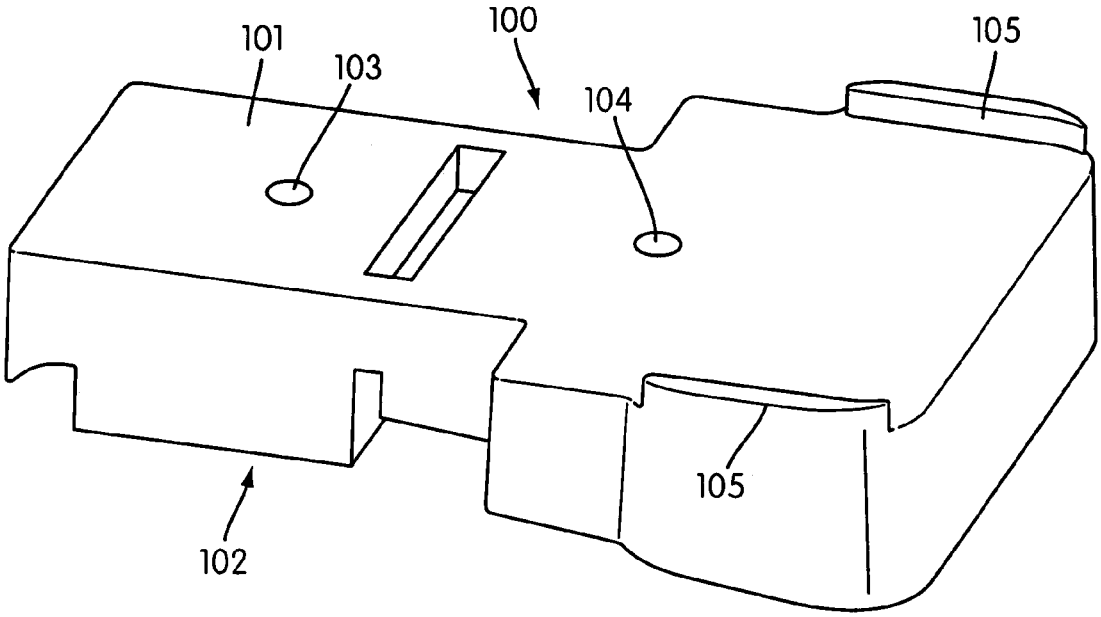
FIG. 21 is a left schematic view of a mullion boot assembly in accordance with the present invention.
Figure 22:
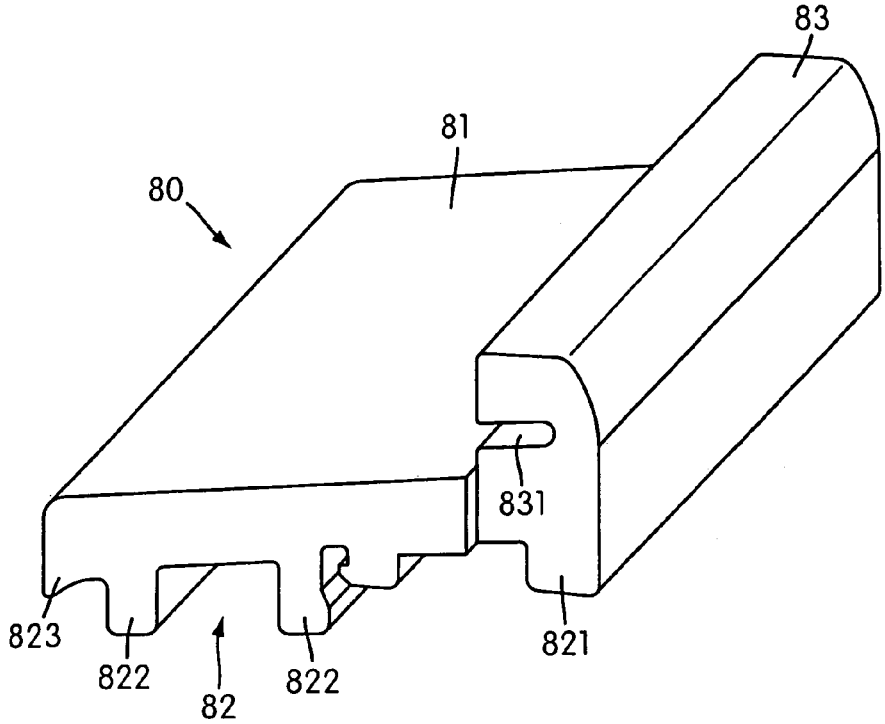
FIG. 22 is a left schematic view of the outswing rail assembly of FIGS. 11 and 12.
Figure 23:
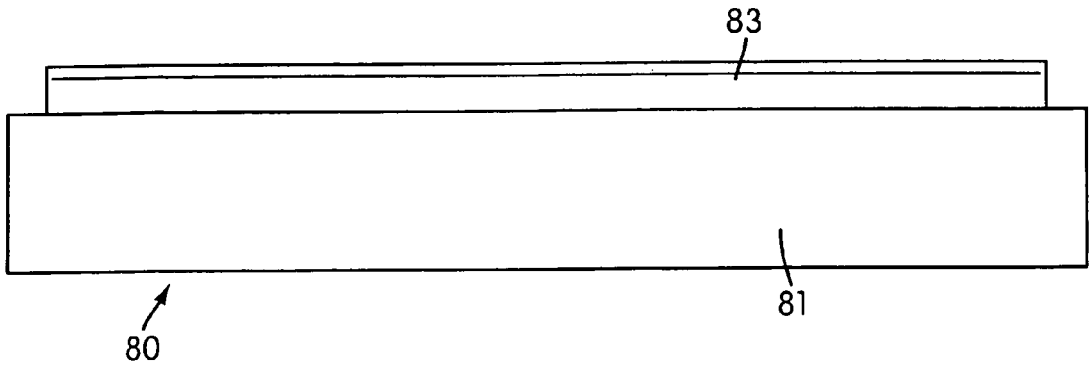
FIG. 23 is a top view of the outswing rail assembly of FIG. 22.
Figure 51:
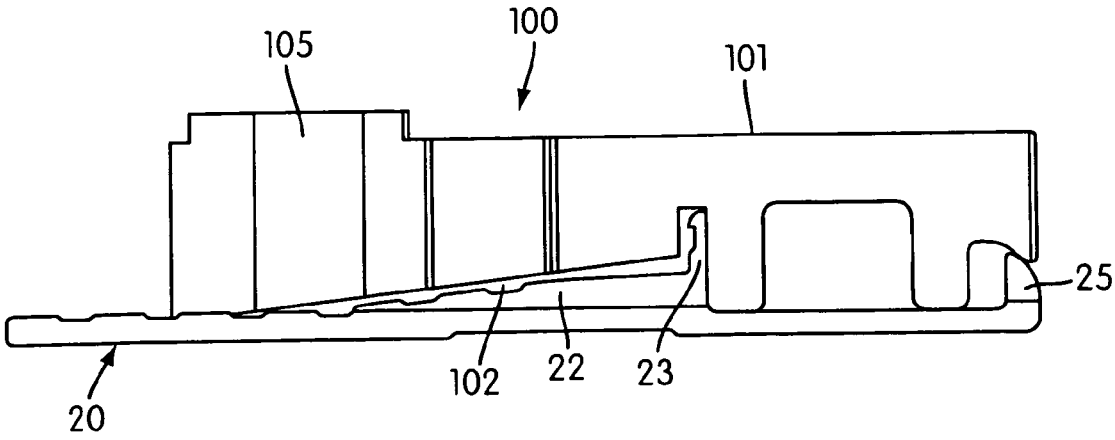
FIG. 51 is a side view of the low profile sill assembly having the mullion boot assembly of FIG. 21 secured thereto.

The mullion maybe secured to the high profile sill assembly 10 or the low profile sill assembly 20 using a mullion boot assembly 100 that is adapted to be received within channel 16 or channel 24, as shown in FIG. 51. As illustrated in FIG. 21, the mullion boot assembly 100 includes a generally horizontally extending mullion supporting surface 101 that engages a downwardly facing surface of the mullion. Additionally, the mullion boot assembly 100 further includes a sill engaging surface 102 that is contoured to a topographic configuration of both the high profile sill assembly 10 and the low profile sill assembly 20. The mullion is fastened directly to the mullion boot assembly 100 using fasteners located within apertures 103 and 104. The supporting surface 101 includes at least one upwardly extending support flange 105 adapted to engage the mullion and prevent lateral movement of the same on the mullion boot assembly 100. A single flange 105 can be provided that extends substantially around the front portion of the mullion boot assembly 100. The mullion boot assembly 100 eliminates the need to form a tenon on the end of the mullion and allows the mullion to be square cut. The mullion boot assembly 100 may be slidably positioned within the channel 16 or channel 24 such that the jamb assembly can be configured for either a left fixed panel or a right fixed panel. The mullion boot assembly 100 is described in greater detail in copending U.S. patent application Ser. No. 10/673,645, entitled "Continuous Head and Sill Assembly and Combined Head and Sill Assembly and Combined Spacing Member and Side Panel Support Therefor," filed on Sep. 30, 2003, U.S. Provisional Patent Application No. 60/414,655, entitled "Continuous Head and Sill Assembly and Spacing Member and Side Panel Support Therefor" and copending U.S. Provisional Patent Application No. 60/414,651, entitled "Continuous Head and Sill Assembly and Combined Spacing Member and Side Panel Support Therefor." The disclosures of which are hereby incorporated specifically herein by reference. The side panel spacer 90 and the mullion boot 100 can be integrally formed as a single unit.

It is contemplated that the mullion boot assembly 100 and the side panel spacer 90 may be formed of a synthetic material, such as by injection molding or casting a polymer material or a composite material (polymer-based, or otherwise). It is noted that a synthetic material may be preferable, since this type of material is generally resistant to decay or other degradation. It is also contemplated that a composite material containing a mixture of wood fiber and polymer may be used. It is also contemplated that the components may be cast from a metallic material or machined from materials such as metals, polymers, composites, wood, etc. Furthermore, the spacing member may be formed from other rigid materials, such as concrete.

Figure 40:
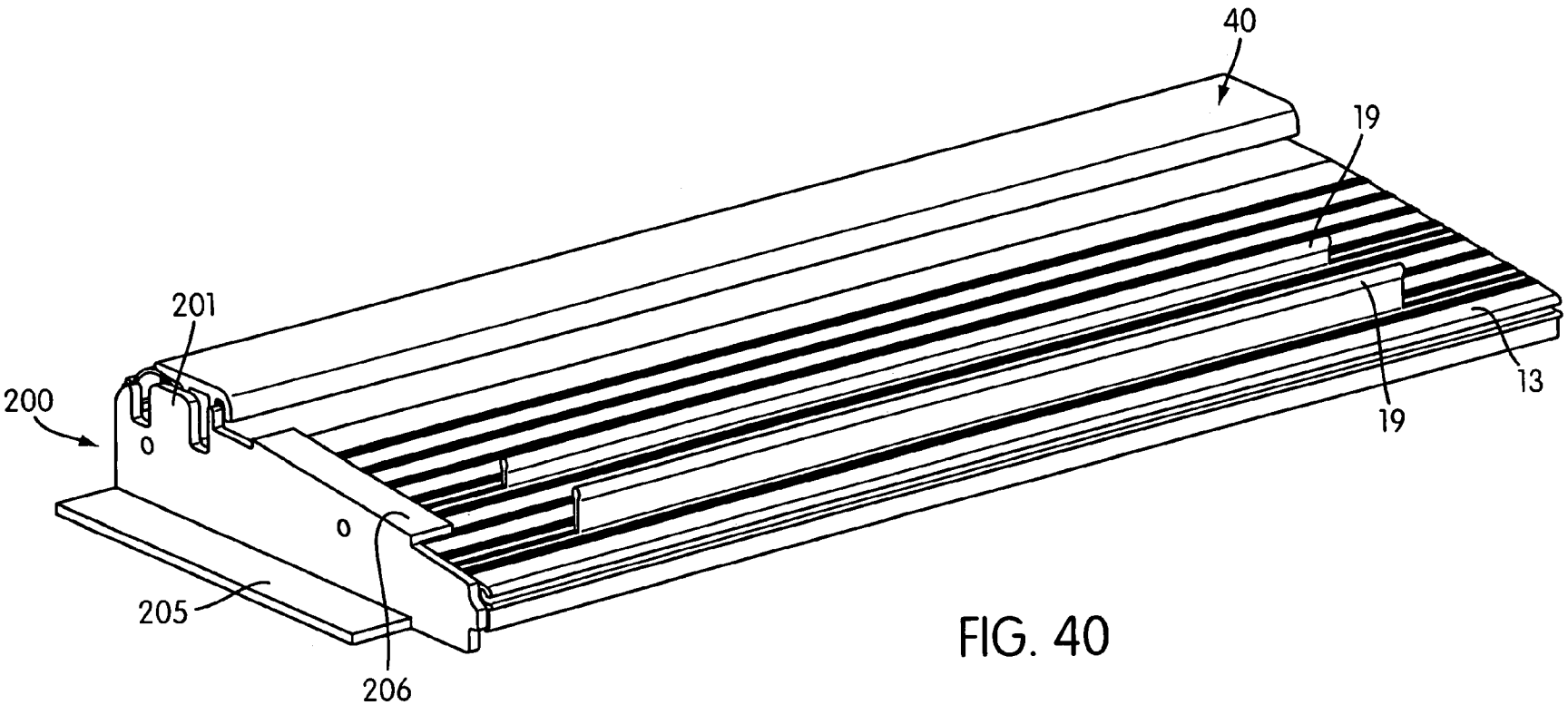
FIG. 40 is a right side perspective view of the corner key assembly located on a high profile sill assembly having an adjustable rail assembly secured thereto.
Figure 41:
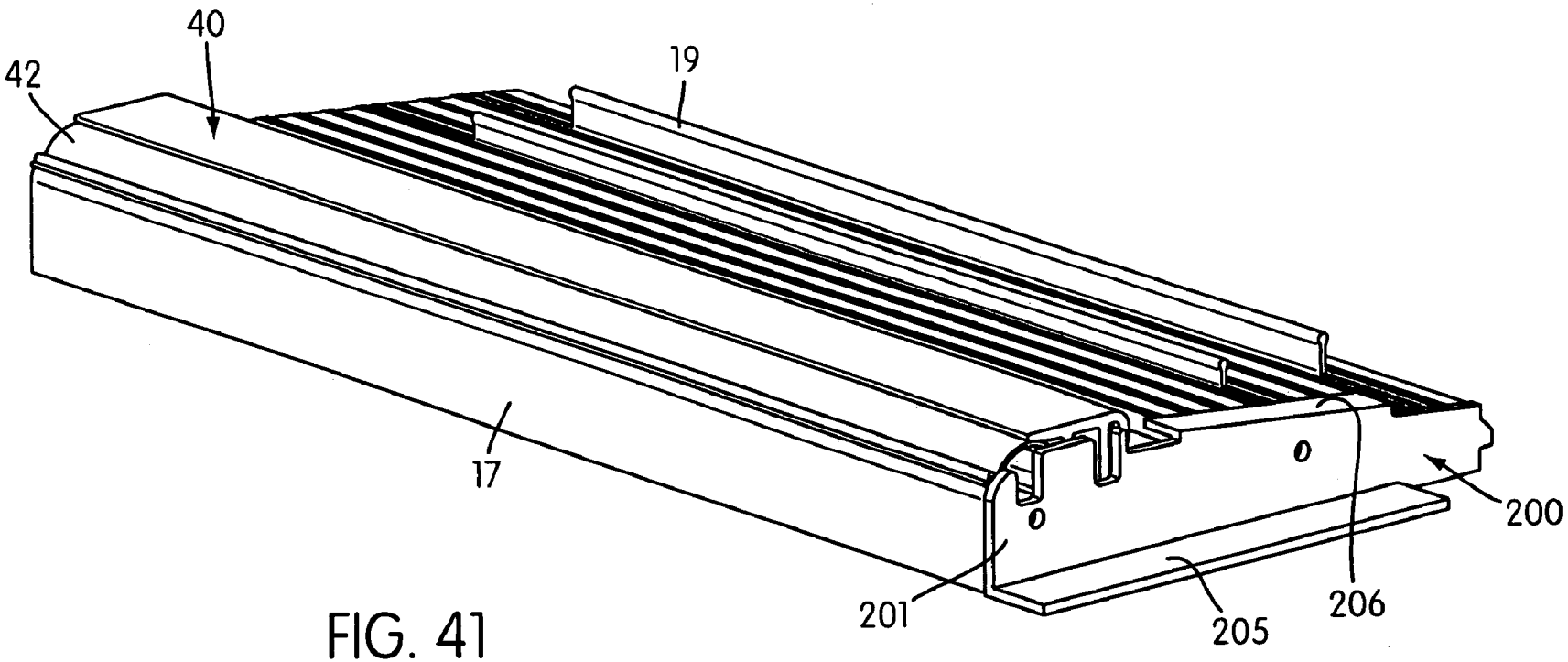
FIG. 41 is a left side perspective view of the corner key assembly located on a high profile sill assembly having an adjustable rail assembly illustrated in FIGS. 24 and 25 secured thereto.
Figure 42:
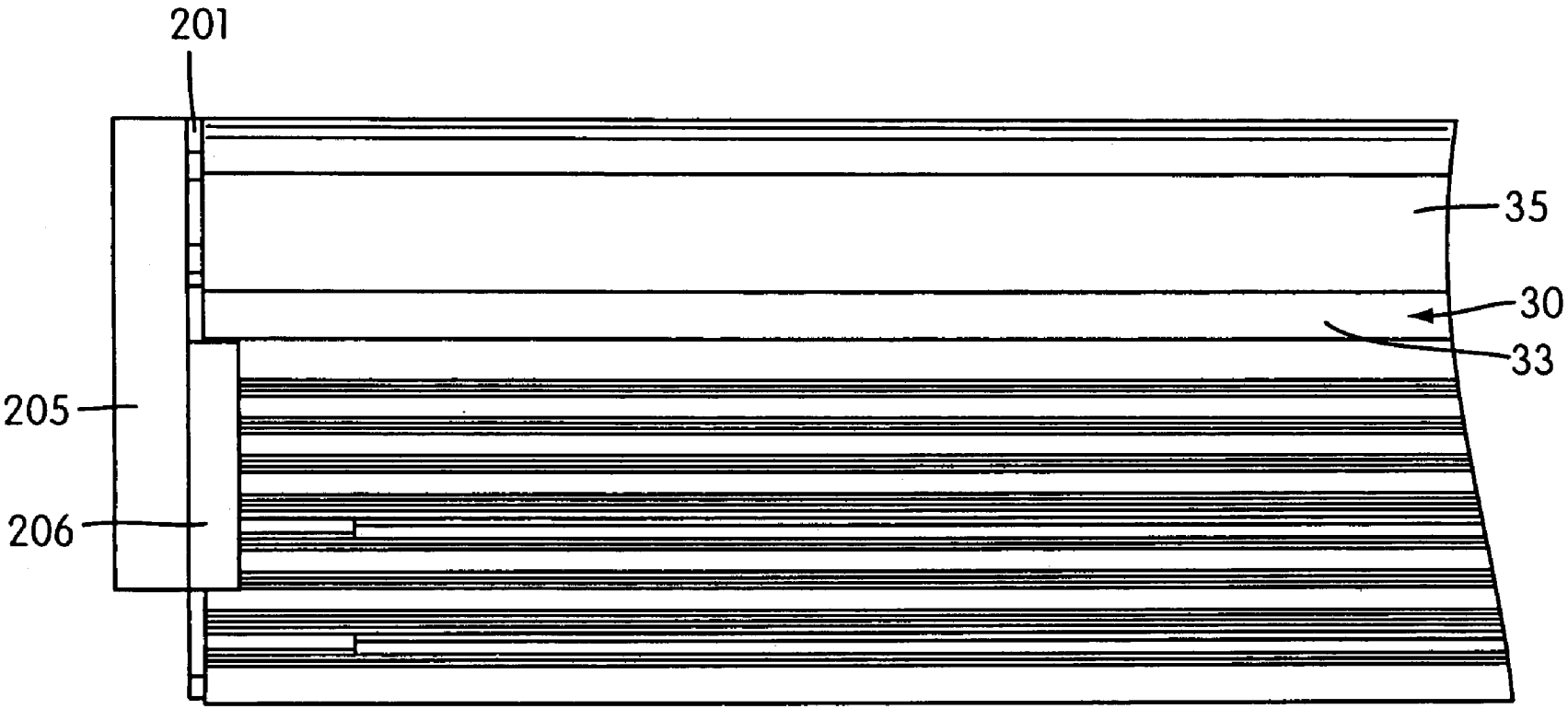
FIG. 42 is a top view of the corner key assembly secured to the high profile sill assembly.

As discussed above, the vertically extending jamb members of the door jamb assembly may be secured directly to the high profile sill assembly 10 by securing fasteners through the jamb member to the screw bosses 121, 152 and 184. In order to provide the assembler with ability to use other fasteners including but not limited to staples and nails, a corner key assembly 200 may be provided. The corner key assembly 200 in accordance with the present invention will be described in greater detail in connection with FIGS. 6 and 35-44. The corner key assembly 200 includes a vertical cap member 201, which is sized to cover the open end of the sill assembly 10, as shown in FIGS. 39-41. A plurality of projections 202, 203 and 204 extend from one side of the vertical cap member 201. The projections 202 and 203 are adapted to be received within the cavity 15, as shown in FIG. 6. Each projection 202 and 203 includes a rib 2021 and 2031, respectively, that is adapted to engage the rib 151. It is contemplated that one of the projections 202 and 203 may be eliminated. It is also contemplated that the projections 202 and 203 may be combined to form a single projection for use when the rib 11 has been omitted. The projection 204 is sized to received within the channel 16.

The corner key assembly 200 may be secured to the sill assembly 10 by inserting fasteners through openings 2011 and 2012 formed in the vertical cap member 201. The openings 2011 and 2012 are aligned with the screw bosses 152 and 184. An adhesive may also be applied to the projections 202, 203 and 204 to secure the corner assembly 200 to the sill assembly 10. The adhesive also serves to form a seal between the corner key assembly 200 and the sill assembly 10.

Figure 43:
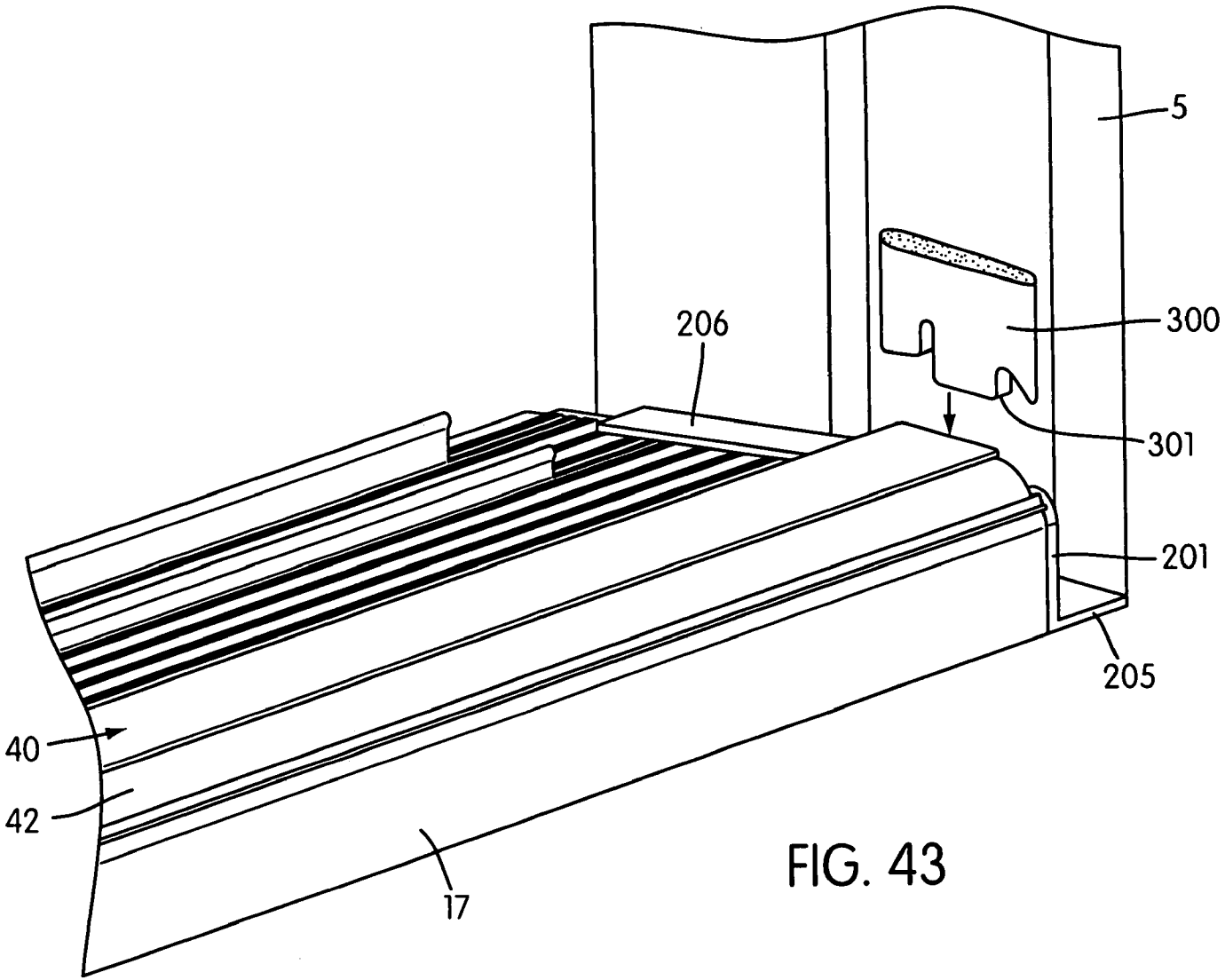
FIGS. 43 and 44 are partial schematic views illustrating the relationship between the corner key assembly and a corner pad in accordance with the present invention.

A first lateral projection 205 extends from a side of the vertical cap member 201 on a side opposite the projections 202, 203 and 204. The lateral projection 205 forms a base upon which the vertically extending jamb member rests, as shown in FIG. 43. The lateral projection 205 raises the jamb member to limit exposure to ground moisture and reduce rot. A second lateral projection 206 extends from an upper end of the vertical cap member 201 on the same side as the projections 202, 203 and 204. The second lateral projection 206 forms a seat for receive a tenon portion of the jamb member. The second lateral projection 206 raises the tenon above the upper surface 13 of the sill assembly 10 such that it is not in contact with any water that is draining off the upper surface 13. This arrangement further reduces exposure to moisture and enhances rot prevention. A seal assembly, not shown, may be located on the first lateral projection 205 and the second lateral projection 206.

Figure 44:
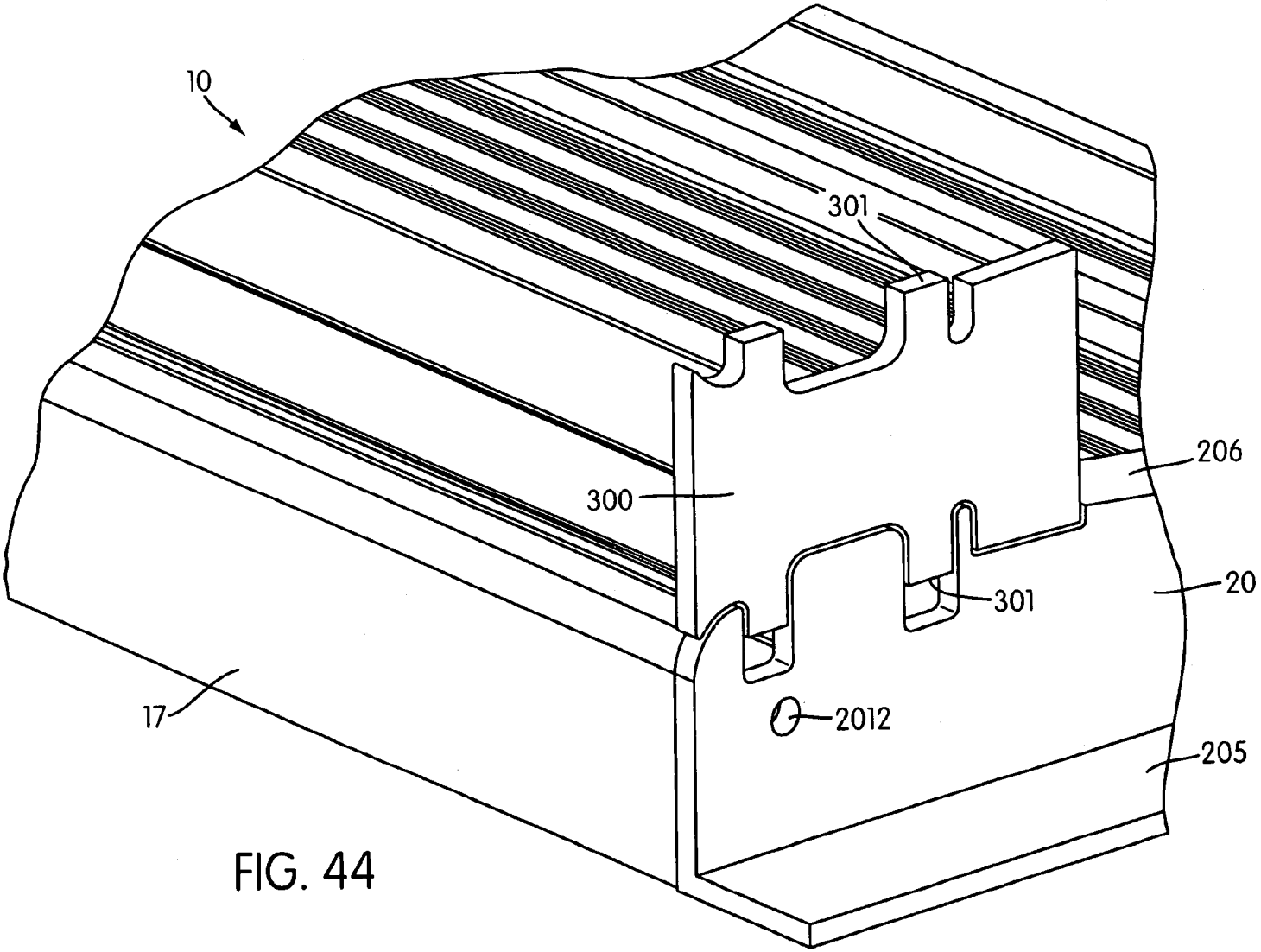

The vertical cap member 201 has a profile that substantially corresponds to the profile of the sill assembly 10, as shown in FIGS. 39, 40, 41, 43 and 44. The vertical cap member 201 also provides a slight clearance between the vertical jamb member and the sill assembly 10 as shown in FIG. 43. A corner pad seal assembly 300 is preferably located within this clearance, as shown in FIGS. 43 and 44. In known jamb assemblies, a corner pad is provided, but the corner pad extends partially over the rail. When an adjustable rail is provided, the corner pad can interfere with the adjustment of the rail and potentially separate from the jamb member. The clearance provided by the corner key assembly 200 in accordance with the present invention prevents this. The corner pad seal assembly 300 preferably includes a contoured end portion 301 that is complimentary with a portion of the vertical cap member 201, as shown in FIGS. 43 and 44.

An adjustable rail assembly 550 in accordance with a preferred embodiment of the present invention will now be described in connection with a high profile sill assembly 500, shown in FIGS. 55-62. The high profile sill assembly 500 includes an elongated sill 510. The elongated sill 510 is preferably extruded and formed from aluminum. The elongated sill 510 includes a leading edge portion 511, which extends upwardly from a first inwardly projecting flange 512. The leading edge portion 511 may include a screw boss 513 for securing the sill assembly 500 to the door jamb, described above, using a suitable fastener therein. An inclined top surface 514 extends rearwardly from the leading edge portion 511 to an upwardly extending lip structure 515. The upwardly extending lip structure 515 projects above the inclined top surface 514. The lip structure 515 also includes a lower portion 516 that extends downwardly below the inclined top surface 514. A second inwardly projecting flange 517 extends from one side of the lower portion 516 towards the first inwardly projecting flange 512. The top surface 514 along with the leading edge portion 511, the flanges 512 and 517 and the lower portion 516 together form a cavity 518.

A sill base substrate 520 is located within the cavity 518. The base substrate 520 is provided to increase the rigidity of the elongated sill 510. The base substrate 520 also serves as a means for attaching the sill 500 to the doorjamb assembly 1. The jamb members 2 may be secured directly to the base substrate 520. It is contemplated that numerous materials may be used to form the base substrate 520 including but not limited to wood, wood flour composites and plastic.

Figure 57:
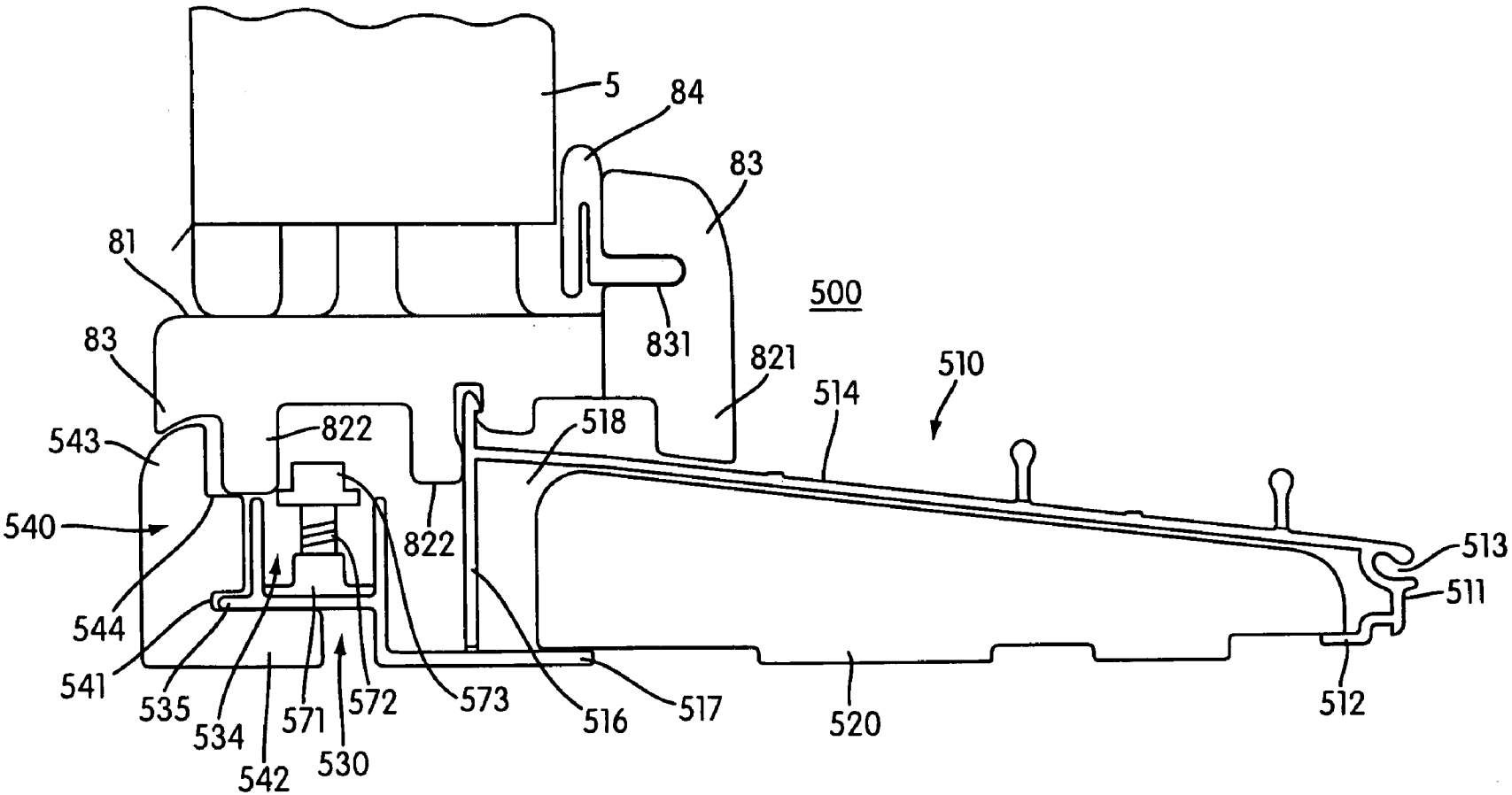
FIG. 57 is a side view of the high profile sill assembly of FIG. 55 having an outswing rail assembly supported thereon.

A rail receiving structure 530 is integrally formed in the elongated sill 510 and is sized to receive an adjustable rail assembly 550, described below. The rail receiving structure 530 includes a pair of upstanding ribs 531 and 532, which extend the length of the sill assembly 510. One rib 531 is spaced from the lip structure 515 and lower portion 516, which together form an elongated channel 533, which extends the length of the sill assembly 510. Rib 532 is spaced from the rib 531 such that a longitudinally extending channel 534 is formed therebetween. Like the channel 533, the channel 534 extends the length of the sill assembly 510. The rail receiving structure 530 includes a rearwardly extending flange 535. The flange 535 extends the length of the sill assembly 510. The flange 535 is sized to be received within a slot 541 in a trim piece 540. As shown in FIG. 57, the rib 532 may include a screw boss 537 for securing the sill assembly 500 to the doorjamb.

Figure 55:
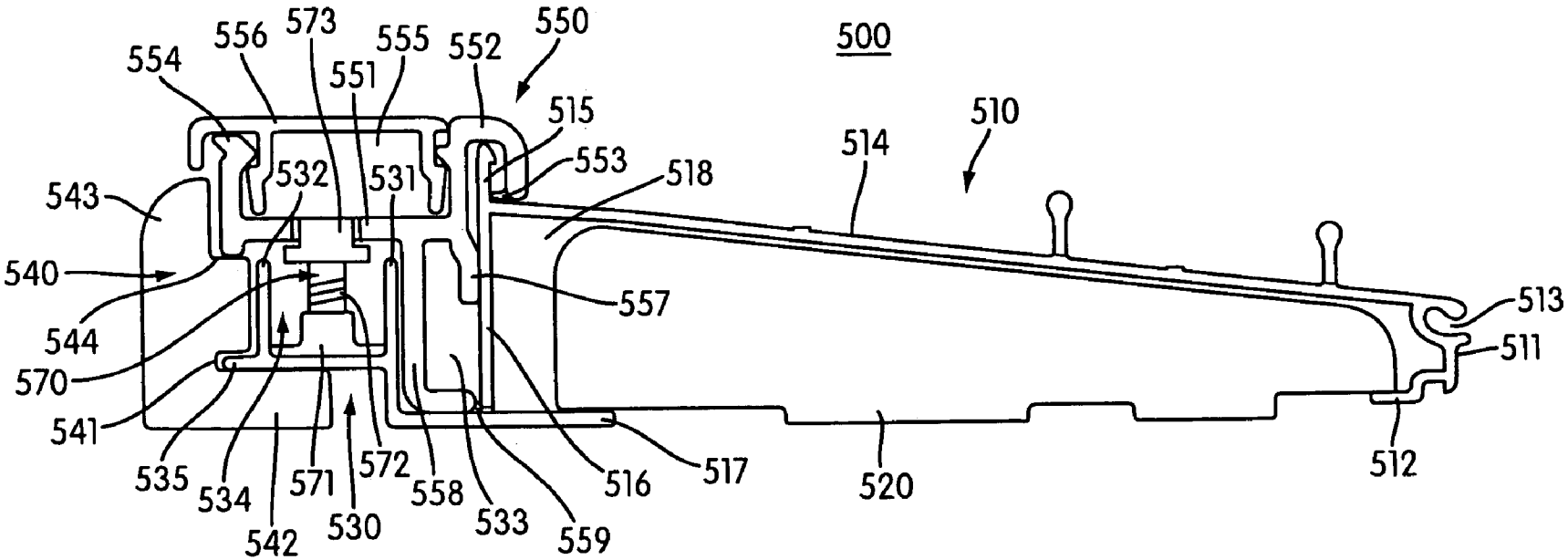
FIG. 55 is a side view of a high profile sill assembly in accordance with a preferred embodiment of the present invention having an adjuster assembly integrated into the sill assembly for adjusting the height of a rail assembly positioned overhead.

The trim piece 540 forms the rear end of the sill assembly 500. The trim piece 540 is preferably formed from a wood, a wood flour composite or a plastic material. The trim piece 540 forms thermal break for the sill assembly 500. The thermal break is provided to limit or reduce the temperature transfer through the high profile sill assembly 500, which is especially necessary in cooler climates. As shown in FIGS. 55-62, a lower portion 542 of the trim piece 540 extends below and supports a portion of the rail receiving structure 530. An upper portion 543 of the trim piece 540 extends upwardly adjacent the rib 532. The upper portion 543 has an upper contour that sized to support various components including but not limited to the outswing rail assembly 80, the side panel support 90 and the mullion boot assembly 100, described above. The trim piece 540 further includes a ledge 544 sized to receive thereon a portion of the adjustable rail assembly 550, as shown in FIG. 55, when the rail assembly 550 is in a lowermost position, a portion 822 of the outswing rail assembly 80, as shown in FIG. 57, a portion 642 of the French fixed rail assembly 60, shown in FIG. 58, or a sidelite spacer support 90, shown in FIG. 59. The flange 535 may include a ridge or bump 536 on a surface thereof, as shown in FIG. 57. The bump 536 provides a friction fit with the slot 541 such that the trim piece 540 may be snap-fit onto the rail receiving structure 530 of the sill assembly 500.

The rail assembly 550 in accordance with a preferred embodiment of the present invention will now be described in greater detail. The rail assembly 550 is secured to the sill assembly 500 to close or eliminate any gap between the sill assembly 500 and the bottom of the door 5. The rail assembly 550 is preferably formed from an extruded material (e.g. plastic). The rail assembly 550 includes a generally horizontal base portion 551. The base portion 551 is sized such that it extends from the lip structure 515 and lower portion 516 to the trim piece 540. One end of the base portion 551 is received on the ledge 544 when the rail assembly 550 is in a lowermost position, as shown in FIG. 55.

The rail assembly 550 includes a forward lip portion 552 that extends upwardly from one edge of the base portion 551. The lip portion 552 is sized to extend over the lip structure 515. A rearward lip portion 554 extends upwardly from an opposite edge of the base portion 551. A free end of the lip portion 552 includes a flexible flange 553. The flange 553 is adapted to engage the lip structure 515 to provide a watertight seal between the sill assembly 510 and the rail assembly 550. The flexible flange 553 is integrally formed on the free end during an extrusion process such that the flexible flange 553 has a lower durometer than that of the remaining portion of the lip portion 552. The lip portions 552 and 554 are spaced apart to form a channel therebetween 555. A cap or cover member 556 similar to cover member 35 is provided to cover the channel 555. The cover member 556 hides and covers a plurality of apertures 560 formed in the base member 551. The apertures 560 provide access to the adjuster assemblies 570 on the rail receiving structure 530. The apertures 560 may be either drilled or predrilled to correspond to the location of the adjuster assemblies 570. The cover member 556 may run the full length of the rail assembly 550 and provides a clean surface without disruptions for the door sweep to seal against. The cover member 556 is snap fit onto the lip portions 552 and 554.

Figure 56:
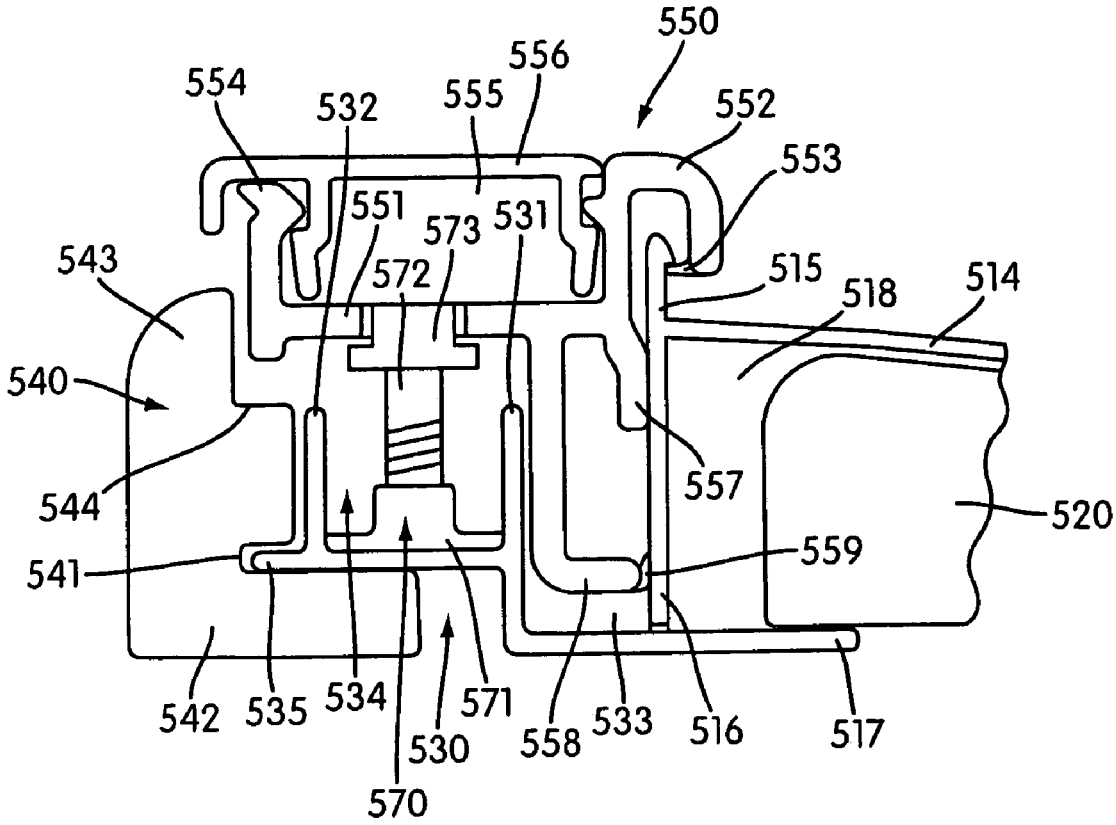
FIG. 56 is a partial side view of the high profile sill assembly of FIG. 55 illustrating the adjuster assembly in a raised position to raise the height of the rail assembly with respect to the high profile sill assembly.

The base member 551 includes a plurality of downwardly extending ribs that are sized to be received within the channel 533, as shown in FIGS. 55 and 56. The ribs locate and stabilize the rail assembly 550 within the channel 533. A first rib 557 extends downwardly from an edge of the base member 551 adjacent the lip structure 515 and the lower portion 516. A second rib 558 is laterally spaced from the first rib 557. Both ribs 557 and 558 are sized to extend into the channel 533. The second rib 558 extends a greater distance than the first rib 557 such that a lower portion of the rib 558 rests on a bottom surface of the channel 533 when the rail assembly 550 is in a lowermost position, as shown in FIGS. 55 and 56. A flexible flange 559 is integrally formed on a free end of the rib 558.

Figure 58:
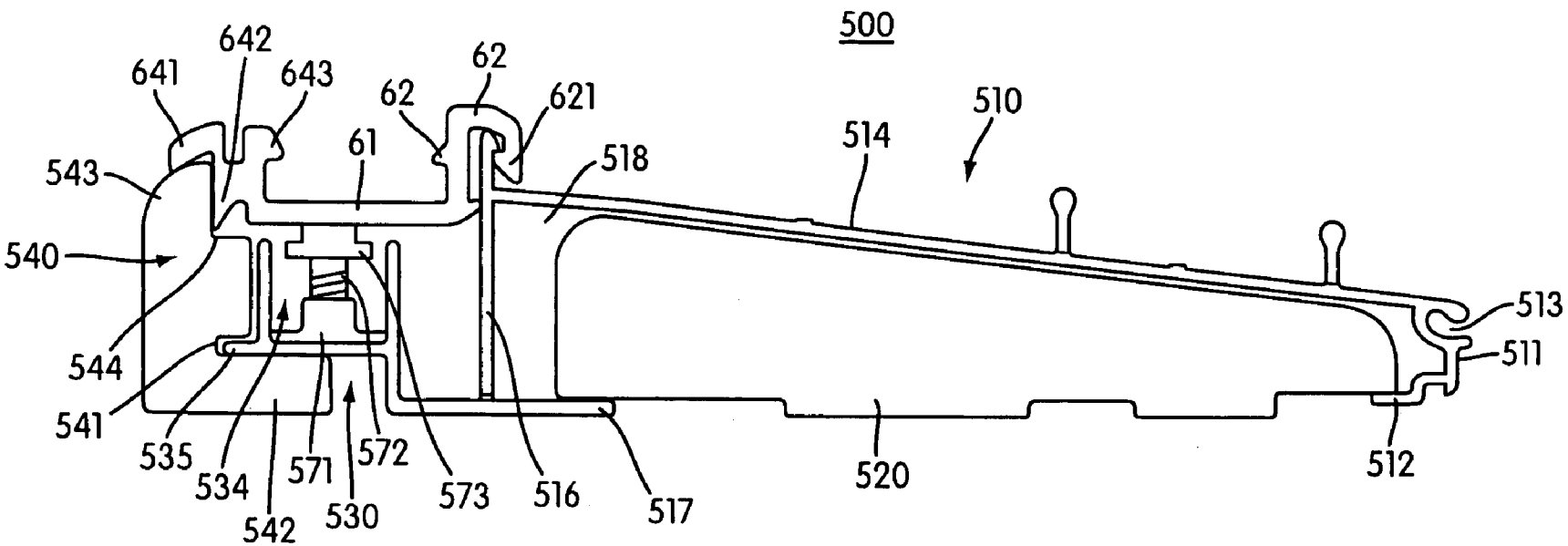
FIG. 58 is a side view of the high profile sill assembly of FIG. 55 having a French fixed rail assembly supported thereon.
Figure 59:
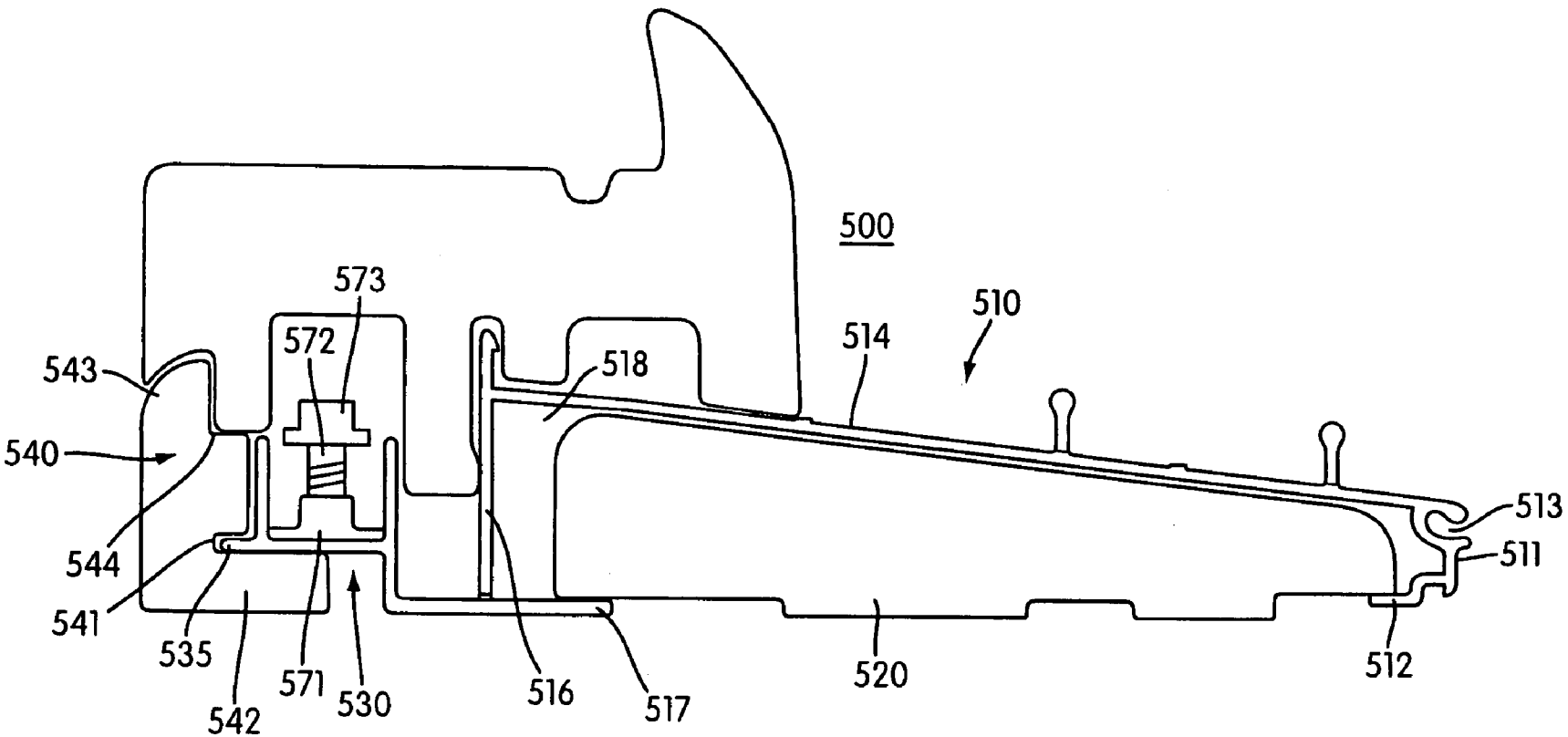
FIG. 59 is a side view of the high profile sill assembly of FIG. 55 having a sidelite spacer supported thereon.
Figure 60:
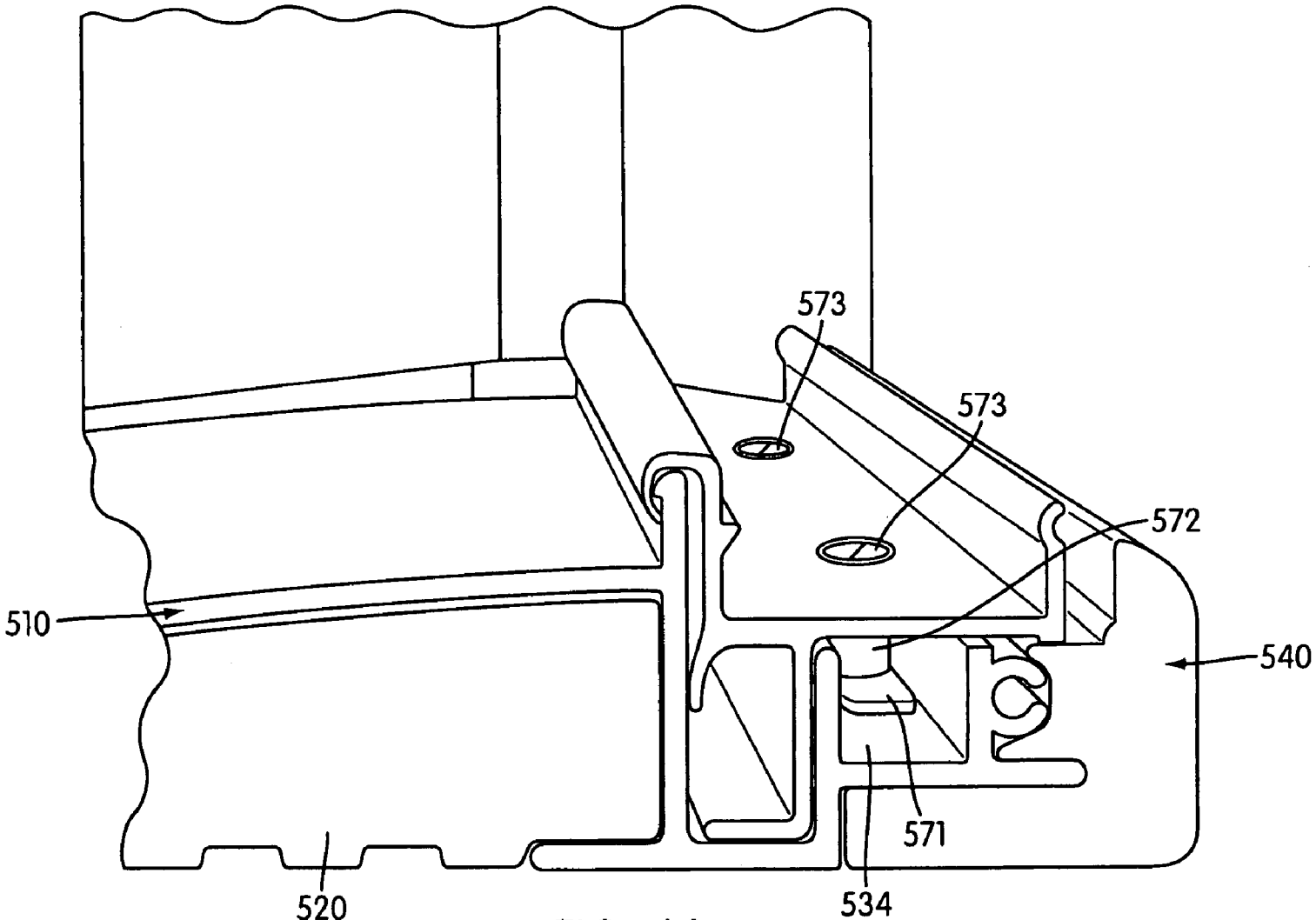
FIG. 60 is a photograph of a side of a partial section of the high profile sill assembly of FIG. 55 having an adjustable height rail assembly supported thereon.
Figure 61:
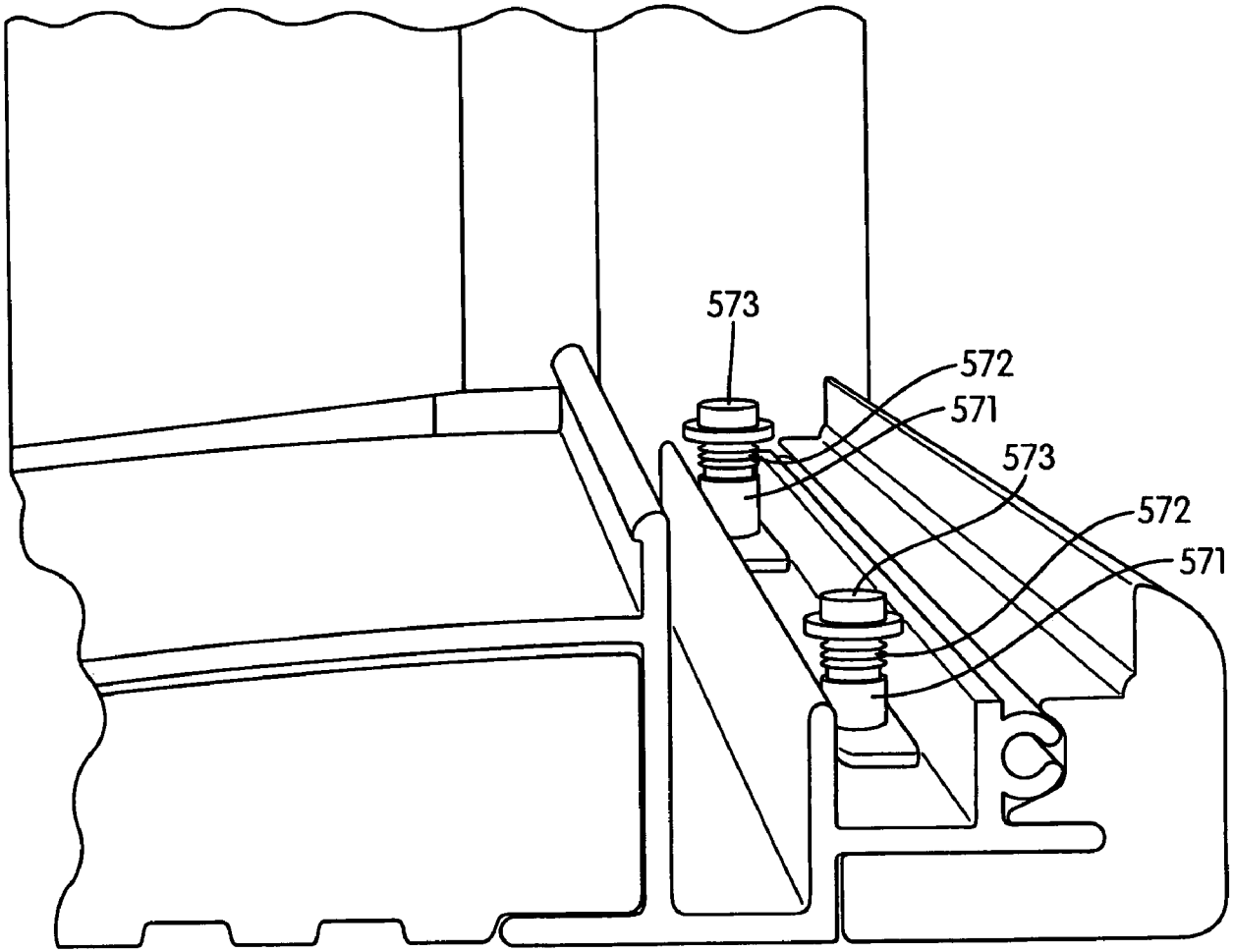
FIG. 61 is a photograph of the side partial section of the high profile sill assembly of FIG. 60 illustrating the positioning of the adjuster assemblies within the sill assembly.
Figure 62:
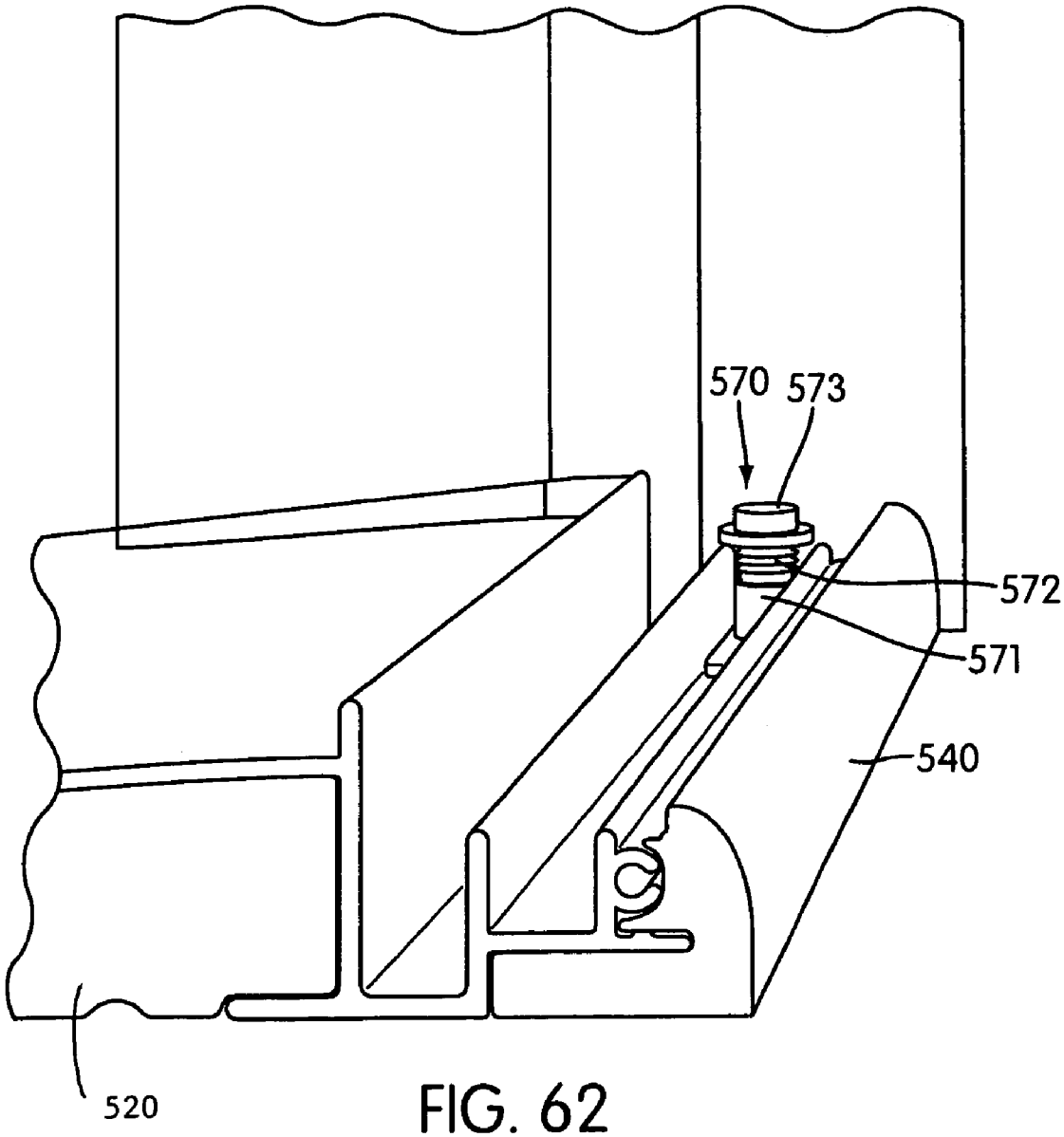
FIG. 62 is another photograph of the side partial section of the high profile sill assembly of FIG. 60 illustrating the positioning of the adjuster assemblies within the sill assembly.

It is desirable for the height of the rail member 550 be adjustable to ensure a good seal with the sweep on the bottom of the door 5. Adjuster assemblies 570 are provided to permit adjustment of the height of the rail assembly 550 with respect to the sill assembly 500. A plurality of adjuster assemblies 570 are integrated into the channel 534 in the rail receiving structure 530. The adjuster assemblies 570 are located in spaced intervals along the entire length of the channel 534 such that the adjuster assemblies 570 are positioned under both adjustable components, as shown in FIGS. 55 and 56, and fixed components, as shown in FIGS. 57-59.

Each adjuster assembly 570 includes a base 571, which is positioned and secured to the channel 534. Each base 571 is secured by a plurality of burrs, which extend from the sides of the base 571. It is also contemplated such that the base 571 may be secured to the channel 534 by welding or using a suitable fastener. An adjuster element 572 is threadably secured to the base 571. The adjuster element 572 includes a head 573 that is received within the aperture 560, as shown in FIGS. 55 and 56. A lower portion of the head 573 includes a flange 574 that is sized to engage an undersurface of the base portion 551 of the adjustable rail 550. The flange 574 contacts the base portion 551 to raise and lower the rail 550 to the desired height.

Adjustment of the rail height is a simple operation. The door installer or the homeowner can adjust the rail assembly 550 by removing cover member 556. A screw driver or suitable tool is used to adjust each of the individual adjuster assemblies 570 to a desired height. After the adjustment, the cover member 556 is then resecured in place.

The high profile sill assembly 500 and in particular the sill assembly 510, the rail retaining portion 530 and the adjuster assemblies 570 are configured such that the sill assembly 500 can be used to produce numerous door configurations. The same sill can be used to entryways with fixed panels, sidelites, french doors, fixed doors, etc. Sufficient clearance is provided when the adjuster assemblies 570 are in their lowermost position such that the adjuster assemblies 570 do not interfere with any fixed components secured to sill assembly, as shown in FIGS. 57-59.

An adjustable rail assembly 650 in accordance with a preferred embodiment of the present invention will now be described in connection with a high profile sill assembly 600, shown in FIGS. 63-67. The high profile sill assembly 600 includes an elongated sill 610. The elongated sill 610 is preferably extruded and formed from aluminum. The elongated sill 610 includes a leading edge portion 611, which extends upwardly from a first inwardly projecting flange 612. The leading edge portion 611 may include a screw boss 613 for securing the sill assembly 600 to the doorjamb, described above, using a suitable fastener therein. An inclined top surface 614 extends rearwardly from the leading edge portion 611 to an upwardly extending lip structure 615. The upwardly extending lip structure 615 projects above the inclined top surface 614. The lip structure 615 also includes a lower portion 616 that extends downwardly below the inclined top surface 614. A second inwardly projecting flange 617 extends from one side of the lower portion 616 towards the first inwardly projecting flange 612. The top surface 614 along with the leading edge portion 611, the flanges 612 and 617 and the lower portion 616 together form a cavity 618.

A sill base substrate 620 is located within the cavity 618. The base substrate 620 is provided to increase the rigidity of the elongated sill 610. The base substrate 620 also serves as a means for attaching the sill 600 to the doorjamb assembly 1. The jamb members 2 may be secured directly to the base substrate 620. It is contemplated that numerous materials may be used to form the base substrate 620 including but not limited to wood, wood flour composites and plastic.

Figure 65:
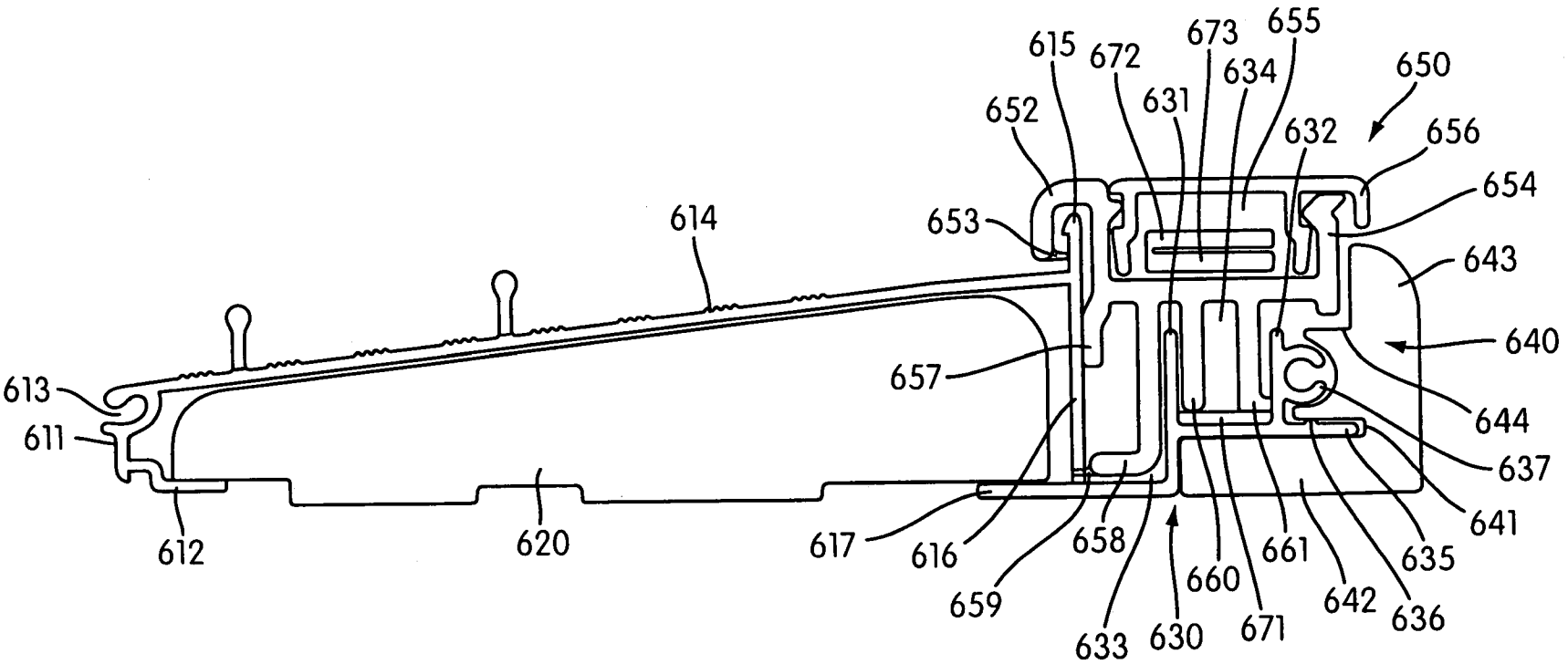
FIG. 65 is a side view of a variation of the high profile sill assembly and adjustable height rail assembly of FIG. 63, wherein a single spacer component of the adjustable spacer assembly is in an installed position.

A rail receiving structure 630 is integrally formed in the elongated sill 510 and is sized to receive an adjustable rail assembly 650, described below. The rail receiving structure 630 includes a pair of upstanding ribs 631 and 632, which extend the length of the sill assembly 610. One rib 631 is spaced from the lip structure 615 and lower portion 616, which together form an elongated channel 633, which extends the length of the sill assembly 610. Rib 632 is spaced from the rib 631 such that a longitudinally extending channel 634 is formed therebetween. Like the channel 633, the channel 634 extends the length of the sill assembly 610. The rail receiving structure 630 includes a rearwardly extending flange 635. The flange 635 extends the length of the sill assembly 610. The flange 635 is sized to be received within a slot 641 in a trim piece 640. As shown in FIG. 65, the rib 632 may include a screw boss 637 for securing the sill assembly 600 to the door jamb.

Figure 63:
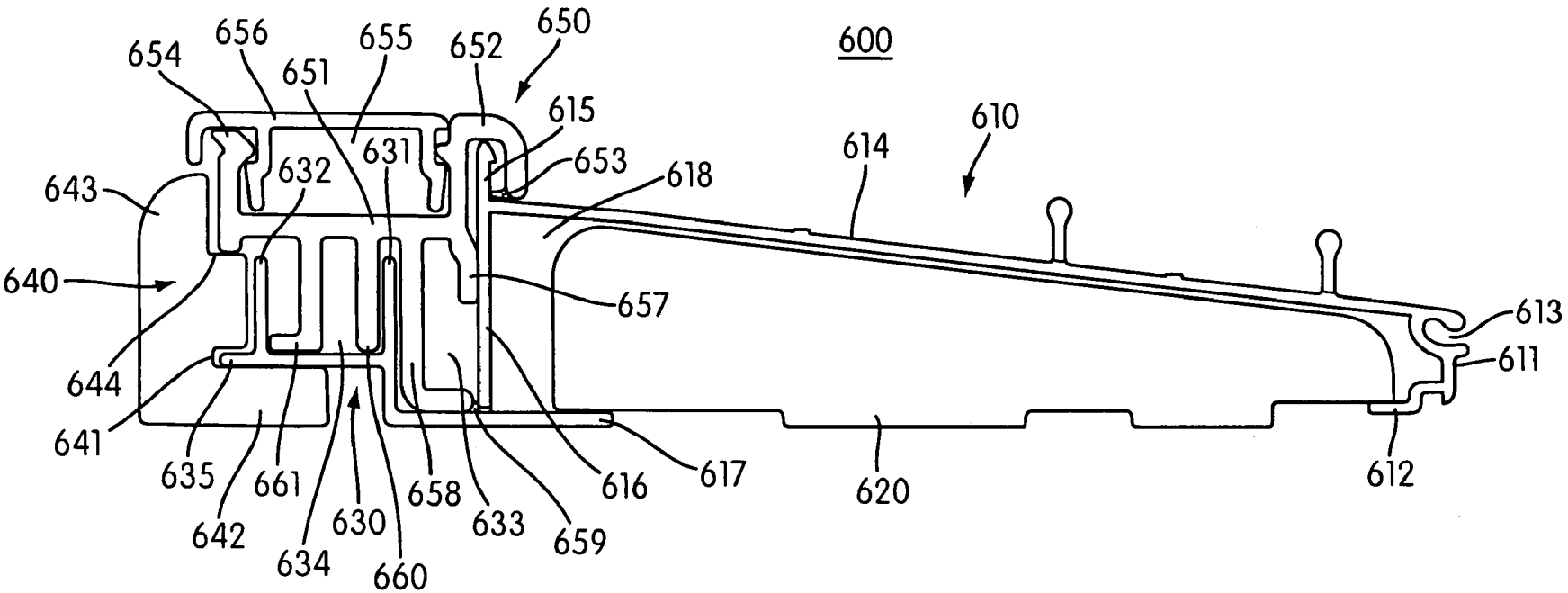
FIG. 63 is a side view of a high profile sill assembly having an adjustable height rail assembly with an adjustable spacer assembly according to a preferred embodiment of the present invention.
Figure 64:
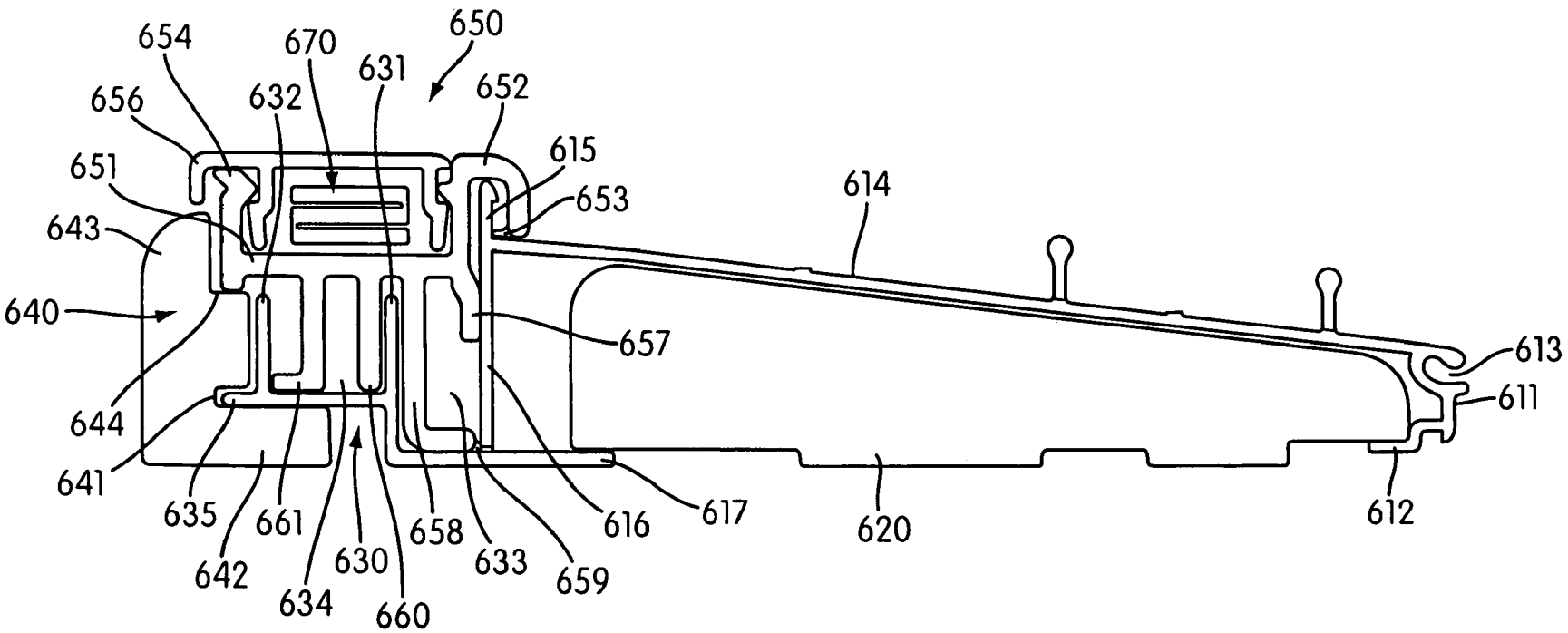
FIG. 64 is a side view of the high profile sill assembly of FIG. 63 wherein the adjustable spacer assembly is in a stored position.
Figure 66:
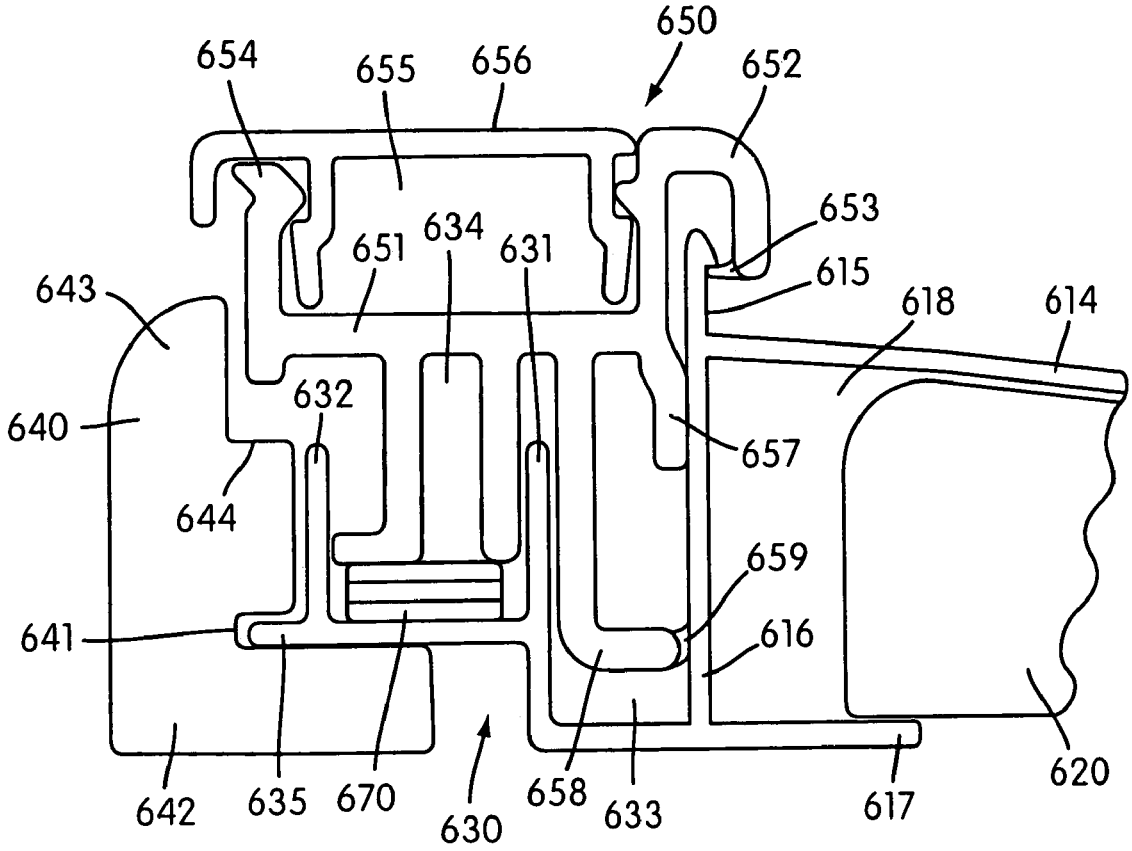
FIG. 66 is a side view of the high profile sill assembly of FIG. 63 wherein three spacer components of the spacer assembly are in an installed position.

The trim piece 640 forms the rear end of the sill assembly 600. The trim piece 640 is preferably formed from a wood, a wood flour composite or a plastic material. The trim piece 640 forms thermal break for the sill assembly 600. The thermal break is provided to limit or reduce the temperature transfer through the high profile sill assembly 600, which is especially necessary in cooler climates. As shown in FIGS. 63-66, a lower portion 642 of the trim piece 640 extends below and supports a portion of the rail receiving structure 630. An upper portion 643 of the trim piece 640 extends upwardly adjacent the rib 632. The trim piece 640 further includes a ledge 644 sized to receive thereon a portion of the rail assembly 650, as shown in FIGS. 63 and 64, when the rail assembly 650 is in a lowermost position. When the spacer assembly 670 is installed, the rail assembly 630 is spaced from the ledge 644, as shown in FIGS. 65 and 66. The upper portion 643 has an upper contour that sized to support various components including but not limited to the outswing rail assembly 80, the side panel support 90 and the mullion boot assembly 100, described above.

The flange 635 may include a ridge or bump 636 on a surface thereof, as shown in FIG. 65. The bump 636 provides a friction fit with the slot 641 such that the trim piece 640 may be snap-fit onto the rail receiving structure 630 of the sill assembly 600.

The rail assembly 650 in accordance with another embodiment of the present invention will now be described in greater detail. The rail assembly 650 is secured to the sill assembly 600 to close or eliminate any gap between the sill assembly 600 and the bottom of the door 5. The rail assembly 650 is preferably formed from an extruded material (e.g. plastic). The rail assembly 650 includes a generally horizontal base portion 651. The base portion 651 is sized such that it extends from the lip structure 615 and lower portion 616 to the trim piece 640. One end of the base portion 651 is received on the ledge 644 when the rail assembly 650 is in a lowermost position, as shown in FIGS. 63 and 64.

The rail assembly 650 includes a forward lip portion 652 that extends upwardly from one edge of the base portion 651. The lip portion 652 is sized to extend over the lip structure 615. A rearward lip portion 654 extends upwardly from an opposite edge of the base portion 651. A free end of the lip portion 652 includes a flexible flange 653. The flange 653 is adapted to engage the lip structure 615 to provide a watertight seal between the sill assembly 610 and the rail assembly 650. The flexible flange 653 is integrally formed on the free end during an extrusion process such that the flexible flange 653 has a lower durometer than that of the remaining portion of the lip portion 652. The lip portions 652 and 654 are spaced apart to form a channel therebetween 655. A cap or cover member 656 similar to cover member 35 is provided to cover the channel 655. The cover member 656 hides the uninstalled spacer components 670, as shown in FIGS. 64 and 65. The cover member 656 may run the full length of the rail assembly 650 and provides a clean surface without disruptions for the door sweep to seal against. The cover member 656 is snap fit onto the lip portions 652 and 654.

The base member 651 includes a plurality of downwardly extending ribs that are sized to be received within the channels 633 and 634, as shown in FIGS. 63-65. The ribs locate and stabilize the rail assembly 650 within the channels 633 and 634. A first rib 657 extends downwardly from an edge of the base member 651 adjacent the lip structure 615 and the lower portion 616. A second rib 658 is laterally spaced from the first rib 657. Both ribs 657 and 658 are sized to extend into the channel 633. The second rib 658 extends a greater distance than the first rib 657 such that a lower portion of the rib 658 rests on a bottom surface of the channel 633 when the rail assembly 650 is in a lowermost position, as shown in FIGS. 63 and 64. A flexible flange 659 is integrally formed on a free end of the rib 658. Third and fourth ribs 660 and 661 are spaced from the rib 658. The ribs 660 and 661 are adapted to be received within the channel 634. A lower portion of the ribs 660 and 661 rests on a bottom surface of the channel 634 when the rail assembly 650 is in a lowermost position.

It is desirable for the height of the rail member 650 be adjustable to ensure a good seal with the sweep on the bottom of the door 5. A spacer assembly 670 is provided to permit adjustment of the height of the rail assembly 650 with respect to the sill assembly 610. The spacer assembly 670 includes a set of spacers 671, 672 and 673 which may be formed as a single component as shown in FIG. 67.

The spacers 671, 672 and 673 are preferably formed from plastic. The present invention, however, is not limited to the use of plastic, other materials including metal, wood and wood flour composites are considered to be well within the scope of the present invention. Each spacer 671, 672 and 673 is sized to extend the length of the channel 634 and extend between the ribs 631 and 632 such that when one or more of the spacers is located within the channel 634, the lower ends of the ribs 660 and 661 rest on the tope most spacer, as shown in FIGS. 65 and 66. The spacers 671, 672 or 673 uniformly support the rail assembly 650 along the entire length of the rail assembly 650. This helps the stiffness of the adjusted sill. While the present invention has been described with three spacers 671, 672 and 673, the present invention is not so limited additional spacers may be provided. Less than three spacers are also contemplated.

The spacers 671, 672 and 673 are preferably formed as a single extruded or machined piece having areas of reduced thickness 673 and 674 formed therebetween. The areas 673 and 674 function as hinges such that spacers 671, 672 and/or 673 may be folded such for compact storage, as shown in FIGS. 64 and 65. The spacers are preferably stored in the channel 655 of the adjustable rail assembly 650 when not in use. The cover member 656 covers the channel 655 and prevents removal of the unused spacers.

Figure 67:
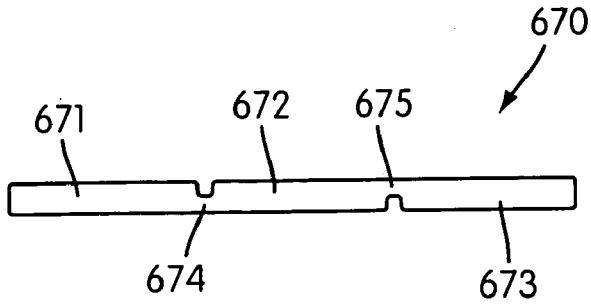
FIG. 67 is a side view of the adjustable spacer assembly.

As shown in FIG. 67, each spacer 671, 672 and 673 has the same thickness. The spacers may have a thickness of 1/32", 1/16" or larger. It is also contemplated that the spacers may have different thickness such that one spacer may have a thickness of 1/32", another spacer may have a thickness of 3/32", and a third spacer may have a thickness of 5/32", which may increase the increments in the adjusting range. The spacers are sized such that an individual spacer may be cut to a desired length. This is especially useful when the door 5 is not square and it is desirable to raise only a portion of the rail assembly 650 to provide a good seal with the door 5.

Adjustment of the rail height is a simple operation and requires no tools. The door installer or the homeowner can adjust the rail assembly 650 by removing cover member 656. The spacer assembly 670 is removed from the channel 655. The rail assembly 650 is removed from the sill assembly 510 and the rail receiving structure 630. One of the spacers 671, 672 or 673 is separated from the remaining spacers and inserted in the channel 634 such that the spacer 671 rests on the bottom surface of the channel 634. The rail assembly 650 is then resecured to the sill assembly 610 and the rail receiving structure 630. The door 5 is then closed to determine whether or not the adjustment of the height of the rail 650 was sufficient. If the height adjustment is sufficient, the remaining spacers 672 and 673 may be relocated in the channel 655. The cover member 656 is then secured in place. If the height adjustment is insufficient, one or more spacers may be added to increase the height of the rail assembly 650 with respect to the sill assembly 610. When the desired height is achieved, the remaining spacers, if any, are located within the channel 655 and the cover member 656 is secured in place.

The spacer assembly 670 permits even adjustment of the rail assembly 650, which results in improved performance because the rail assembly 650 remains straight. The spacer assembly 670 is advantageous over other designs involving screws because no tools are required to perform the adjustment operation and striped or broken screws are not of concern.

When a door is not square, one or more of the spacers may be cut to a desired length to raise only a portion of the rail assembly 650. In this manner, the entire length of one or more of the spacers may be utilized with a portion of another spacer.

It will be appreciated that numerous modifications to and departures from the preferred embodiments described above will occur to those having skill in the art. The components described herein may be used with high profile sill assemblies and low profile sill assemblies, which reduces the number of unique components required to produce differ jamb assemblies. Unlike conventional sill assembly components, an assembler utilizing various components of the present invention can produce an outswing, a french or double, or a fixed inswing door unit by simply substituting different rails. Furthermore, the same sill assemblies can be used by adding additional components to create fixed side panels, double doors and various other combinations without modification of the sill assembly. Thus, it is intended that the present invention covers the modifications and variations of the invention, provided they come within the scope of the appended claims and their equivalents.

What is claimed is:

1. An adjustable threshold and door sill assembly, comprising:

an elongated sill assembly having a length, wherein the elongated sill assembly includes at least one elongated channel extending substantially the length of the elongated sill assembly, wherein the elongated sill assembly includes an upwardly extending lip structure positioned adjacent one of the at least one elongated channel;

an elongated rail assembly extending at least a portion of the length of the elongated sill assembly, wherein a portion of the elongated rail assembly is received within the at least one elongated channel, wherein the elongated rail assembly includes a leading portion of the elongated rail assembly that engages the upwardly extending lip structure;

a plurality of adjuster assemblies fixedly secured within one of the at least one channel for adjusting the vertical position of the elongated rail assembly with respect to the elongated sill assembly; and at least one fixed component secured to elongated sill assembly to position at least one of the plurality of adjuster assemblies beneath the at least one fixed component.

2. The adjustable threshold and door sill assembly according to claim 1, wherein each of the plurality of adjuster assemblies includes a base member secured to the channel and an adjustment member adjustably secured to the base member.

3. The adjustable threshold and door sill assembly according to claim 1, wherein the plurality of adjuster assemblies are spaced along the entire length of the channel.

4. A modular exterior threshold and door sill assembly for an entryway, wherein the entryway includes a pair of vertically extending jamb members, a header structure and at least one door, comprising:

an elongated sill assembly connected at opposing ends to the pair of vertically extending jamb members, wherein the elongated sill assembly includes a longitudinally extending sill base having a leading edge and a trailing edge, an upwardly extending portion extending from the trailing edge of the sill base, and an upwardly extending lip structure extending from the sill base, wherein the upwardly extending lip structure is laterally spaced from the upwardly extending portion, wherein the upwardly extending lip structure, the upwardly extending lip structure and an interconnecting portion of the sill base form an elongated channel;

an elongated rail assembly extending at least a portion of the length of the elongated sill assembly, wherein a portion of the elongated rail assembly is received within the elongated channel, a leading portion of the elongated rail assembly engages the upwardly extending lip structure, and a trailing portion of the elongated rail assembly contacts a free end of the upwardly extending portion, wherein the elongated rail assembly is selectively positioned within the elongated channel; and at least one sill component connected to one of the elongated rail assembly and the elongated channel, wherein the at least one sill component includes at least one of a cover assembly, an astragal bolt receiver assembly, a mullion boot assembly, and a side panel spacer assembly.

5. The modular exterior threshold and door sill assembly according to claim 4, wherein the elongated rail assembly includes an elongated rail channel formed in an upper surface thereof.

6. The modular exterior threshold and door sill assembly according to claim 5, wherein the at least one sill component includes one of a cover assembly and an astragal bolt receiver assembly positioned within the elongated rail channel.

7. The modular exterior threshold and door sill assembly according to claim 6, wherein an astragal bolt receiver assembly is positioned within the elongated rail channel, wherein the astragal bolt receiver assembly comprises:

a body, wherein the body includes a forward portion sized to extend over the leading portion of the elongated rail assembly;

a bolt receiving aperture formed in the body; and a least one fastening assembly connected to the body for releasably and adjustably securing the body within the elongated rail channel.

8. The modular exterior threshold and door sill assembly according to claim 7, further comprising at least one cover assembly positioned within the elongated rail channel, wherein the cover assembly covers the at least one fastening assembly.

9. The modular exterior threshold and door sill assembly according to claim 4, wherein the entryway includes at least one mullion located between the jamb members and at least one fixed panel positioned between one mullion and one of the jamb members, wherein the at least one sill component includes a mullion boot assembly connected each of the mullions, wherein the mullion boot assembly is received within the elongated channel.

10. The modular exterior threshold and door sill assembly according to claim 9, wherein the at least one sill component further includes a side panel spacer assembly, wherein the side panel spacer assembly is adapted to be the at least one fixed panel, wherein the side panel spacer assembly is received within the elongated channel, wherein the side panel spacer assembly is received within the elongated channel adjacent the mullion boot assembly.

11. The modular exterior threshold and door sill assembly according to claim 10, wherein the elongated rail assembly is an adjustable height rail assembly.

12. The modular exterior threshold and door sill assembly according to claim 11, wherein the elongated rail assembly is a fixed rail assembly.

13. The modular exterior threshold and door sill assembly according to claim 4, wherein the elongated sill assembly is a low profile sill assembly.

14. The modular exterior threshold and door sill assembly according to claim 13, wherein the elongated rail assembly is a fixed rail assembly.

15. The modular exterior threshold and door sill assembly according to claim 4, wherein the elongated sill assembly is a high profile sill assembly.

16. The modular exterior threshold and door sill assembly according to claim 15, wherein the elongated sill assembly further includes an enclosed cavity formed therein, wherein the cavity is positioned on a side of the lip structure opposite the elongated channel.

17. The modular exterior threshold and door sill assembly according to claim 16, further comprising: at least one drainage port formed in the lip structure to permit the drainage of moisture from the elongated channel to the cavity.

18. The modular exterior threshold and door sill assembly according to claim 16, wherein the sill assembly further includes at least one drainage port to permit the drainage of moisture from the cavity to an exterior of the sill assembly.

19. The modular exterior threshold and door sill assembly according to claim 16, further comprising:

a pair of corner key assemblies, one corner key assembly being secured to one end of the sill assembly, another corner key assembly being secured to an opposite end of the sill assembly, wherein the corner key assemblies are sized to enclose the opposing ends of the sill assembly.

20. The modular exterior threshold and door sill assembly according to claim 19, wherein each corner key assembly comprising:

a vertical cap member sized to cover the end of the sill assembly;

at least one mounting projection extending from one side of vertical cap member, wherein the at least one mounting projection is sized to be received within one of the elongated channel and the cavity in the sill assembly.

21. The modular exterior threshold and door sill assembly according to claim 20, wherein each corner key assembly further comprising:

a first mounting extension extending from a side of the vertical cap member opposite the at least one mounting projection, wherein the mounting extension is sized to receive at least a portion of the vertical jamb member thereon.

22. The modular exterior threshold and door sill assembly according to claim 21, wherein each corner key assembly further comprising:

a second mounting extension extending from the same side of the vertical cap member as the at least one mounting projection, wherein the second mounting projection is sized to receive at least a portion of the vertical jamb member thereon.

23. The modular exterior threshold and door sill assembly according to claim 22, wherein the second mounting extension is vertically spaced above an upper surface of the high profile sill assembly.

24. The modular exterior threshold and door sill assembly according to claim 20, wherein the vertical cap member forms a space between the vertical jamb member and the sill assembly, wherein a corner pad is positioned within the space.

25. The modular exterior threshold and door sill assembly according to claim 24, wherein the corner pad is configured to conform to the exterior profile of at least a portion of the vertical cap member.

26. The modular exterior threshold and door sill assembly according to claim 15, wherein the elongated rail assembly is an adjustable height rail assembly.

27. The modular exterior threshold and door sill assembly according to claim 26, wherein the adjustable height rail assembly comprises:

an elongated rail received within the elongated channel, wherein the elongated rail having a downwardly extending portion adapted to contact the sill base when the elongated rail is a lowermost position; and an adjustment mechanism for raising and lowering the positioning of the elongated rail.

28. The modular exterior threshold and door sill assembly according to claim 27, wherein the adjustment mechanism comprising:

at least one adjustment bracket selectively positioned within the elongated channel; and at least one adjustment cam operatively connected to the at least one adjustment bracket.

29. The modular exterior threshold and door sill assembly according to claim 27, wherein the adjustment mechanism comprising:

a plurality of adjuster assemblies fixedly secured within the elongated channel for adjusting the vertical position of the elongated rail assembly with respect to the elongated sill assembly.

30. The modular exterior threshold and door sill assembly according to claim 27, wherein the adjustment mechanism comprising:

at least one spacer component for uniformly adjusting the vertical position of the elongated rail assembly with respect to the elongated sill assembly along the length of the elongated rail assembly, wherein each of the at least one spacer component is sized to be received in one of the at least one elongated channel and extend the length of the one channel, wherein each of the at least one spacer component has an installed position whereby the spacer component is positioned within the one elongated channel below a lower portion of the elongated rail assembly.

31. An adjustable threshold and door sill assembly, comprising:

an elongated sill assembly having a length, wherein the elongated sill assembly includes at least one elongated channel extending substantially the length of the elongated sill assembly, wherein the elongated sill assembly includes an upwardly extending lip structure positioned adjacent one of the at least one elongated channel;

an elongated rail assembly extending at least a portion of the length of the elongated sill assembly, wherein a portion of the elongated rail assembly is received within the at least one elongated channel, wherein the elongated rail assembly includes a leading portion of the elongated rail assembly that engages the upwardly extending lip structure; and at least one spacer component for uniformly adjusting the vertical position of the elongated rail assembly with respect to the elongated sill assembly along the length of the elongated rail assembly, wherein each of the at least one spacer component is sized to be received in one of the at least one elongated channel and extend the length of the one channel, wherein each of the at least one spacer component has an installed position whereby the spacer component is positioned within the one elongated channel below a lower portion of the elongated rail assembly for supporting the elongated rail assembly in the vertical position.

32. The adjustable threshold and door sill assembly according to claim 31, wherein each of the at least one spacer component has a stored position, wherein an upper portion of the elongated rail assembly includes a rail assembly channel formed therein, wherein the at least one spacer component is located in the rail assembly channel when in the stored position.

33. The adjustable threshold and sill assembly according to claim 32, wherein the elongated rail assembly further includes a removable cover assembly for covering the rail assembly channel.

34. The adjustable threshold and sill assembly according to claim 31, wherein the at least one spacer components includes a plurality of spacer components.

35. The adjustable threshold and sill assembly according to claim 34, wherein the plurality of spacer components are integrally formed as a single unit.

36. A modular exterior threshold and door sill assembly for an entryway, wherein the entryway includes a pair of vertically extending jamb members, a header structure and at least one outward swinging door, comprising:

an elongated sill assembly connected at opposing ends to the pair of vertically extending jamb members, wherein the elongated sill assembly includes a longitudinally extending sill base having a leading edge and a trailing edge, an upwardly extending portion extending from the trailing edge of the sill base, and an upwardly extending lip structure extending from the sill base, wherein the upwardly extending lip structure is laterally spaced from the upwardly extending portion, wherein the upwardly extending lip structure, the upwardly extending lip structure and an interconnecting portion of the sill base form an elongated channel;

an elongated outswing rail assembly extending at least a portion of the length of the elongated sill assembly, wherein a portion of the elongated outswing rail assembly is received within the elongated channel, a leading portion of the elongated outswing rail assembly engages the upwardly extending lip structure, and a trailing portion of the elongated outswing rail assembly contacts a free end of the upwardly extending portion, wherein the elongated outswing rail assembly is selectively positioned within the elongated channel.

37. The modular exterior threshold and door sill assembly according to claim 36, wherein the outswing rail assembly includes a downwardly extending portion adapted to be received within the elongated channel.

38. The modular exterior threshold and door sill assembly according to claim 37, wherein the outswing rail assembly includes an upwardly projecting bumper, and a weatherstripping strip positioned within a recess in the bumper.

* * * * *